US006795981B2

(12) United States Patent
Sato et al.

(10) Patent No.: US 6,795,981 B2
(45) Date of Patent: Sep. 28, 2004

(54) WATER DISCHARGING DEVICE

(75) Inventors: Minoru Sato, Kitakyushu (JP); Makoto Hatakeyama, Kitakyushu (JP); Kinya Arita, Kitakyushu (JP); Yasuo Hamada, Kitakyushu (JP)

(73) Assignee: Toto Ltd., Fukuoka (JP)

( * ) Notice: Subject to any disclaimer, the term of this patent is extended or adjusted under 35 U.S.C. 154(b) by 82 days.

(21) Appl. No.: 10/450,307

(22) PCT Filed: Dec. 28, 2001

(86) PCT No.: PCT/JP01/11675

§ 371 (c)(1),
(2), (4) Date: Jun. 10, 2003

(87) PCT Pub. No.: WO02/055795

PCT Pub. Date: Jul. 18, 2002

(65) Prior Publication Data

US 2004/0019962 A1 Feb. 5, 2004

(30) Foreign Application Priority Data

Jan. 5, 2001 (JP) ..... 2001-000602
Feb. 21, 2001 (JP) ..... 2001-044916

(51) Int. Cl.[7] ..... A47K 3/20; A47K 4/00; E03D 9/08

(52) U.S. Cl. ..... 4/420.4

(58) Field of Search ..... 4/420.4, 420.5, 4/443–448

(56) References Cited

U.S. PATENT DOCUMENTS

| | | | | |
|---|---|---|---|---|
| 4,542,853 | A | 9/1985 | Diamond | |
| 6,092,739 | A | 7/2000 | Clearman et al. | |
| 6,186,414 | B1 | 2/2001 | Clearman et al. | |
| 6,199,771 | B1 | 3/2001 | Clearman et al. | |
| 6,254,013 | B1 | 7/2001 | Clearman et al. | |
| 6,254,014 | B1 | 7/2001 | Clearman et al. | |
| 6,360,965 | B1 | 3/2002 | Clearman et al. | |
| 6,526,602 | B2 * | 3/2003 | Jeon | 4/420.4 |

FOREIGN PATENT DOCUMENTS

| | | | | |
|---|---|---|---|---|
| JP | 08246535 A | * | 9/1996 | E03D/9/08 |
| JP | 2000008452 A | * | 1/2000 | E03D/9/08 |
| JP | 2000282545 A | * | 10/2000 | E03D/9/08 |

* cited by examiner

*Primary Examiner*—Tuan N. Nguyen
(74) *Attorney, Agent, or Firm*—Beyer Weaver & Thomas, LLP

(57) ABSTRACT

A novel water jetting device achieves a water jet of a wide range and an economization of water without using an electric drive device. A water jetting body 10 is so vortex chamber 4 with its water jetting spout 11 confronting the outside of the force receiving member 12 that a force receiving member 12 can oscillate in a position inclined in the vortex chamber 4. A vortex flow thus established in the vortex chamber 4 is caused to make a flow velocity difference around the force receiving member 12, and a force generated on the basis of the flow velocity difference is exerted upon the force receiving member 12 to oscillate the water jetting body 10 in the inclined position in the vortex chamber 4 thereby to jet the cleaning water in the vortex chamber 4 from the water jetting spout 11.

49 Claims, 46 Drawing Sheets

WATER DISCHARGING DEVICE

TECHNICAL FIELD

The present invention relates to a water jetting device for jetting supplied cleansing water from nozzle.

BACKGROUND ART

In the past, when desired to wash with a stronger water stream, it was necessary to jet a larger amount of cleansing water, or with the aim of cleansing a wider area, or to improve cleanliness feel in the case of cleansing the human body, to jet a larger amount of water from the cleansing nozzle over a wider area.

For example, with the aim of cleansing a wide area there has been proposed a method of jetting cleansing water from a cleansing nozzle in a gyrating or roughly gyrating manner, moving the cleansing nozzle per se along a predetermined path while jetting the cleansing water. With this method, as shown in FIG. 1, the cleansing nozzle of a human body localized cleansing device is driven by two motors and by a combination of left/right and forward/backward nozzle movements the cleansing nozzle is moved on a predetermined path.

In JP 10-193776 A and JP 2000-008452 A the kinetic energy of cleansing water pressurized by a water pump is used to turn an impeller. This impeller is integrally provided with a water jetting spout, the water jetting spout being moved on a circular path to create a gyrating jet of water.

In JP 8-246535 A, there is given an example of conically traversing a spout pipe by means of meshing of a fixed gear and a traversing gear having blades traversing by means of a stream of water.

As shown in FIG. 1, those in which the cleansing nozzle per se moves on a predetermined course through a combination of nozzle movements had the following problems.

By means of a combination of nozzle movements cleansing water can be jetted while gyrating or roughly gyrating, but there is a need to move the unit containing the cleansing nozzle forward/backward and left/right, and much power was needed to drive the unit. Also, driving of the unit was accompanied by vibration. Because of this, there was the problem that vibration was a source of noise. Therefore, to drive the cleansing nozzle at vibration strength of a level that does not produce a problem, driving at low speed was essential. That is, nozzle drive was thusly limited to low speed drive, and therefore there was the problem that the speed of gyration or approximate gyration of the cleansing water could not be increased to high speed, or could not be made variable from low speed to high speed.

Also, those in which the kinetic energy of pressurized cleansing water by a water pump is used to turn an impeller, and a gyrating jet of water is jetted from a water jetting spout integral with the impeller had the following problems.

Jetted water from the water jetting spout gyrates along substantially the same path as the water jetting spout. Therefore, to wash a wider area, it is necessary to increase the size of the circular path of the water jetting spout, and to a corresponding degree increase the size of water jetting spout peripheral parts in the circumference diameter direction. Therefore sliding resistance during gyration at high speed increases, high drive power is required. As a result, there was the problem that to obtain this drive power the amount of water and water pressure must be increased.

Also, those in which a spout pipe spouts cleansing water while being conically circled by means of meshing of a fixed gear and a traversing gear having blades traversing by means a stream of water had the following problems.

With this type, the traversing gear traverses under the kinetic energy of a stream of water in order so that the spout pipe traverses along the outside periphery of the fixed gear. Therefore, when spouting cleansing water, due to the action of rotational resistance of the traversing gear and fixed gear, traversing speed is rather low. Also, in the event that scale etc. in cleansing water becomes deposited on gear surfaces, greater water stream kinetic energy will be needed for traversing. Thus, there is the problem that traversing speed drops or traversing halts altogether. Further, as the energy for traversing is provided by the kinetic energy of the water stream, there is the problem that the nozzle per se must be large so that the blades provided to the traversing gear may traverse. Noise and vibration produced by meshing of the gears is also a problem.

Additionally, owing to a sliding portion provided between the nozzle body and the gyrating nozzle, dirt becomes clogged and deposited in the sliding portion in similar fashion to the traversing gear, so that stability of sliding, i.e. reliability of jetting, is lacking.

Also in some instances the user may desire to wash with a strong stream of water nevertheless produced by a low flow rate. To realize a water jet that would meet this desire, it is necessary to channel a low flow rate of cleansing water at high speed. In this respect, since low flow rate means that driving force of the traversing gear declines, traversing of the spout pipe slows, and the user may feel as if the wash point reached by the cleansing water is moving slowly. If so, then it will no longer be perceived that the washed area is being washed all at once. Therefore, in order that an entire wash area be constantly reached by cleansing water, it was necessary, while maintaining cleansing water flow speed, to gyrate the spout pipe, in other words the water jet, at a rate of speed imperceptible to the human body so that the human body has the sensory illusion of the jet of water reaching it over the entire path of gyration. In this respect, channeling cleansing water at a low flow rate means that the spout pipe can only gyrate at low speed, producing a sensation of the wash point moving in linear fashion so that it becomes difficult to create the sensory illusion described above.

It has also been proposed to use a flow element to undulate the water jet. However, this causes cleansing water to splash during jetting, causing a large amount of water that does not contribute to cleansing to be wasted, so that water could not be conserved. Additionally, owing to the design of the flow element, there was the problem that the direction of undulation and frequency of undulation are limited.

Particularly after jetting, that is, after being left exposed to the air, when pulsed using the flow element, the kinetic energy of the jet of cleansing water is consumed in oscillation of the flow element, resulting in the problem of weakening of the force of the water jet.

There is also a need for "soft cleansing of a wide area" as with bidet cleansing by females. The cleansing target of bidet cleansing is more sensitive to vibration etc., and thus where the wash point moves in linear fashion as described earlier, the stimulation produced by water reaching each wash point will be too strong. Therefore, while it is necessary to create the sensory illusion described above by more rapid oscillatory motion of the wash point, the flow element is limited in terms of frequency of undulation, thus making it impossible to realize high speed undulation of wash point.

The present invention was made in order to solve the above problems, and has as an object to propose a novel water jet system cable of cleansing a wider area without entailing nozzle drive. Additionally it is intended to enable high speed water jet motion using water power only, without using any nozzle drive device, water pump or other such drive device, and in the process to conserve energy, reduce cost, and reduce vibration and noise. Water jet reliability is improved as well.

DISCLOSURE OF THE INVENTION

To solve these problems at least in part, a water jetting device of the invention is a device comprising a nozzle, for jetting from the nozzle cleansing water supplied thereto, wherein the nozzle has;

an inflow chamber into which cleansing water flows, a water jetting body assembled in the inflow chamber, having a water jetting member comprising a cleansing water jetting spout and a chamber housed member continuous with the water jetting member and situated within the inflow chamber, the water jetting body having a conduit for guiding cleansing water in the inflow chamber to the water jetting spout, and a water supply mechanism for guiding cleansing water into the inflow chamber in such a way that vortical flow around the chamber-housed member along the inside peripheral wall of the inflow chamber is created in cleansing water flowing into the inflow chamber, the water jetting body is assembled in the inflow chamber with the water jetting spout located in proximity to the exterior of the inflow chamber, such that the chamber-housed member is capable of swinging in an inclined attitude within the inflow chamber, and the water supply mechanism generates a flow velocity differential in the vortical flow around the chamber-housed member, the force generated on the basis of the flow velocity differential exerting influence on the chamber-housed member whereby the chamber-housed member at an inclined attitude within the inflow chamber induces swinging motion and revolution of the water jetting body.

The water jetting device of the present invention having the arrangement described above guides cleansing water into the inflow chamber from the water supply mechanism and creates vortical flow around the chamber-housed member in this inflow chamber. This vortical flow generates a flow velocity differential around the chamber-housed member, so that within the inflow chamber force is generated on the basis of this flow velocity differential. This force is similar in nature to lift which, when a physical object moves through a fluid, acts on the physical object on the basis of a velocity differential of fluid to either side of the physical object. Therefore, in the following description, the force based on flow velocity differential shall be termed lift for the purpose of simplifying the description.

In this way, regarding the lift FL created when the chamber-housed member is arranged within the inflow chamber and vortical flow generated around the chamber-housed member, at the point in time of occurrence thereof, the velocity of the chamber-housed member is zero and, in relative terms, is affected by the flow velocity V [m/sec] of the vortical flow. This lift $F_L$ is given by the following equation, where L[m] is a physical quantity, namely length, corresponding to the maximum projection area S of the chamber-housed member subjected to lift, and ρ [kg/m$^3$] is the density of the cleansing water.

$$F_L=(\rho\cdot V^2\cdot C_L\cdot L)/2 \quad [N]$$

When lift $F_L$ acts on chamber-housed member in this way, as a result drag $F_D$ (=$(\rho\cdot V^2\cdot C_D\cdot L)/2$[N]) acts on the chamber-housed member as well. $C_D$ is the drag coefficient.

Positing now a condition in which vortical flow has been generated around the chamber-housed member in the inflow chamber, lift acts on the chamber-housed member in the manner described earlier. This lift is directed outwardly to the side of high flow velocity of the vortical flow around the chamber-housed member from the vortical flow center. Meanwhile, the chamber-housed member, being capable of swinging in an inclined attitude within the inflow chamber, receives this lift and inclines thereby, tilting towards the inflow chamber wall as well as operating in the direction of resultant force of this lift and drag. As drag occurs along the flow direction of the vortical flow, this resultant force operates in a direction moving the chamber-housed member along the flow direction of the vortical flow.

At this point the condition of flow differential of vortical flow around the chamber-housed member changes as well, and by means of lift and drag under this new condition, the chamber-housed member moves in flow direction of the vortical flow while maintaining its inclined attitude. Thus, the water jetting body undergoes swinging motion and revolves within the inflow chamber. This revolution shall be termed "swinging revolution". As the water jetting spout of the water jetting body is in proximity to the exterior of the inflow chamber, cleansing water guided into the water jetting spout is jetted in conical configuration with the water jetting body swinging location as the apex. Even with such jet, revolution occurs on the pattern of swinging revolution. Such jet shall occasionally be abbreviated to "revolving jet".

Moreover, as the chamber-housed member receives lift and inclines to the inflow chamber wall side, this chamber-housed member becomes pushed directly by the vortical flow of the inflow chamber. Therefore, the chamber-housed member receives direct kinetic energy from the vortical flow and moves in the flow direction of the chamber-housed member while maintaining an inclined attitude, thereby accelerating swinging revolution of the water jetting body.

Kinetic energy A herein refers to that defined by the following equation and is energy dominated by the flow of water (vortical flow).

$$A=(\rho\cdot V^2\cdot Q)/2 \quad [W]$$

Here, Q represents instantaneous flow rate [m$^3$/sec] and R represents the turning or circling radius (m) of the water.

Centrifugal force refers to that defined by the following equation and is force generated by revolution of the chamber-housed member due to turning or circling of water, and is force generated in turning radius direction of revolution or circling.

$$F=MV^2/R \quad [N]$$

Here, M represents the mass of the water jetting body, V the velocity of revolution, and R the radius of revolution.

As a result of these, according the water jetting device of the present invention, there can be realized cleansing water jetted water of conical configuration unaccompanied by driving of the nozzle per se, whereby wide area cleansing water contact, i.e. cleansing over a wide area may be improved.

Further, in terms of improving such wide area cleansing, it is sufficient to improve the cleansing water inflow to the inflow chamber to generate vortical flow, this vortical flow giving rise to swinging revolution of the water jetting body in the inflow chamber. Therefore, as compared to the case where the nozzle per se moves over a path and jets water while gyrating or roughly gyrating, the motion component is small. Additionally, swinging revolution of the water jetting body is created exclusively by vortical flow of cleansing water, so there is no need whatsoever for a motor or other such actuator to realize this swinging revolution. Thus, no noise and vibration occur from actuator drive, providing the advantage of superior noise and vibration silence. For example, where this water jetting device is employed as a human body part cleansing device for cleansing a local part of the human body, there may be provided a human body part cleansing device of superior noise and vibration silence. Additionally, as there is no need for meshing of gears etc. there is no clogging with dirt or the like, and reliability of jet may be increased.

In addition to the small member of moving members, there is no actuator or other such electrical drive portion, so an extremely compact human body part cleansing device can be provided. Further, in addition to the lack of problems with durability of an electrical drive portion, no electrical wiring to the nozzle tip is required. Therefore there is no consideration of ground fault, and the assembly operation and maintenance operation may be simplified, structure simplified, and accordingly costs reduced.

Swinging revolution of the water jetting body to achieve the wide-area jet described above occurs by assembling the water jetting body in the inflow chamber and vortical flow generation through cleansing water introduction into the inflow chamber, so structure can be simplified and cost reduced. Through simplified structure miniaturization of the device can be improved.

The condition of producing flow differential around the chamber-housed member can be adjusted through the condition of cleansing water introduction into the inflow chamber, inflow chamber shape etc. Therefore, the condition of swinging revolution of the water jetting body is also adjustable making possible diversification of jet mode. For example, the aforementioned lift and centrifugal force can be increased to make the water jetting body jet while undergoing swinging revolution at high speed, or the swinging revolution condition of the water jetting body can be stabilized to achieve stabilized jet.

Where the water jetting body undergoes swinging revolution at high speed, the wash point contacted by the jet of cleansing water will move at high speed as well. That is, by increasing the revolution frequency defined by this swinging revolution cycle, the human body made be made to experience the sensory illusion of the entire cleansing water contact area (aggregate location of water contact points) being contacted by water. Thus, with a human body part cleansing device implementing this water jetting device, through a sensory illusion of high speed movement of water contact point there can be realized a soft, wide area cleansing requirement, which is desirable.

Still further, lift is created separately from the kinetic energy possessed by the cleansing water, and this lift contributes to swinging revolution of the water jetting body and higher speed thereof. Therefore, compared to using a flow element, there is no risk of diminishing the force of the jet.

Also, even if transitioning of water contact to each wash point should occur, the aforementioned sensory illusion occurs, so there is no need for a continuous jet such that cleansing water simultaneously contacts the entire water contact area. Therefore, to that extent, there is a water conserving effect.

The water jetting device of the present invention can take various modes.

For example, having made the inflow chamber of cylindrical shape, the chamber-housed member of the water jetting body can be made of round columnar shape. By so doing, each shape is simple, so the manufacturing cost thereof can be reduced.

Having adopted such a shape, making the outside diameter of the chamber-housed member about 35–80% of the inside diameter of the inflow chamber has the following advantages.

To induce vortical flow around the chamber-housed member in the inflow chamber, making the cleansing water inflow to the inflow chamber eccentric with respect to the inflow chamber and using a nozzle conduit communicating with the inflow chamber wall is simple. When creating cleansing water inflow in this manner, where the outside diameter of the chamber-housed member and the inside diameter of the inflow chamber are in the aforementioned relationship, in the state immediately after cleansing water initially flows into the inflow chamber, the inflowing cleansing water reliably occurs with a flow differential in the vortical flow around the chamber-housed member along the inflow chamber inner wall. Thereby, stabilization of swinging revolution/jet pattern of the water jetting body may be imparted.

In contrast to this, if chamber-housed member outside diameter is larger than the above range the chamber-housed member outer wall becomes too close to the inflow chamber inner wall so the cleansing water eccentrically inflowing to inflow chamber tends to collide with the chamber-housed member and rebound, creating disturbance in the vortical flow around the chamber-housed member. As a result, the aforementioned lift cannot be brought about favorably and swinging revolution of the water jetting body, and hence the jet pattern, becomes unstable.

Also, the outside diameter of the chamber-housed member and the inside diameter of the inflow chamber are in the aforementioned relationship, the width of the vortical flow occupying the space between the chamber-housed member outer wall and inflow chamber inner wall is suitable, and the speed distribution peak across the width of this vortical flow will not be unintentionally maldistributed to the inflow chamber inner wall side. Therefore, the peak location and chamber-housed member are relatively close together, making it easy for lift to act on the chamber-housed member. In contrast to this, where the chamber-housed member outside diameter is smaller than the aforementioned range the space between the inflow chamber inner wall and the chamber-housed member outer wall is greater, the width of the vortical flow is greater, and the vortical flow circles around the chamber-housed member of small diameter. Therefore, the aforementioned speed distribution peak is maldistributed to the inflow chamber inner wall side and the peak location and the chamber-housed member are further apart, making it difficult for lift to act on the chamber-housed member. As a result, the swinging revolution/jet pattern of the water jetting body becomes unstable.

At least one of the inflow chamber and the chamber-housed member may have a peripheral wall shape creating a difference in flow velocity of vortical flow around the chamber-housed member, for example, peripheral wall regions with different curvature rates. Even if this is done vortical flow having flow velocity differential can be reliably produced around the chamber-housed member along the inflow chamber inner wall, so swinging revolution/jet pattern of the water jetting body can be given stability.

When using a nozzle conduit communicating with the inflow chamber wall and eccentric to the inflow chamber, by having a plurality of these nozzle conduits vortical flow can be created by cleansing water flowing into the inflow chamber from the plurality of nozzle conduits. By so doing vortical flow around the chamber-housed member in the inflow chamber can be induced easily and reliably.

In such case, by making the plurality of nozzle conduits to inflow cleansing water at different flow velocities, or to have different conduit area, it is achieved to inflow of cleansing water at different flow velocities. As regards at least one of the plurality of nozzle conduits, it is satisfactory to give it a faculty of inflow cleansing water at different flow velocities, or an inflow different conduit area.

The plurality of nozzle conduits may also be made to communicate with the inflow chamber peripheral wall at asymmetric locations with respect to the center of the inflow chamber. By so doing vortical flow around the chamber-housed member in the inflow chamber can be induced easily and reliably.

The water jetting body having the nozzle may be made so that the chamber-housed member inclines with respect to the inflow chamber during non-jetting when there is no inflow of cleansing water to the inflow chamber. For example, the nozzle can be made to assume an inclined attitude relative to the horizontal plane, and the water jetting body made to incline the chamber-housed member thereof with respect to the inflow chamber due to the action of gravity thereon when not jetting. By so doing, the space between the inflow chamber inner wall and the chamber-housed member of the water jetting body can be narrowed from prior to inflow of cleansing water to the inflow chamber. Thus, from the onset of inflow of cleansing water to the inflow chamber the flow velocity of cleansing water passing through the narrowed space can be raised and a vortical flow velocity differential can be reliably created. Thus, the lift described above can be reliably created from the onset of inflow of cleansing water, facilitating stabilization of swinging revolution/jet pattern of the water jetting body.

When inclining the water jetting body in this manner, the following may be done. That is, a projection may be provided in the center of the inflow chamber floor and this projection used to incline the chamber-housed member of the water jetting body with respect to the inflow chamber during non-jetting. Even where this is done, lift can be reliably created from the onset of inflow of cleansing water, facilitating stabilization of swinging revolution/jet pattern of the water jetting body. Such a projection may also be provided to the bottom end of the inflow chamber of the water jetting body.

The inflow chamber may be made to have a tapered inner peripheral wall of small diameter at the water jetting body the chamber-housed member end, and the chamber-housed member of the cleansing water given a column shape. By so doing, the gap between the outside face of the inclined the chamber-housed member and the inner wall of the inflow chamber can be made about equal to the length of the chamber-housed member. Thus, after the chamber-housed member has initially inclined, the flow rate as the vortical flow passes through the aforementioned gap can be accelerated in substantially the same manner over the entire length of the chamber-housed member. That is, the length contribution to generation of lift is increased so that lift may be increased. As a result, the drag accompanying lift increases as well, and the velocity of swinging revolution of the water jetting body increases. Additionally, the range over which interference with the vortical flow becomes longer, so the chamber-housed member is rotated directly by the vortical flow along the direction thereof. Thus, centrifugal force increases, and higher velocity of swinging revolution of the water jetting body, and hence swinging revolution of the water jetting body on a stabilized path and stabilized water jetting, may be realized easily.

The water jetting body installed within the inflow chamber comprises the water jetting member as a column body smaller in diameter than the chamber-housed member. By so doing, the water jetting spout of the water jetting body may be made to border the outside of the inflow chamber at the small diameter end of the inflow chamber and the chamber-housed member to revolve in the manner described above, whereby the central portion of swinging movement of the water jetting body (the chamber-housed member) becomes smaller in diameter. Therefore, the pressure-receiving area of the water pressure of cleansing water from the inflow chamber is narrowed, and resistance in the central portion during revolution is lower as well. These points are also advantageous in terms of accelerating and stabilizing swinging revolution of the water jetting body.

Further, the inflow chamber may have an opening, with the water jetting spout of the water jetting member in the water jetting body being made to border the outside from the opening, and the peripheral edge of the opening being made a swivel plate for the distal end of the water jetting member.

When the water jetting body jets cleansing water from the water jetting spout thereof, the vortex chamber is substantially filled with cleansing water, and the cleansing water is guided to the water jetting spout of the water jetting body. In this condition, the water jetting body per se is pushed upwardly. Even in this case the chamber-housed member is subjected to lift giving rise to swinging motion in an inclined attitude as described earlier, and the water jetting body undergoes swinging revolution.

During swinging revolution of the water jetting body, the aforementioned upward pushing causes the distal end of the chamber-housed member to be pushed against the rim of the opening. Incidentally, during this pushing the water jetting body per se is undergoing swinging revolution, so the distal end of the chamber-housed member can be made to give rise to so-called "one-sided touching" with the rim of the opening on the side to which the water jetting body is inclined. By so doing the distal end of the chamber-housed member is apart from the rim of the opening in areas other than the side to which it inclines, and in association with swinging revolution of the water jetting body, the position of at which the distal end of the chamber-housed member contacts the rim of the opening changes while maintaining one-sided touching. Thus, cleansing water within the inflow chamber attempting to leak out from the distal end of the chamber-housed member in non-one-sided touching areas thereof can be made to function as seal water of the distal end of the chamber-housed member. Therefore, no special lubricants or lubrication function is required at the chamber-housed member distal end or rim of the opening, providing a simpler arrangement and simplifying maintenance/inspection and assembly operations.

During swinging revolution of the water jetting body the chamber-housed member distal end is merely made to undergo one-sided touching, so contact between the chamber-housed member distal end and rim of the opening occurs over only a small area. Therefore, frictional force associated with contact can be reduced, which is desirable in terms of preventing wear.

The inflow chamber can be designed to have at the rim of the opening an annular projecting portion projecting towards the chamber-housed member distal end. By so doing, where the chamber-housed member distal end is one-sided touching in the manner described above, the chamber-housed member distal end is in one-sided touching contact with the annular projecting portion only, which has the advantage of stabilizing one-sided touching, the aforementioned wear prevention, etc. In this case, even if wear should occur, along the circumference of the rim of the opening the location of contact between the rim of the opening and the chamber-housed member distal end does not change, so there is no functional impairment such as a drop in speed due to wear.

Making the chamber-housed member distal end of sloping face shape, spherical shape or arcuate shape provides the advantage of stabilizing one-sided touching and preventing wear. Making the peripheral edge of the chamber-housed member distal end of tapered shape or chamfering it to arcuate shape provides the advantage of stabilizing one-sided touching, the aforementioned wear prevention, etc.

By making the rim of the opening of spherical shape and making the chamber-housed member distal end of convex spherical shape conforming to this spherical shape the chamber-housed member distal end can be received by the rim of the opening over substantially the entire circumference thereof. Here as well it is possible to stabilize swinging revolution of the water jetting body.

In the manner described above the chamber-housed member of the water jetting body is subject to the action of lift based on vortical flow, as well as to centrifugal force by being pushed along by the vortical flow. Thus, where the chamber-housed member has high mass, inertia (=centrifugal force) increases where the chamber-housed member initially revolves in an inclined attitude by lift/centrifugal force. This provides advantages in terms of stabilizing swinging revolution of the water jetting body and stabilizing revolving jet. In terms of increasing the mass of the chamber-housed member, simple methods for doing so are to fabricate the zone of metal, and to fabricate the water jetting member continuous therewith of resin. In terms of producing the water jetting member and the chamber-housed member with the former made of resin and the latter of metal, a production method such as insert molding is advantageous in terms of productivity and lower cost.

The water jetting body can be made to undergo the aforementioned revolution (swinging revolution) while undergoing rotation whereby the water jetting body per se turns about the axis of the chamber-housed member. By so doing, as the water jetting body performs revolving jet in a conical pattern due to swinging revolution, a speed component in the direction of rotation is imparted to the cleansing water by rotation of the water jetting body. Thus, cleansing water (i.e. cleansing water undergoing revolving jet in a conical pattern) is dispersed by centrifugal force around the rotation axis produced by rotation of the water jetting body, so that cleansing water jet can cover a wider area. Additionally, since the cleansing water is dispersed, revolving jet in a conical pattern per se is expanded so that jet can be produced with negligible "hollowing".

The water jetting body can have the conduit leading to the water jetting spout of the water jetting member inclined with respect to the rotation axis of the water jetting body. By so doing, the jet path of cleansing water from the water jetting spout becomes a synthesized path of a conical revolving jet path produced by swinging revolution of the water jetting body, and the following path. That is, as the conduit leading to the water jetting spout is inclined with respect to the rotation axis of the water jetting body, a conical jet of cleansing water with respect to the rotation axis as well is emitted from the water jetting spout. Thus, jet is produced over a synthesized path of this jet path and the aforementioned conical revolving jet path, thereby realizing jet free from hollowing even where cleansing water is jetted over a wider area. When realizing this wide area jet, there is no special need to increase the amount of water, it being sufficient merely to induce rotation of the water jetting body, enabling water conservation to be carried out efficiently.

Where a wide area jet including rotation of the water jetting body is not required, it is sufficient for the conduit leading to the water jetting spout to be inclined, without being rotated. By so doing the center axis orientation of the conical revolving jet, that is, the direction of orientation of the conical revolving jet, can be inclined in conformance with the incline of the conduit, without changing nozzle position. Therefore, the orientation of the cleansing water (direction of orientation of the conical revolving jet) can be changed without being subject to limitations of nozzle position and attitude, increasing the degree of freedom in nozzle layout.

The water jetting body may have the conduit leading to the water jetting spout of the water jetting member eccentric with respect to the rotation axis of the water jetting body. By so doing, the jet path of cleansing water from the water jetting spout can be made a combination of a conical revolving jet path produced by swinging revolution of the water jetting body, and a circular path based on eccentricity of the water jetting spout, thereby enabling a conical jet free from hollowing to be carried out even where cleansing water is jetted over a wider area. As with the case where the conduit is inclined, water conservation to be carried out efficiently.

Where a wide area jet including rotation of the water jetting body is not required, it is sufficient for the conduit leading to the water jetting spout to be eccentric, without being rotated. By so doing the conical revolving jet can be offset to the eccentric location side of the conduit without changing nozzle position. Therefore, the orientation of the cleansing water (direction of orientation of the conical revolving jet) can be offset without being subject to limitations of nozzle position and attitude, increasing the degree of freedom in nozzle layout.

When furnishing the water jetting member with a water jetting spout, the water jetting spout may be made in a slot shape or dilated taper shape. By so doing, the conical revolving jet path can be expanded to one such that cleansing water of a shape conforming to water jetting spout shape revolves. Thus, jet can be generated reliably without hollowing, as with conduit inclination/eccentricity, water conservation efficiency can be increased.

Additionally, it is preferable to provide a rectifier mechanism for rectifying the flow of cleansing water when guiding the cleansing water to the water jetting spout, or form the water jetting spout of a plurality of openings. By so doing, conical revolving jet can be stabilized to an even greater degree, so jet reliability can be improved.

The degree of inclination of the chamber-housed member of the water jetting body in the inflow chamber can be wide/narrow adjusted. By so doing the extent of spread of the conical revolving jet can be wide/narrow set, making it easy to obtain various wash areas.

Additionally, the nozzle can have a flexible clasp body for clasping the water jetting body, with the inflow chamber closed off by the clasp body. By so doing, it is a simple matter to avoid rotation of the water jetting body as described above.

Also, to solve the above problems at least in part, an another water jetting device of the invention is a device comprising a nozzle, for jetting from the nozzle cleansing water supplied thereto, wherein the nozzle has;

an inflow chamber into which cleansing water flows, a water jetting body assembled in the inflow chamber, having a water jetting member comprising a cleansing water jetting spout and a chamber-housed member continuous with the water jetting member and situated within the inflow chamber, the water jetting body having a conduit for guiding cleansing water in the inflow chamber to the water jetting spout, a flexible clasp body for clasping the water jetting body, the clasp body, with the water jetting spout being placed bordering the outside of the inflow chamber, providing closure to the inflow chamber such that the chamber-housed member is assembled within the inflow chamber so as to be capable of swinging in an inclined attitude within the inflow chamber;

a water supply mechanism for guiding cleansing water into the flow chamber; and a transmission mechanism for creating vortical force around the inner peripheral wall of the inflow chamber by means of cleansing water inflow to the inflow chamber through the water supply mechanism, exerting the vortical force on the chamber-housed member, and creating swinging movement and revolution of the water jetting body with the chamber-housed member in an inclined attitude within the inflow chamber.

This another water jetting device of the invention having the above arrangement guides cleansing water from the water supply mechanism to the inflow chamber, creates vortical force in the inflow chamber around the inner peripheral wall thereof, and exerts this vortical force on the chamber-housed member via transmission mechanism. Meanwhile, the chamber-housed member is capable of swinging in an inclined attitude in the inflow chamber, and thus receives this vortical force as-is while inclined and circles (revolves) through the inflow chamber along the direction in which the vortical force is applied.

Incidentally, since the water jetting body is clasped by the clasp body which closes the inflow chamber, unlike the water jetting device described above, the water jetting body cannot be made to rotate. Since the clasp body is flexible, the clasp body undergoes deformation with revolutional movement of the chamber-housed member and does not hinder revolution of the chamber-housed member. The water jetting body revolves while undergoing swinging movement (swinging revolution) in the inflow chamber. The water jetting spout of the water jetting body borders the outside of the inflow chamber, so cleansing water guided to the water jetting spout is jetted in a conical pattern with the swinging position of the water jetting body as the apex. With jetting in this manner as well, revolution after the pattern of swinging revolution of the water jetting body produces a conical revolving jet.

That is, this another water jetting device of the present invention can realize a conical cleansing water jet without driving the nozzle per se, whereby cleansing water contact over a wide area, i.e. wide area cleansing, can be created.

In terms of creating such wide area cleansing, it is sufficient to create generation/imparting/transmission of vortical force of the cleansing water inflow into the inflow chamber to give rise to swinging revolution of the water jetting body within the inflow chamber. Therefore, the motion component is smaller than is the case where the nozzle per se is moved along a predetermined path and cleansing water jetted while gyrating or roughly gyrating. Additionally, swinging revolution of the water jetting body is created through the introduction of cleansing water into the inflow chamber, so no motor or other actuator is required to realize this swinging revolution. Thus, no noise or vibration occurs from actuator drive, providing the advantage of superior noise and vibration silence. Therefore, where this another water jetting device of the present invention is employed as a human body part cleansing device, there may be provided a human body part cleansing device of superior noise and vibration silence. Additionally, as there is no need for meshing of gears etc. there is no clogging with dirt or the like, and reliability of jet may be increased.

In addition to the small motion component, there is no actuator or other such electrical drive portion, so an extremely compact human body part cleansing device can be provided. Further, in addition to the lack of problems with durability of an electrical drive portion, no electrical wiring to the nozzle tip is required. Therefore there is no consideration of ground fault, and the assembly operation and maintenance operation may be simplified, structure simplified, and accordingly costs reduced.

Also, swinging revolution of the water jetting body to realize the aforementioned wide area jet is created by assembling the water jetting body in the inflow chamber and creating vortical flow through introduction of cleansing water into the inflow chamber, so that simpler structure, lower cost and a more compact device can be produced.

The vortical force exerted on the chamber-housed member can be adjusted by changing the circumstances of cleansing water introduction to the inflow chamber. Therefore, through higher velocity or stabilization of vortical force, higher velocity or stabilization of swinging revolution by the water jetting body may be created, providing working effects similar to the preceding water jetting device.

The fact that rotation of the water jetting body is not produced as described above means that the water jetting body rotates in succession to the clasp body and nozzle. Therefore, no position displacement to varying degrees or temporary rotation of the water jetting body is included.

By integrally arranging the water jetting body and the clasp body, there is no need to seal or screw together the water jetting body and the clasp body. Therefore, assembly can be simplified and reliability improved as well without fastening parts together.

In these instances, the clasp body preferably further comprises a cylindrical clasp member for mating with the water jetting body and clasping the water jetting body, and causes the pressure of cleansing water inflowing into the inflow chamber to act against the outside wall of the cylindrical clasp member. By so doing, the cylindrical clasp member per se can be constricted by cleansing water pressure, so sealing by the water jetting body can be increased on its own. As a result, seal reliability can be improved and cleansing water leakage from the cylindrical clasp member held to an acceptable level. Also, since leaking cleansing water from the cylindrical clasp member is minimal, disturbance of the revolving jet from the water jetting spout by this leaking cleansing water can be avoided, which is advantageous in stabilizing the revolving jet. Further, since bonding of the water jetting body to the clasp body is not required, there is no need for an adhesive and an application step therefor. A simpler production process may therefore be realized.

The clasp body can be made to differ in thickness of the clasp body going in the radial direction from the center of the water jetting body clasp zone. By so doing, deformation of the clasp body during swinging revolution of the water jetting body is facilitated, impairment of swinging revolution of the water jetting body avoided further, and the reliability of swinging revolution enhanced. Even where the clasp body is made thinner in a portion thereof to facilitate deformation of the clasp body, by making the clasp body thicker in localized fashion to provide reinforcement, breakage of the clasp body can be prevented. That is, by making clasp body thickness gradually different and non-uniform in the radial direction, it is possible to improve strength and reliability while retaining the pliability needed for swinging revolution of the water jetting body. Alternatively, a sharp transition in clasp body thickness from the thin portion of the thick portion is acceptable as well.

The clasp body may have a convex flex member at the outside around the clasp zone of the water jetting body clasped with the clasp body. By so doing, deformation of the flex portion in the flexing direction is facilitated even without making the clasp body extremely thin, thus further facilitating deformation of the clasp body. Therefore, it can be made easy to generate swinging revolution of the water jetting body while retaining the strength of the clasp body.

When manufacturing the clasp body, any of polyester based, polyolefin based, or polystyrene based thermoplastic elastomers is preferred. By so doing there is no need for a vulcanization step as is required when using synthetic rubber, and injection molding can be used as a production technique. Therefore it is possible to reduce production time, lower costs, and recycle. Further, there are no bonded portions or joined portions as when the water jetting body and the clasp body use adhesives, screws etc., and joinability with common resin materials used for the nozzle (PP (polypropylene), ABS (acrylonitrile-butadiene-styrene copolymer), and POM (polyacetal)) is good so improved sealing and improved reliability may be achieved.

Also, the clasp body can be composed of resin and made into a bending sheet utilizing the elasticity of the resin. By so doing, where the clasp body is used for a nozzle such that high water pressure will bear on the water jetting body and the clasp body, there is more resistance to permanent strain, breakage etc. due to elongation and deformation than would be the case where rubber, elastomer etc. is used.

In this case, as the resin for forming the clasp body it is preferable to use any of (PP (polypropylene), ABS (acrylonitrile-butadiene-styrene copolymer), or POM (polyacetal)). By so doing, even where used as a cleansing nozzle in a human body part cleansing device, elastic deformation is imparted by the ample strength and excellent pliability, and is advantageous. It is also suitable for the utilized flex portion. Additionally, through the use of these resin, excellent moldability and productivity are given, which is advantageous in cost reduction.

The clasp body giving the water jetting body swinging revolution as described above can be made to fulfill the ratio value f/fn of $0.5 \leqq (f/fn) \leqq 10$, where fn is the natural frequency thereof and f is the frequency defined by the cycle of revolution produced by the water jetting body. By so doing there are the following advantages. First, of this relationship, the case of the ratio value f/fn being $0.5 \leqq (f/fn) \leqq 1.5$ is described.

As is generally known, if the aforementioned ratio value f/fn is $0.5 \leqq (f/fn) \leqq 1.5$, f and fn are in a relationship of readily resonating. Therefore, the clasp body vibrates in combination with swinging revolution of the water jetting body, and this cyclic swinging revolution of the water jetting body and the vibration of the clasp body are in a relationship of readily resonating. Therefore, by resonance of the swinging revolution of the water jetting body and vibration of the clasp body, the swinging revolution of the water jetting body can be made larger, and the water jetting body can be made to undergo larger swinging revolution with a small stream of water. By optimizing the rigidity, size and weight of the clasp body the value of f/fn can be optimized.

The frequency of swinging revolution of the water jetting body in this case can be determined, for example, by determining the characteristic peak appearing when frequency analysis is performed with a sensor located on a certain portion of the path. Or, it can be determined from video photography or still photography, or from flow velocity. Frequency herein is used to include averaged frequency profile obtained when there is fluctuation or width of frequency, and this is so in the following examples as well.

On the other hand, where the ratio value f/fn is $1.5 < (f/fn) \leqq 10$, the following is true. As is generally known, in the case of such a relationship f and fn are in a damping relationship that readily attenuates vibration. Therefore, while the clasp body vibrates in combination with swinging revolution of the water jetting body, this cyclic swinging revolution of the water jetting body and the vibration of the clasp body are in a relationship of ready attenuation. Accordingly, there is no problem of vibration generated by swinging revolution of the water jetting body and vibration of the clasp body being transferred to the nozzle and water jetting device, creating noise and vibration. Here, if the fn value is decreased even further, i.e. the value of f/fn increased, greater damping action is obtained. To reduce the fn value in this way it is necessary to make the clasp body rigidity and constant extremely small, and the strength of the clasp body per se may drop, so preferably f/fn will be held to 10 or less.

Even where swinging revolution is generated without generating rotation of the water jetting body in the manner described above, as with the water jetting device described previously, the water jetting body may be designed with conduit leading to the water jetting spout of the chamber-housed member inclined with respect to the center axis of the water jetting body. By so doing the jet direction, i.e. the orientation direction of the conical revolving jet, can be inclined without changing the nozzle position. Therefore, cleansing water orientation can be changed without being subject to limitations in terms of nozzle placement. For example, where used in a human body part cleansing device, by offsetting the orientation direction of the conical revolving jet in the nozzle advance direction, soiled water after cleansing can be prevented from again falling on the nozzle during cleansing. Alternatively, by conversely offsetting rearward with respect to the advance direction, splattering in the forward direction can be prevented during cleansing.

In any of the water jetting devices described above, the nozzle has a plurality of the inflow chambers and the water jetting bodies assembled therein. By so doing there is imparted a jet in a configuration resembling aggregated jets over a wide area, allowing the wash area to be expanded even further. Therefore, this is suitable for cleansing a wide area such as with a shower device. In this case, the water jetting bodies with different paths of swinging revolution of the water jetting body, revolution frequencies etc. may be placed appropriately so that jetting may be performed selectively by each water jetting body. By so doing, a water jetting body having a path of revolution and revolution frequency suitable to the purpose of cleansing may be selected to perform the desired cleansing.

When performing swinging revolution of the water jetting body as described hereinabove, any of various revolution frequencies may be used. For example, the frequency of swinging revolution of the water jetting body may be set to 3 Hz and more. When a water jetting body having such a frequency is used as a cleansing nozzle of a human body cleansing device, so that the contact point of the cleansing water with the human body in actual practice transitions at a frequency above 3 Hz. However, with water contact point transitioning at such a frequency the human body cannot readily discern that the water contact point is transitioning. Thus, it is possible to create a sensory illusion just as if cleansing water was contacting over the entire path of a conical revolving jet, and as a result the amount of cleansing water can be reduced. At this time, naturally the swinging revolution velocity at the same give swinging revolution frequency will differ between a small and large target wash area, and where the wash area is small a low movement speed will be satisfactory, and where the wash area is large the movement speed will be higher.

Where the frequency of swinging revolution of the water jetting body is set to 40 Hz and more, there are the following advantages.

As noted earlier, the wash target in bidet cleansing is sensitive and delicate, and the surface layer of the skin has extremely sensitive sensory receptors. Therefore, even with relative slow vibration and stimulation change of about 3–40 Hz, this will be perceived by the sensory receptors so that the user will perceive unpleasant vibration and stimulation.

However, where a nozzle having a water jetting body swinging revolution frequency of 40 Hz and more is used as a cleansing nozzle for a human body cleansing device (female localized cleansing device), vibration and stimulation change kin the range of about 3–40 Hz is not imparted, so the sensation of unpleasant vibration and stimulation can be ameliorated.

In particular, by setting the frequency of swinging revolution of the water jetting body to 160 Hz and below, there are the following advantages.

Where the swinging revolution frequency of the water jetting body is set to 160 Hz and more, contact of water to sensitive areas of the human body is substantially not perceivable as swinging revolution of the water jetting body (transition of the water contact point). This is true even if the swinging revolution frequency is increased further.

Incidentally, the greater the extent to which the swinging revolution frequency is increased, the greater the centrifugal force generated by swinging revolution of the cleansing water. Thus, the cleansing water, being subjected to this centrifugal force, will expand outwardly from the initial path of swinging revolution, producing wetting of locations outside the desired range. Increasing the swinging revolution frequency, i.e. the swinging revolution velocity, causes an increase in the air resistance to which the cleansing water is subjected and creating dispersion and splashing of the cleansing water due to air shear. This creates waste of water. Accordingly, by holding swinging revolution frequency to 160 Hz and below, unwanted expansion of the wash area and water waste may be checked, so that it is possible to maintain a proper wash area and improve water conservation efficiency.

Also, setting an upper limit of about 380 Hz for the frequency of swinging revolution of the water jetting body has the following advantages. FIG. 2 is a descriptive diagram describing the condition at which splashing of cleansing water occurs.

Where the nozzle of the water jetting device of the present invention is used as a cleansing nozzle for a human body cleansing device, as shown in FIG. 2, from the viewpoint of splashing water, the jet wash area L1 is typically limited to about 30 mm or less. Moreover, the following is true as regards the velocity of the jet at maximum jet.

Where the velocity of the jet direction component is V1 (approximately 12 meters per second), let the circumferential direction velocity component be V2. Since the maximum distance to a local area of the human body is L2 (about 150 mm maximum), let jet width be assumed to be at the minimum (i.e. zero), and dispersion of the jet to occur through rotation only. By so doing, where the jetted cleansing water is dispersed and expanded by means of the circumferential direction velocity component, the relationship $$V2/V1 \leqq (L1/2)/L2$$

is desirable in terms of minimizing cleansing water splashing. Where this relationship holds, even if the jetted cleansing water is dispersed as splashed water drops separating from the surface of the jet due to the circumferential direction velocity component, the splashing drops enter a range (wash range L1) such that splashing on the washed portion of the human body is not bothersome. That is, the above relationship is the minimum requirement for avoiding unwanted splashing.

Accordingly, from the above relationship it is preferable for the circumferential direction velocity component V2 to be no more than 1.2 meters per second. Where D1 is water jetting spout diameter, the rotation frequency $f_j$ is $V2/(D1 \cdot \pi)$, and the water jetting spout diameter D1 is typically a minimum of about 1 mm. Therefore, rotation frequency $f_j$ is preferably such that $f_j \leqq 380$ Hz.

While the case where jet width due to swinging revolution is at zero minimum has been considered, when jet width due to swinging revolution is greater than this, it will be necessary to further reduce the swinging revolution frequency. Therefore, as with the rotation frequency $f_j$ mentioned earlier, the swinging revolution frequency of the water jetting body must as a mandatory condition be 380 Hz and below, regardless of the size of jet width due to swinging revolution. Similarly, with regard to flow rate as well, flow velocity during maximum jet amount has been considered, but where jet amount, that is, flow velocity, is lower, it will be necessary to further reduce the size of jet width due to swinging revolution, since splashing is large in this direction. Accordingly, it will be necessary to hold the swinging revolution frequency of the water jetting body to 380 Hz and below so that splashing is not a concern when the jet area is broadened.

The water jetting device described above may be implemented in various devices for jetting water to wash articles for cleansing. For example, besides the human body part cleansing device and the shower device described previously, it may be used for a portable human body part cleansing device that can be taken along to perform cleaning of a local part of the human body. With the water jetting device described above, when bringing about swinging revolution of the water jetting body, there is no need for an actuator, much less a driving power source, battery or the like. Moreover, the amount of cleansing water can be reduced with aim of water conservation, so the water jetting device of the present invention is suitable as a portable human body part cleansing device of which light weight, compactness and low cost are required. Even where used as a portable human body part cleansing device in which wash position is performed manually, appreciable saving of water is possible without splashing of cleansing water or unpleasant vibration. Thus, even where the cleansing water is carried in a tank, there is no problem of the water in the tank becoming rapidly depleted during use.

With a human body part cleansing device embodying the water jetting device of the present invention, the high water savings afforded by the water jetting device can be utilized to minimize running out of warm water in the tank during use. Even where water is boiled using an instantaneous heat exchanger, since only a minimal amount of water need be used; it is possible to reduce the power consumed by the heater, and to warm low-temperature to the required temperature. Additionally, as no large scale device is required to realize jet by means of swinging revolution, the human body part cleansing device per se can be made more compact, quieter, and with less vibration.

Further, in common water pressure districts where supply water pressure is maintained at about 0.05 MPa, there is no need for a special pump for pressurization in order to provide jet by means of swinging revolution. Additionally, jet by means of swinging revolution stimulates the blood vessels in the vicinity of anus, improving the flow of blood, and may provide benefits such as promoting the desire to defecate. It has been verified that swinging revolution of the water jetting body is possible even where supply water pressure is about 0.01 MPa.

A shower device embodying the water jetting device of the present invention likewise exhibits the water savings afforded by the water jetting device, and can achieve water conservation in a shower device. Since, as noted, no special devices or power supply are required, it is suitable as a shower device for use in a humid environment prone to rusting or ground fault, such as in a bathroom. Additionally, showering under a jet produced by swinging revolution massages and relaxes blood vessels in the area contacted by the water, thus enabling scalp or whole-body massage.

In a cleansing device embodying the water jetting device of the present invention, for example, a dishwasher for cleansing articles to be washed, the nozzle of the water jetting device is directed onto the articles to be washed, showering the articles to be washed with a jet produced by swinging revolution. As noted earlier, such a jet has a vortical component produced by swinging, revolution, and a vortical component produced by rotation where the water jetting body undergoes rotation. Therefore, according to the water jetting device of the present invention, which performs jetting by means of swinging revolution, the ability to remove adhering soils on the articles to be washed is greater than in the case when cleansing water is simply directed straight onto articles to be washed, so that cleaning ability may be improved. Also, utilizing the water savings afforded by the water jetting device, higher cleaning ability can be achieved with less cleansing water.

As regards the nozzle that gives rise to jetting by swinging revolution, it is the nozzle per se that gives the water savings and improved cleaning ability mentioned above. Therefore, by simply replacing the nozzle in the wash chamber of an existing cleansing device (dishwasher) with that of the present invention, the unit can be easily retrofitted to give excellent water conservation and high cleaning power.

In such a cleansing device (dishwasher), the nozzle is installed on a rotating arm designed to be rotatable within the wash chamber. During installation, nozzles are arranged on the distal portions of the rotating arm to either side of the rotation shaft so that each nozzle is supplied with cleansing water. Nozzles are then oriented to jet on the diagonal so that the reaction force produced by the cleansing water jet imparts rotation in the same direction of the rotating arms.

By so doing, by jetting from nozzles located in the distal portions of the rotating arms (jetting by swinging revolution), dishes are showered with jet produced by swinging revolution while the rotating arm turn around the rotation shaft. As a result, dishes in the wash chamber can be showered with jet produced by swinging revolution from the nozzles by means of rotating of the rotating arms. Ability to clean dishes can be enhanced thereby. Water conservation efficiency is high as well.

BEST MODE FOR CARRYING OUT THE INVENTION

Figure 3:
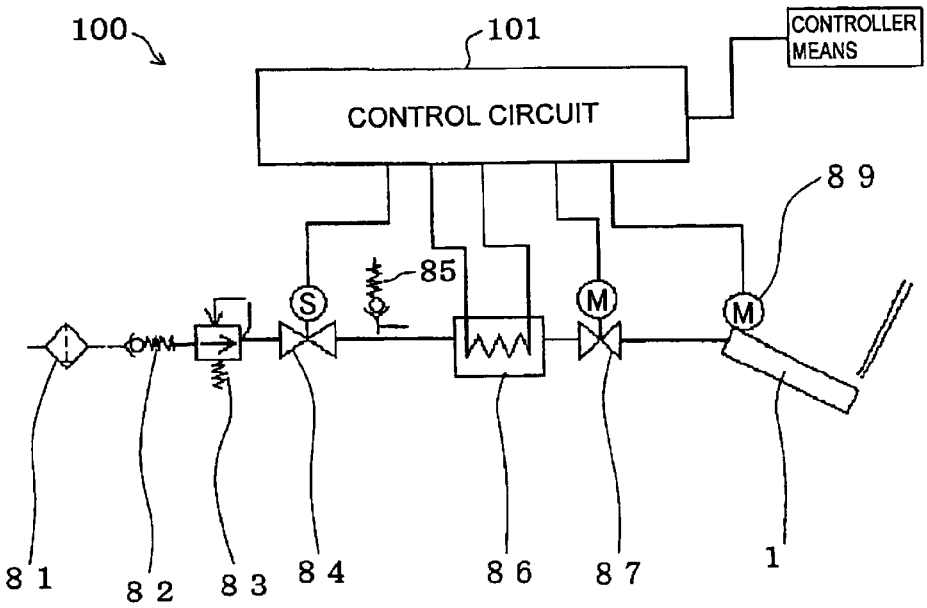
FIG. 3 is a descriptive diagram describing a water path arrangement diagram of a human body part cleansing device 100 in an example embodying the water jetting device of the present invention.

The modes for carrying out the present invention are described next using drawings. FIG. 3 is a descriptive diagram describing a water path arrangement diagram of a human body part cleansing device 100 in an example embodying the water jetting device of the present invention.

As shown in the drawing, the human body part cleansing device 100 comprises, in order of water flow from the upstream end, a filter 81, a check valve 82, a regulator valve 83, an electromagnetic valve 84, a pressure escape valve 85, a heat exchanger 86, and a flow rate adjustment valve 87, and jets cleansing water from a cleansing nozzle 1 towards a local part of the human body. The filter 81 removes dirt and scale from the supplied cleansing water, and the check valve 82 prevents reverse flow of cleansing water to the primary side.

Cleansing water receives pressure adjustment to predetermined water pressure by the regulator valve 83 and then passes through the open valve of the electromagnetic valve 84 to reach the heat exchanger 86. At this time, if cleansing water pressure should go above the set level due to miss-operation or operation halt by the regulator valve 83, the pressure escape valve 85 operates so that downstream lines and downstream equipment are not subjected to unintentionally high pressure.

The heat exchanger 86 heats the cleansing water jetted from the cleansing nozzle 1 in order to warm it, and may be of tank type or instantaneous type. In the present example, an instantaneous heat exchanger is used. Cleansing water warmed by the heat exchanger 86 receives flow rate regulation by the flow rate adjustment valve 87 and is then jetted from the cleansing nozzle 1. The cleansing nozzle 1 is advanced to a predetermined location by a nozzle drive motor 89, and at completion of cleansing/standby it is stored in the chassis (not shown) of the human body part cleansing device 100.

The human body part cleansing device 100 has a control circuit 101 for drive control of the equipment mentioned above in response to operation of a control means (a remote control, for example). This control circuit 101, upon input by the user of a start wash operation using the control means (for, example, operating a Wash switch), receives a Start Wash signal and starts the cleansing operation. That is, the control circuit 101 transmits a drive signal to the nozzle drive motor 89, causing the cleansing nozzle 1 to advance to a predetermined location. When nozzle advance is completed, the control circuit 101 performs valve opening control of the electromagnetic valve 84 to set the water conduit to the open state allowing cleansing water to flow through. In association with electromagnetic valve control, the control circuit 101 executes flow rate control by means of the flow rate adjustment valve 87, whereupon the cleansing water is jetted from the cleansing nozzle 1 onto a local part of the human body at the adjusted flow rate. Localized cleansing is performed thereby.

Figure 4A:
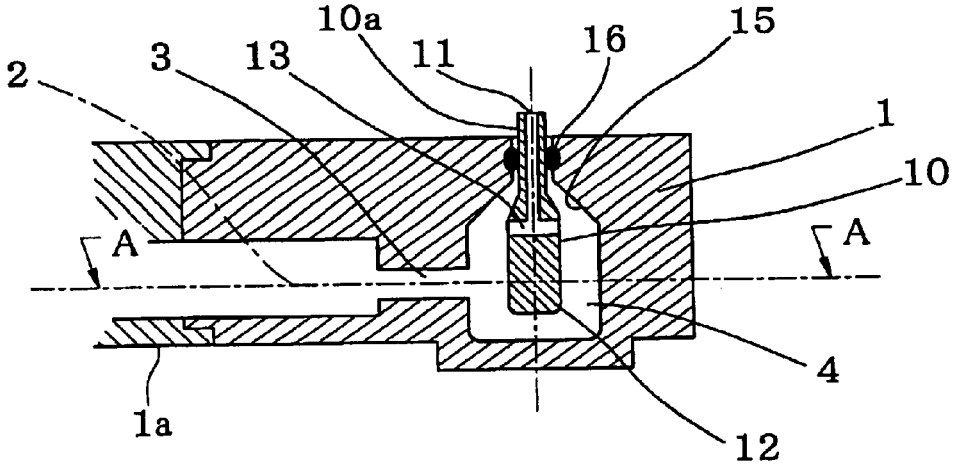
FIG. 4 is a descriptive diagram describing a cleansing nozzle 1 viewed in cross section, wherein FIG. 4(*a*) shows a lateral section of the cleansing nozzle 1, and FIG. 4(*b*) is a sectional diagram of the cleansing nozzle 1 viewed in section in plane A—A in FIG. 4(*a*)
Figure 4B:
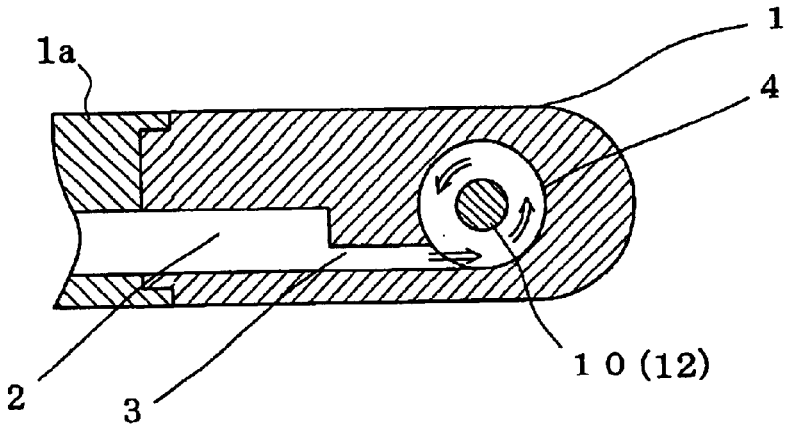

Next, the cleansing nozzle 1 shall be described. FIG. 4 is a descriptive diagram describing the cleansing nozzle 1 viewed in cross section, wherein FIG. 4(*a*) shows a lateral section of the cleansing nozzle 1, and FIG. 4(*b*) is a sectional diagram of the cleansing nozzle 1 viewed in section in plane A—A in FIG. 4(*b*).

As shown in the drawing, the cleansing nozzle 1 comprises a vortex chamber 4 of cylindrical configuration serving as an inflow chamber for inflow of cleansing water; cleansing water is supplied to this vortex chamber 4 through a conduit 2 and a vortex chamber inflow conduit 3. The vortex chamber inflow conduit 3 is the nozzle conduit and has a water passage cross sectional area that is smaller than that of the control circuit 101; it connects to the vortex chamber eccentrically with respect to the center of the vortex chamber 4. Therefore, cleansing water from the vortex chamber inflow conduit 3 inflows from a tangential direction with respect to the vortex chamber 4, creating a swirling vortical flow as shown in the drawing. Here, since the water passage cross sectional area of the vortex chamber inflow conduit 3 is smaller than that of the conduit 2 the flow velocity of cleansing water inflowing to the vortex chamber 4 may be increased.

The cleansing nozzle 1 is comprised of a water jetting body 10 assembled within this vortex chamber 4. The water jetting body 10 has a water jetting member 10*a* of small-diameter round column shape provided with a water jetting spout 11 for cleansing water, and a force receiving member 12 of large-diameter round column shape continuous with this water jetting member. This force receiving member 12 is positioned within the vortex chamber 4 and receives various forces, described hereinbelow, from the vortical flow, contributing to swinging revolution drive etc., described hereinbelow, of the water jetting body 10. The force receiving member 12 comprises a water supply conduit 13 passing therethrough in the lateral direction, and cleansing water in the vortex chamber 4 is guided to the water jetting spout 11 from this water supply conduit 13. The water supply conduit 13 opening intersects the force receiving member 12 in a cross shape, and the total water passage cross sectional area of this water supply conduit 13 is greater that of the water jetting spout 11. Therefore, when cleansing water is guided from the water supply conduit 13 to the water jetting spout 11, the cleansing water flow is rectified according to area size, so the cleansing water jet from the water jetting spout 11 is stable.

The water jetting body 10 is inserted/supported with the water jetting member 10*a* internally touching a seal member 16 provided at the opening upper portion of the vortex chamber 4, with the force receiving member 12 descending substantially to the center of the vortex chamber 4. Accordingly, when cleansing water inflows from the vortex chamber inflow conduit 3 to the vortex chamber 4, this cleansing water gives rise to vortical flow around the force receiving member 12 along the inside peripheral wall of the vortex chamber 4.

In this example, as shown in the drawing, the outside diameter of the force receiving member 12 is approximately 40% of the inside diameter of the cylindrical vortex chamber 4. However, the outside diameter of the force receiving member 12 may be made from about 35–80%, preferably about 40–70%, of the inside diameter of the cylindrical vortex chamber 4. The effect of this inside/outside diameter ratio is described hereinbelow.

The seal member 16 which supports the water jetting body 10 in the manner described above is composed of an O-ring, seal ring or other elastic body, and as shown in the drawing supports the water jetting body 10 with the water jetting spout 11 thereof bordering the outside of the vortex chamber 4. Additionally, since this seal member 16 is an elastic body, with the water jetting body 10 supported, the force receiving member 12 can incline in various directions within the vortex chamber 4 as well as the force receiving member 12 undergoing swinging revolution in the inclined state. Further, since the seal member 16 is an elastic body, the water jetting body 10 can freely rotate by turning about the center axis of the water jetting body 10 itself within the vortex chamber 4, and can revolve by turning conically with the support location provided by the seal member 16 as the apex, etc. This rotation and revolution are created by the force receiving member 12 and the vortical flow described above, and will be described in detail hereinbelow.

The upper wall of the vortex chamber 4 is a taper guide member 15 constricted in diameter on the water jetting member 10*a* side of the water jetting body 10 as shown in the drawing. This taper guide member 15 limits the maximum angle of incline of the force receiving member 12, and hence of the water jetting body 10.

The cleansing nozzle 1 having the above arrangement is provided as a single nozzle head unit having a nozzle distal end portion that includes the vortex chamber 4, and is detachable from a nozzle body member la shown in the drawing. Therefore, the nozzle head, including the cleansing nozzle described hereinbelow, may be easily replaced and installed.

Figure 5:
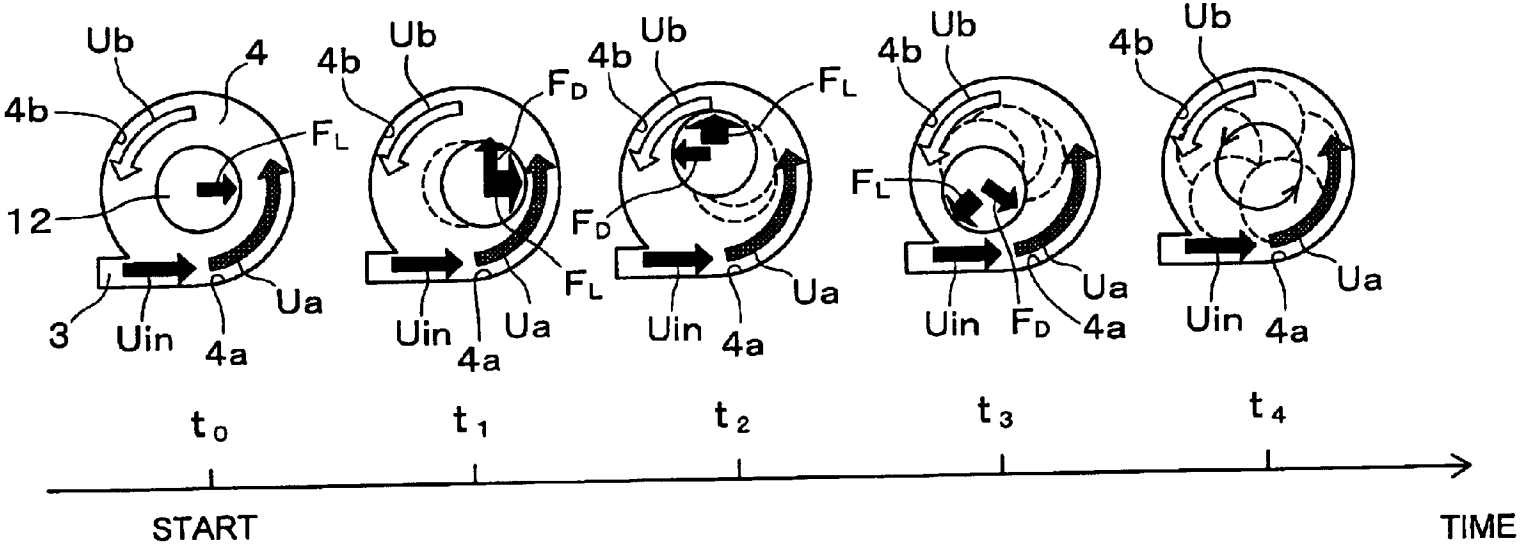
FIG. 5 is a descriptive diagram describing behavior of a force receiving member 12 after cleansing water has flowed into a vortex chamber 4, and the condition of force bearing on the force receiving member 12 over time.
Figure 6:
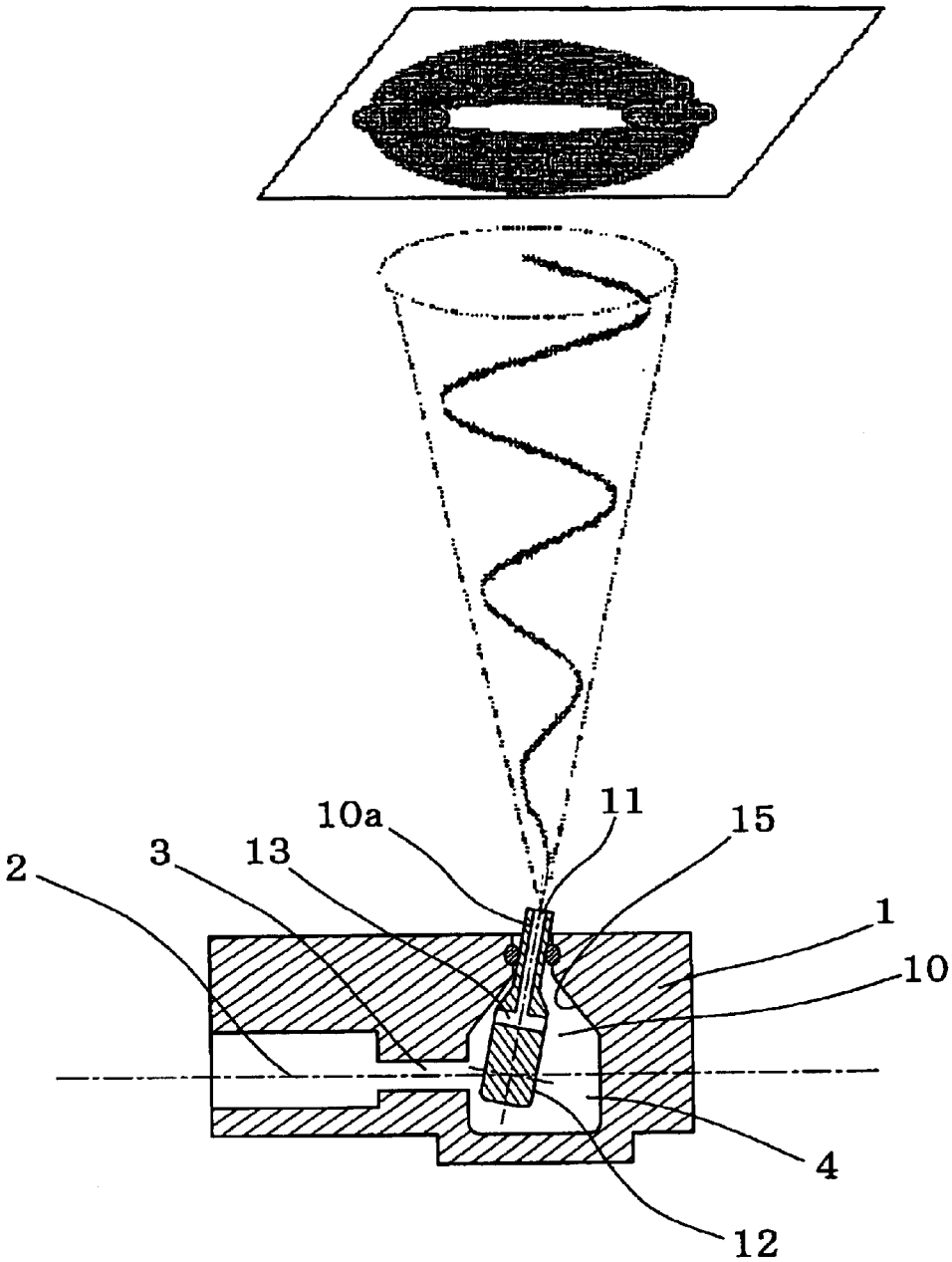
FIG. 6 is a descriptive diagram describing the condition of cleansing water jet obtained through this behavior of the force receiving member 12.

Here, the condition of cleansing water jet in the cleansing nozzle 1 having the above arrangement and the behavior thereof shall be described. FIG. 5 is a descriptive diagram describing behavior of the force receiving member 12 after cleansing water has flowed into the vortex chamber 4, and the condition of force bearing on the force receiving member 12 over time; and FIG. 6 is a descriptive diagram describing the condition of cleansing water jet obtained through this behavior of the force receiving member 12.

As shown in FIG. 5, let it be assumed that cleansing water is now made to inflow from the vortex chamber inflow conduit 3 to the vortex chamber 4 (time to). Here, since the cleansing water passes from the conduit 2 of large water passage cross sectional area through the vortex chamber inflow conduit 3 of small water passage cross sectional area, it inflows to the vortex chamber 4 at high flow velocity. Therefore, the kinetic energy which this cleansing water can confer by collision etc. in increased.

Once cleansing water flows into the vortex chamber 4 in this way, the cleansing water gives rise to vortical flow around the force receiving member 12 along the inside wall of the vortex chamber 4. Flow velocity in this vortical flow has the highest flow velocity Uin in the communicating portion of the vortex chamber inflow conduit 3.

Between the site at which inflowing cleansing water first begins to circle, i.e. a peripheral wall zone 4*a* on a line extended from the opening of the vortex chamber inflow conduit 3 on the one hand, and a peripheral wall zone 4*b* opposed to this zone on the other, there is created a differential between flow velocity Ua and flow velocity Ub, the relationship of the two being Ua>Ub). That is, as cleansing water circulates (circles) from the peripheral wall zone 4*a* to the peripheral wall zone 4*b*, it is subjected to influences such as flow dispersion within the vortex chamber 4, cleansing water contact with the inside wall of the vortex chamber 4, cleansing water viscosity, surface friction etc. so that the cleansing water slows in velocity. Therefore, a flow velocity differential is created in the cleansing water around the force receiving member 12. Here, while the moving substance is a fluid (cleansing water), the relative relationship of the cleansing water and the force receiving member 12 is such that it is no different from the condition of a physical object moving through a fluid.

When a physical object moves through a fluid, a condition of lift acting on the physical object based on a flow velocity differential of the fluid to either side of the physical object is created, and accordingly this condition is created between the force receiving member 12 and the cleansing water in the vortex chamber 4, so that force of the same nature as lift acts on the force receiving member 12. For convenience, this force is termed lift as noted earlier, but to give an example in terms of another phenomenon, the creation of lift through a flow velocity differential in a fluid is similar to creation of a velocity differential on the surfaces of an airplane wing, i.e. lift by means of a velocity differential.

As shown in FIG. 4, the force receiving member 12 penetrates into the vortex chamber 4, and at time t0 in FIG. 5, is as follows. At time t0 vortical flow around the stopped force receiving member 12 occurs, so the lift $F_L$ thereof receives the effect of flow velocity Ua [m/sec] of the vortical flow at the peripheral wall zone 4*a*. This lift $F_L$ is given by the following equation, where the maximum projection area of the force receiving member 12 receiving lift is designated S [$m^2$] and the density of the cleansing water is designated ρ [$kg/m^3$]. In the equation, $C_L$ is the coefficient of lift.

$$F_L=(\rho\cdot V^2\cdot C_L\cdot S)/2 \quad [N]$$

When this lift FL acts on the force receiving member 12, as a result thereof, drag $F_D$ (=$(\rho\cdot V^2\cdot C_D\cdot S)/2$ [N]) acts on the force receiving member 12 as well. $C_D$ is the coefficient of drag.

The maximum projection area S in the above equation depends on the length L [m] of the force receiving member 12, so by extending the length L of the force receiving member 12, lift and drag may be increased.

As shown at time t0 in FIG. 5, once vortical flow around the force receiving member 12 is created in the vortex chamber 4, as noted earlier, lift acts on the force receiving member 12. This lift is directed outwardly from the center side in the vortical flow, and towards the peripheral wall zone 4*a* where the flow velocity of the vortical flow, around the force receiving member 12 is high. Meanwhile, since the force receiving member 12 is capable of swinging revolution in an inclined attitude in the vortex chamber 4, it receives this lift $F_L$ and inclines in the direction indicated by arrow $F_L$ in the drawing. In this way, once the force receiving member 12 inclines towards the inside wall of the vortex chamber 4, at time t1, this lift $F_L$ and drag $F_D$ both act and move in the resultant force direction. This resultant force in one in which drag is along the flow direction of the vortical flow, so it moves in a direction moving the force receiving member 12 in the flow direction of the vortical flow.

At this point, the passage gap for the vortical flow on the side towards which the force receiving member 12 has tilted becomes narrow and vortical flow velocity increases due to this narrow section. This condition occurs such that the location of the narrowed gap moves around the force receiving member 12, so the location of high flow velocity of the vortical flow moves along the inside peripheral wall of the vortex chamber 4 as well. Accordingly, in association with movement of the location of maximum flow velocity, the orientation of lift $F_L$ and drag $F_D$ change as well, so proceeding to times t2, t3 and t4, the force receiving member 12 moves in the flow direction of the vortical flow while maintaining its inclined attitude. Once the water jetting body receives lift and drag in this manner and begins to revolve, centrifugal force acts on the water jetting body in the radial direction of the vortex chamber.

For this reason, the water jetting body 10 revolves within the vortex chamber 4 while undergoing swinging motion (i.e. swinging revolution) about the support location provided by the seal member 16. Since the water jetting spout 11 of the water jetting body 10 is bordering the outside of the vortex chamber 4, cleansing water guided through the water supply conduit 13 to the water jetting spout 11 is jetted in a conical pattern having as its apex the location of the center of swinging of the water jetting body 10. Even jet in this manner revolves according to swinging revolution of the water jetting body, creating the conical revolving jet described hereinabove.

While this conical revolving jet is being performed, the seal member 16 seals about the circumference of the water jetting member 10*a* of the water jetting body 10. The water jetting body 10 is limited in terms of its maximum angle of incline by the taper guide member 15 provided in the upper portion of the vortex chamber 4, preventing swinging revolution at an undesirably large incline.

Additionally, once the force receiving member 12 receives the effect of lift FL and tilts towards the inside wall of the vortex chamber 4, this force receiving member 12 now receives drag $F_D$ in a direction pushing it straight in the vortical flow in the vortex chamber 4. Therefore, the force receiving member 12 in an inclined attitude receives the effects of centrifugal force described above, and moves in the flow direction of the vortical flow while maintaining its inclined attitude, accelerating swinging revolution of the water jetting body 10.

Here, the condition of swinging revolution shall be described. As shown in FIG. 6, once the water jetting body 10 gives rise to swinging revolution as described above, the water jetting spout 11 revolves while changing its jet direction in association with swinging revolution of the water jetting body 10. Therefore, the water jetting spout 11 jets cleansing water while describing a helical expanding path, as a result of which a conical revolving jet is created. Thus, the jet path of the cleansing water is made into a path of conical swinging revolution on a path much larger than the path of the water jetting spout 11, so that a local part can be washed over a wide area.

Therefore, according to the human body part cleansing device 100 of this example, a conical revolving jet can be realized without driving the nozzle per se, whereby cleansing water contact over a wide area, i.e., wide area cleansing, can be achieved.

In terms of achieving such wide area cleansing, it is sufficient to achieve cleansing water inflow into the vortex chamber 4 and create a vortical flow, this vortical flow giving rise to swinging revolution of the water jetting body 10. That is, during wide area cleansing, the only moving member is a small water jetting body 10 installed in the vortex chamber 4 provided within the nozzle. Additionally, swinging revolution of the water jetting body 10 is created using only vortical flow of cleansing water, so there is no need whatsoever for a motor or other such actuator. Thus, the human body part cleansing device 100 produces no noise or vibration based on actuator drive, providing the advantage of exceptionally superior noise and vibration silence.

Further, to induce the vortical flow it is sufficient to achieve cleansing water inflow into the vortex chamber 4, so there is no special need for a pressurized water supply of cleansing water by a pressurization pump etc. This also enables noise and vibration to be silenced to a greater extent.

Additionally, as there is no need for meshing of gears etc. there is no clogging with dirt or the like, and reliability of jet may be increased. In association with this obviation of the need for gears etc., the water jetting member 10*a* has been given small diameter to reduce slide resistance with respect to the seal member 16, so during swinging revolution of the water jetting body 10 there is no energy loss, and swinging revolution can be made high speed.

In addition to the small number of moving members, there is no actuator or other such electrical drive portion, so an extremely compact the human body part cleansing device 100 can be provided. Further, in addition to the lack of problems with durability of an electrical drive, portion, no electrical wiring to the nozzle tip is required. Therefore there is no consideration of ground fault, and the assembly operation and maintenance operation may be simplified, structure simplified, and accordingly costs reduced.

Wide area cleansing through the conical revolving jet described above can be realized readily by means of assembly of the water jetting body 10 in the vortex chamber 4 and creating vortical flow through introduction of cleansing water into the vortex chamber 4. By means of this structure can be simplified and lower cost achieved, as well as achieving miniaturization of the device through simplified structure.

In the present example, the water passage cross sectional area of the vortex chamber inflow conduit 3 designed for cleansing water inflow into the vortex chamber 4 is small, so as to increase the flow velocity of cleansing water inflow into the vortex chamber 4. The cleansing water flow velocity inflowing to the vortex chamber 4 prescribes lift $F_L$ as described earlier. Therefore, by preparing the vortex chambers inflow conduits 3 of various water passage cross sectional areas and using these selectively, it is possible to adjust lift $F_L$ acting on the force receiving member 12, as well as drag and centrifugal force. These forces also determine the frequency of swinging revolution of the water jetting body 10. Therefore, by water passage cross sectional area adjustment of the vortex chamber inflow conduit 3 or selection of the vortex chamber inflow conduit 3, the frequency of swinging revolution of the water jetting body 10 can be adjusted as well. Therefore, there are the following advantages.

Where F1 and ΔS are the force and area at the instant that cleansing water contacts a washed article such as a human body or the like, the intensity of the cleansing water perceived by the human body at a certain instant may be given as F1/ΔS. Where f1 is the swinging revolution frequency of the water jetting body 10, and jetting continues at this frequency, the total area S contacting a washed article such as a human body etc. at time intervals of a cycle that is the inverse of frequency f1 (Δt=1/f1) will be equal to the value of ΔS integrated over this cycle Δt (S=fΔS).

Meanwhile, when a person perceives stimulation through the skin etc., the receptors perceiving the stimulation, although differing somewhat by individual and location of receiving stimulation, create a sensory illusion of continued stimulation or of receiving stimulation similar to continuity, in response to stimulation in a range of several Hz to several hundred Hz. Therefore, where a stimulation of intensity F1/ΔS at a certain instant moves on a path whose cycle is Δt (movement total path S=fΔS), the individual will have the sensory illusion of receiving stimulation of intensity F1/ΔS over total area S. This tendency is shown more markedly at smaller Δt, and begins to be perceived at f=about 3 Hz, i.e. Δt=about 0.3 second.

Therefore, water passage cross sectional area of the vortex chamber inflow conduit 3 can be adjusted or the vortex chamber inflow conduit 3 selected so as to make the swinging revolution frequency f1 of the water jetting body 10 to 3 Hz and more. By so doing, the wash area can be enlarged without any loss (reduction) of cleansing water stimulation.

The relationship of force F1 at the aforementioned instant (hereinafter termed force F1) and the amount of cleansing water Q1 jetted is represented by the following equation, where the spout area is S1 and the cleansing-water flow velocity is V1.

$$F1=\rho\cdot Q\cdot V1=\rho\cdot Q^2\cdot Q/S1$$

As will be clear from this equation, force F1 is proportional to the square of instantaneous flow rate $Q^2$, and inversely proportional to spout area S1. Therefore, where flow is reduced to conserve water, force F1 can be increased by reducing spout area S1. Accordingly, it is determined that in order to reduce flow rate to improve or maintain cleansing power or stimulation during cleansing, it is desirable to reduce spout area S1, i.e. increase the flow velocity of the cleansing water.

Figure 1:
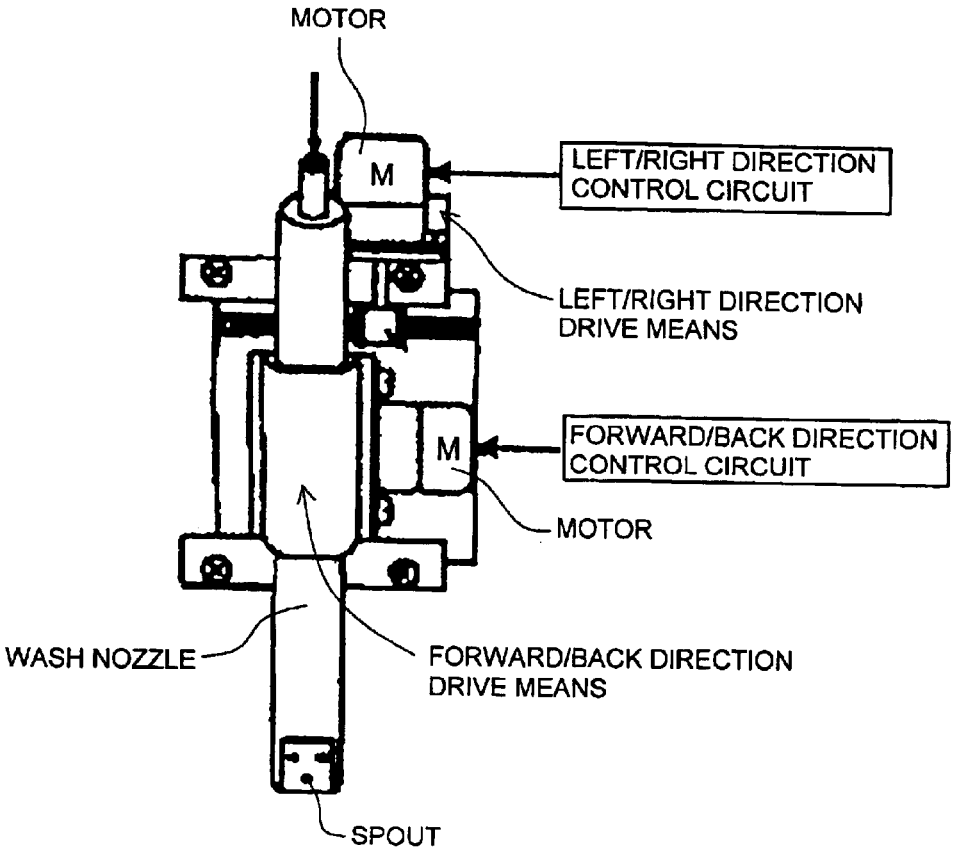
Fig.1 PRIOR ART
FIG. 1 is a descriptive diagram describing a conventional human body part cleansing device.
Figure 2:
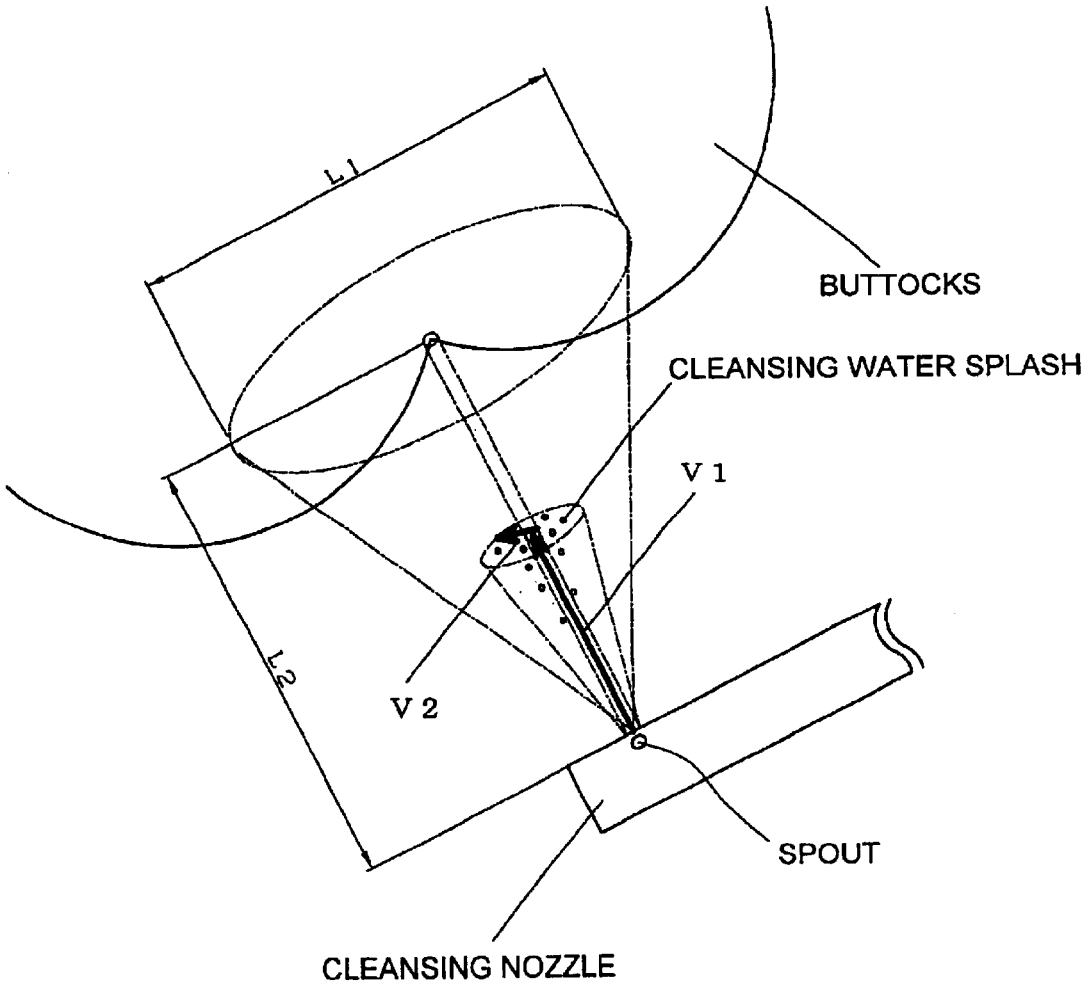
FIG. 2 is a descriptive diagram describing the condition at which splashing of cleansing water occurs.

Also, adjustment of water passage cross sectional area of the vortex chamber inflow conduit 3 or selection of the vortex chamber inflow conduit 3 can be performed in order to bring the swinging revolution frequency f1 of the water jetting body 10 to 40 Hz and more. By so doing, the wash point contacted by the jet of cleansing water can be made to move at high speed through high speed swinging revolution of the water jetting body 10. Therefore, the human body can be made to have a sensory illusion just like receiving contact by cleansing water over an entire water contact range (aggregate location of water contact points). Because of this, according to the human body part cleansing device 100 of the present example subjected to frequency adjustment in the manner described above, through sensory illusion created by high speed movement of water contact point there can be realized a soft, wide area cleansing desire, which is desirable. Specifically, in bidet cleansing of a cleansing device intended for dedicated use on a local part of the female anatomy which is sensitive to stimulation, or an ordinary localized cleansing device, wide area jet cleansing can be executed while amelioration stimulation perception appropriately.

Where frequency is set to 380 Hz and below, the jet width produced by swinging revolution described in FIG. 2 does not become unintentionally large. Therefore, splashing of cleansing water on a local part of the human body can be reduced, enabling cleansing to be performed pleasantly.

With the human body part cleansing device 100, lift is created on the basis of vortical flow, and this lifting power is employed for swinging revolution of the water jetting body and acceleration thereof. That is, the kinetic energy of the cleansing water is not used directly in swinging revolution, so compared to those using a flow element, there is no risk of attenuating the intensity of the jet.

Further, since in actual practice the aforementioned sensory illusion is produced even though water contact onto the wash point is transitioned, there is no need for a continuous jet such that an entire water contact area is contacted simultaneously by the cleansing water. Therefore, there is a commensurate water conservation effect.

Figure 7A:
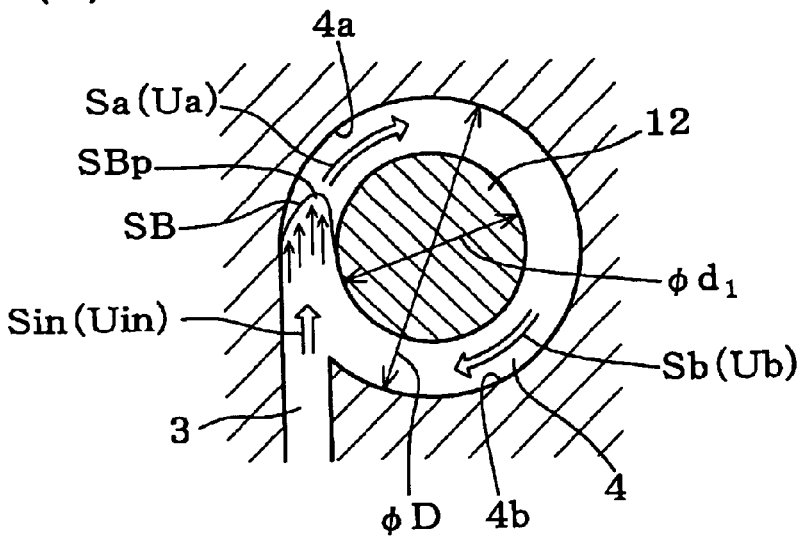
FIG. 7 is a descriptive diagram describing the effects of prescribing the inside/outside diameter ratio of the vortex chamber 4 and the force receiving member 12, wherein FIG. 7(*a*) is a descriptive diagram describing vortical condition where inside/outside diameter ratio is in the range 0.35–0.80, and FIG. 7(*b*) is a descriptive diagram describing vortical condition where inside/outside diameter ratio is below 0.35.
Figure 7B:
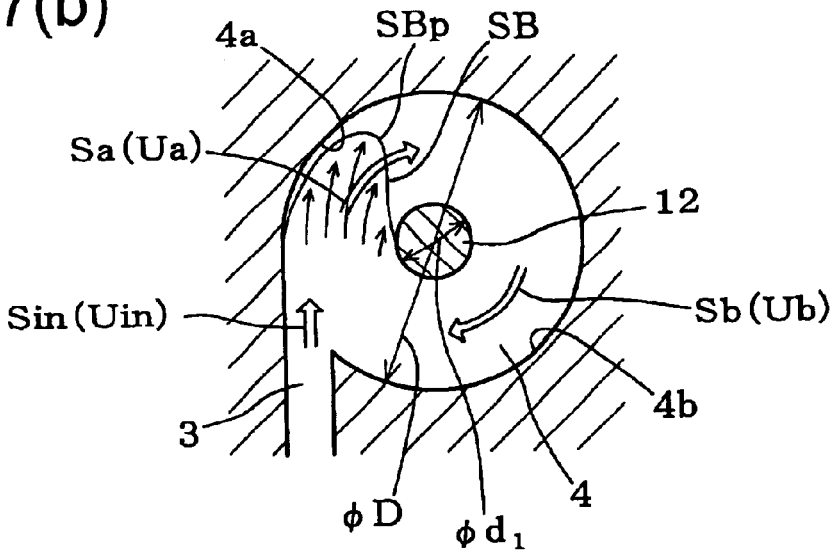

Here, some other effects shall be described. FIG. 7 is a descriptive diagram describing the effects of prescribing the inside/outside diameter ratio of the vortex chamber 4 and the force receiving member 12, wherein FIG. 7(*a*) is a descriptive diagram describing vortical condition where inside/outside diameter ratio is in the range 0.35–0.80, and FIG. 7(*a*) is a descriptive diagram describing vortical condition where inside/outside diameter ratio is below 0.35.

First, the case of the outside diameter Φd of the force receiving member 12 being in the range (proper range) of about 35–80% of the inside diameter ΦD of the vortex chamber 4 shall be described. As shown in FIG. 7(*a*), inflowing cleansing water Sin, having inflowing from the vortex chamber inflow conduit 3 to the vortex chamber 4 in a tangential direction thereto, reaches the peripheral wall zone 4*a* without directly colliding with the force receiving member 12. Then, cleansing water 5*a* which flows while circling around the peripheral wall zone 4*a* decelerates in the manner described earlier while reaching the peripheral wall zone 4*b*. By means of this, it is possible to reliably give rise to vortical flow imparted with a flow velocity differential around the force receiving member 12 along the inside wall of the vortex chamber 4, so that the swinging revolution/jet pattern of the water jetting body 10 described previously may be imparted with stability.

Also, where the force receiving member 12 outside diameter and the vortex chamber 4 inside diameter are within the proper range, the width of the vortical flow occupying the gap between the vortex chamber inside wall and the force receiving member outside wall will not become excessively wide or narrow. Therefore, this peak location and the force receiving member 12 are in relatively close proximity, so lift $F_L$ readily acts on the force receiving member 12. That is, the force receiving member 12 readily receives lifting force and is inclined thereby, facilitating creation of swinging revolution of the water jetting body 10 as described earlier.

In contrast to this, as shown in FIG. 7(*b*), where the outside diameter of the force receiving member 12 is the above proper range, the width of the vortical flow will broaden and the vortical flow will circle around the small-diameter the force receiving member 12. Therefore, the peak SB of the aforementioned velocity distribution SB becomes maldistributed towards the vortex chamber inside wall side, so that the peak location and the force receiving member 12 are farther apart and lift $F_L$ does not readily act on the force receiving member 12. As a result, swinging revolution of the water jetting body 10 and hence the jet pattern become unstable.

Also, while not shown in the drawings, if the outside diameter of the force receiving member 12 is greater than the above proper range; the force receiving member 12 outside wall will be too close to the vortex chamber inside wall, so the inflowing cleansing water Sin collides with the force receiving member 12 creating rebound within the vortex chamber, and creating disturbance in the vortical flow around the force receiving member 12. As a result, the aforementioned lift $F_L$ can not be produced appropriately, and swinging revolution of the water jetting body 10 and the jet pattern become unstable.

Figure 8:
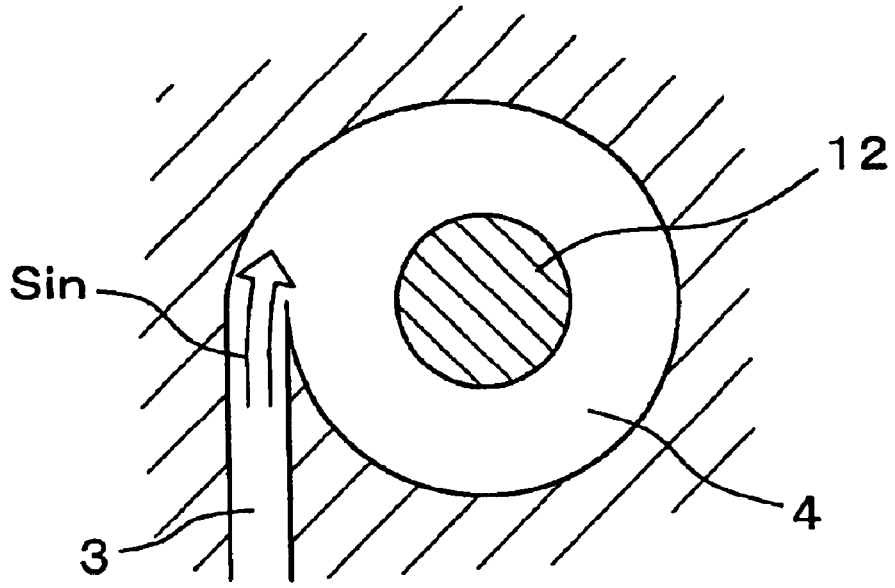
FIG. 8 is a descriptive diagram describing a vortex chamber inflow conduit 3 in modified example.

Since collision of inflowing cleansing water Sin with the force receiving member 12 makes swinging revolution unstable, it is possible to modify the vortex chamber inflow conduit 3 in the following manner. FIG. 8 is a descriptive diagram describing the vortex chamber inflow conduit 3 in modified example.

As shown in the drawing, the vortex chamber inflow conduit 3 is formed so as to connect smoothly with the inside peripheral wall face of the vortex chamber 4. Therefore, inflowing cleansing water Sin has a velocity component such that it circles naturally between the vortex chamber inside wall and the force receiving member 12 outside wall from initial inflow into the vortex chamber 4, as shown in the drawing. Thus, collision of inflowing cleansing water Sin with the force receiving member 12 can be avoided, which is advantageous in terms of stabilizing swinging revolution and jet pattern.

In the present example described above, the water jetting body 10 is rotatably supported by the seal member 16, so during swinging revolution, friction is created at the support location of the seal member 16. Also, if there is contact with the taper guide member 15, friction is produced by this contact as well. Through balance of generation conditions of this friction and the aforementioned force and kinetic energy received by the force receiving member 12 of the water jetting body 10, the water jetting body 10 gives rise to rotation about its own center axis. The direction of rotation is determined by the aforementioned balance, and may be the same as the vortical flow direction, or the reverse direction. With the water jetting body 10 of the present example, zone receiving directly the kinetic energy of the vortical flow is the round column shaped the force receiving member 12, making it difficult to convert kinetic energy into water jetting body rotation. Therefore, though water jetting body rotation is produced, the turning thereof is slow, so water jetting body rotation shall be described in the following modification example.

The aforementioned the force receiving member 12 is not limited in shape to a round column shape, and may be a triangular column, square column, hexagonal column or other polygonal column.

As regards the weight of the force receiving member 12, this may be increased or decreased by means of shape, size, material etc. By increasing/decreasing weight it is possible to increase or decrease revolution velocity when the force receiving member 12 is acted on by drag and lift or to centrifugal force per se, as well as to modify frictional force with the taper guide member 15 and inertia of the water jetting body per se. Thus, the speed of swinging revolution by the water jetting body 10 can be modified.

Figure 9A:
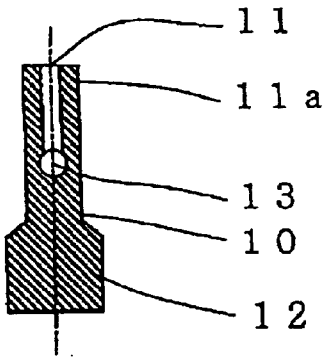
FIG. 9(*a*) is a descriptive diagram describing a water jetting body 110 in a modified example, wherein FIG. 9(*b*) is a longitudinal section of this water jetting body 110 and FIG. 9(*c*) is a sectional view taken along line c—c in FIG. 9(*b*)
Figure 9B:
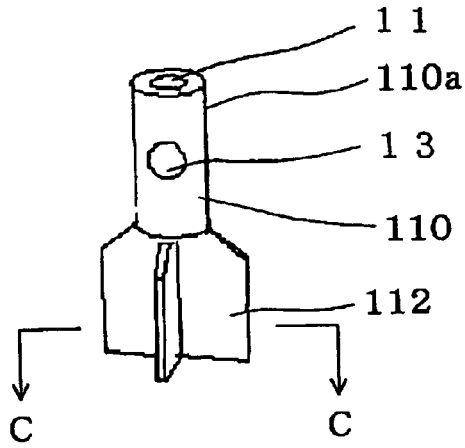
Figure 9C:
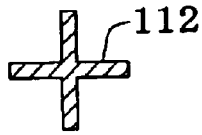
Figure 10A:
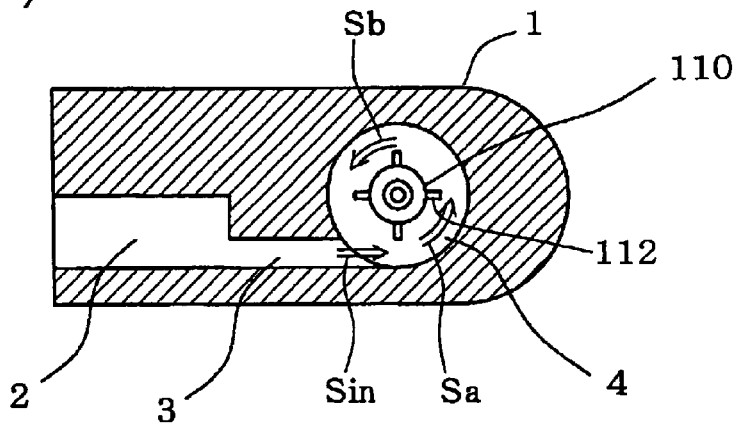
FIG. 10 is a descriptive diagram describing a cleansing nozzle 1 assembled with the water jetting body 10 in a modified example and viewed in cross section, wherein FIG. 10(*a*) shows a lateral section of the cleansing nozzle 1, and FIG. 10(*b*) is a sectional diagram of the cleansing nozzle 1 viewed in longitudinal section.
Figure 10B:
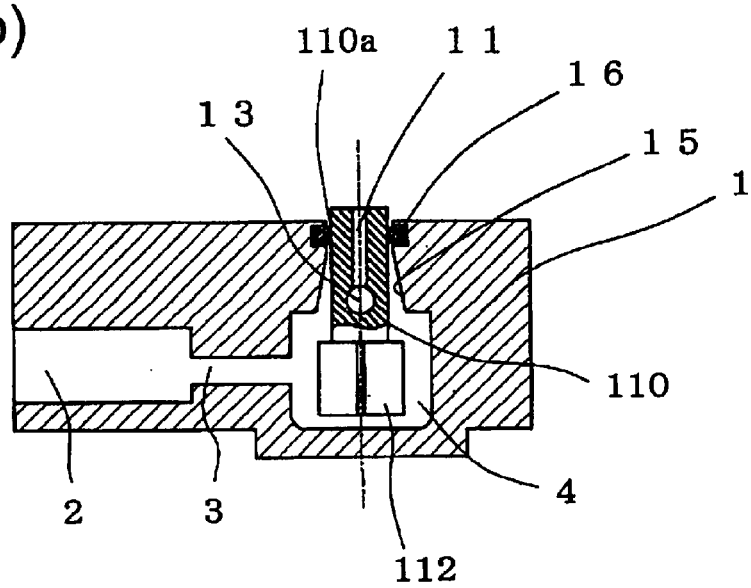

A modified example is now described. This modified example features conversion of vortical flow kinetic energy into water jetting body rotation to actively bring about water jetting body rotation. FIG. 9 is a descriptive diagram describing a water jetting body 110 in a modified example, wherein FIG. 9(a) is a longitudinal section of this water jetting body 110 and FIG. 9(*b*) is a sectional view taken along line c—c in FIG. 9(*b*). FIG. 10 is a descriptive diagram describing the cleansing nozzle 1 assembled with the water jetting body 110 in a modified example and viewed in cross section, wherein FIG. 10(*a*) shows a lateral section of the cleansing nozzle 1, and FIG. 10(*b*) is a sectional diagram of the cleansing nozzle 1 viewed in longitudinal section. The cleansing nozzle 1 has the vortex chamber 4, and the arrangement for supplying cleansing water to the vortex chamber from the conduit 2 and the vortex chamber inflow conduit 3 to create vortical flow in the vortex chamber 4 etc. is similar to that in the example described previously.

As shown in the drawings, the water jetting body 110 comprises a small-diameter round columnar water jetting member 110*a* with the water jetting spout 11, and a force receiving member 112 connected therewith. The force receiving member 112 has blades projecting in four directions. Even with this arrangement of the force receiving member 112, a flow velocity differential between the peripheral wall zone 4*a* and the peripheral wall zone 4*b* is created, and the gap with the inside peripheral wall of the vortex chamber 4 is narrowed by the lateral edges of the blades, thus contributing to swinging revolution of the water jetting body 110. The force receiving member 112 gives rise by means of the blades thereof to catching of the vortical flow, so the kinetic energy of the vortical flow within the vortex chamber 4 is received to give rise to rotation of the water jetting body 110.

Even with this water jetting body 110, the water jetting member 110*a* in supported in internal contact with the seal member 16. In this supported state, the water jetting spout 11 is bordering the outside of the vortex chamber 4, and the force receiving member 112 swings in an inclined attitude within the vortex chamber 4. That is, the water jetting body 110 undergoes swinging revolution about the support location of the seal member 16, and is also capable of rotation due to the elasticity of the seal member 16.

Figure 11:
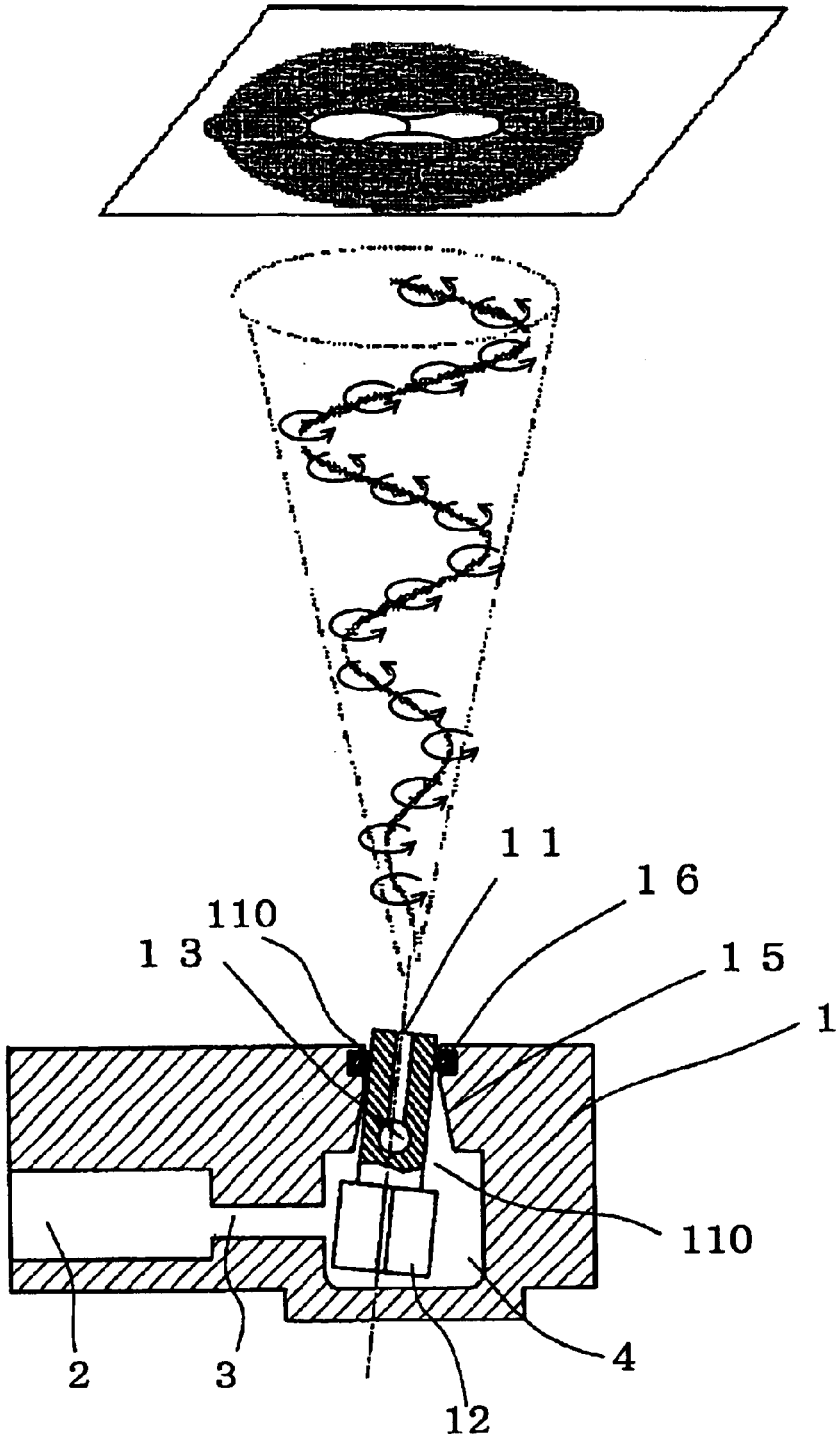
FIG. 11 is a descriptive diagram describing the condition of cleansing water jet from the cleansing nozzle 1 using the water jetting body 110.

The condition of jetting water shall now be described. FIG. 11 is a descriptive diagram describing the condition of cleansing water jet from the cleansing nozzle 1 using the water jetting body 110.

When cleansing water is supplied to the vortex chamber 4 through the conduit 2 and the vortex chamber inflow conduit 3, vortical flow is created in the vortex chamber 4 in the manner described earlier. Therefore, as in the previous example, the force receiving member 112 revolves in an inclined attitude due to lift, and gives rise to swinging revolution of the water jetting body 110. Meanwhile, the vortical flow created within the vortex chamber 4 collides with the blades of the force receiving member 112 in the course of circulation thereof, imparting some of its kinetic energy. By means of this, the force receiving member 112 rotates the water jetting body 110 in the same direction as the vortical flow.

Since the water jetting body 110 rotates in this manner, centrifugal force based on this rotation acts on the jet of cleansing water from the water jetting spout 11. Therefore, cleansing water, which have been jetted from the water jetting spout 11, spreads out and scatters due to the centrifugal force. Accordingly, as shown in FIG. 11, the spreading path of this jet per se and the revolving jet path combine, so that width can be imparted to the path of the conical revolving jet. By adjusting the speed of rotation through the way of acting of centrifugal force, the spread condition (wideness/narrowness of spread path) of the jetted cleansing water can be determined. Therefore, by adjusting the blade shape and size of the force receiving member 112 etc., the size of the jet drops, intensity due to vibration, and stimulation can be controlled.

Figure 12A:
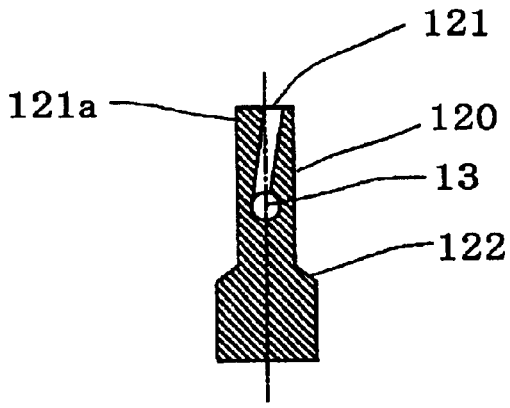
FIG. 12 is a descriptive diagram describing water jetting bodies 120, 125 of a modified example, wherein FIG. 12(*a*) is a longitudinal section of a water jetting body 120 and FIG. 12(*b*) is a longitudinal section of a water jetting body 125.
Figure 12B:
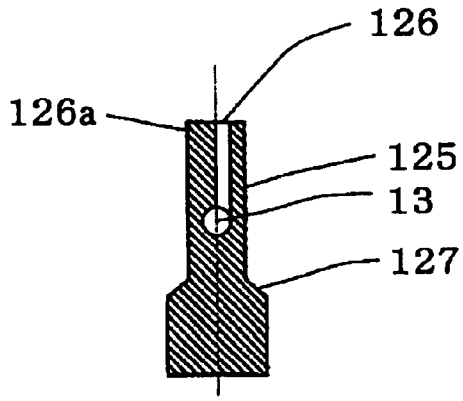
Figure 13:
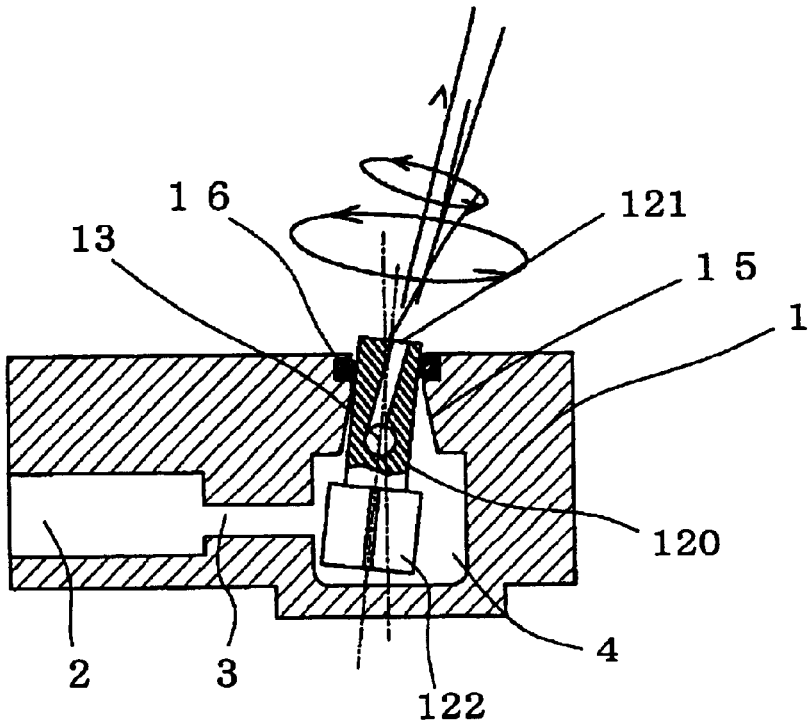
FIG. 13 is a longitudinal cross sectional view a cleansing nozzle assembled with the water jetting body 120.
Figure 14:
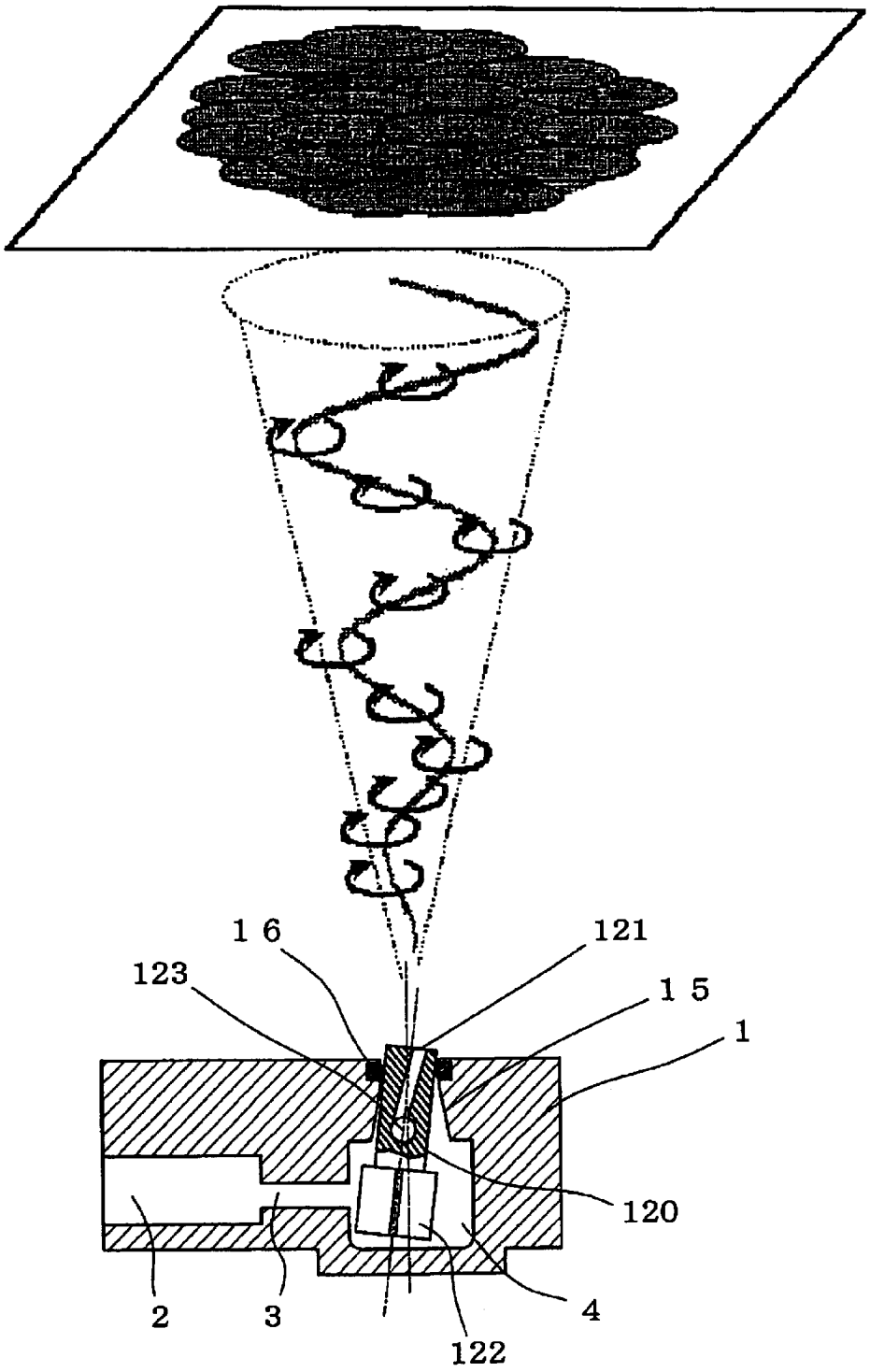
FIG. 14 is a descriptive diagram describing the condition of cleansing water jet from the cleansing nozzle 1 using the water jetting body 120.

Next, another modified example shall be described. This modified example features broadening the path of swinging revolution that accompanies swinging revolution of the water jetting body. FIG. 12 is a descriptive diagram describing water jetting bodies 120, 125 of a modified example, wherein FIG. 12(*a*) is a longitudinal section of a water jetting body 120 and FIG. 12(*b*) is a longitudinal section of a water jetting body 125. FIG. 13 is a longitudinal cross sectional view a cleansing nozzle assembled with the water jetting body 120. FIG. 14 is a descriptive diagram describing the condition of cleansing water jet from the cleansing nozzle 1 using the water jetting body 120.

As shown in FIG. 12(*a*), the water jetting body 120 has a water jetting member 121a supported by the seal member 16, and a the water jetting spout 121 communicated with the water supply conduit 13 in the water jetting member 121*a*. This water jetting spout 121 is formed in an inclined state with respect to the center axis (rotation axis) of the water jetting body 120. The water jetting body 125, shown in FIG. 12(*b*), has in the water jetting member 126*a* thereof a water jetting spout 126 communicating with the water supply conduit 13, the water jetting spout 121 being eccentric with respect to the center axis (rotation axis) of the water jetting body 120. Even with these water jetting bodies, as with the water jetting body 110, they are supported by the seal member 16 and are capable of swinging revolution.

Additionally, due to the force receiving members 122, 127 had by each, each water jetting body rotates similarly to the water jetting body 110.

When vortical flow is created in the vortex chamber 4 in the manner described above, as shown in FIG. 14, since the water jetting body 120 has a force receiving member 122 equivalent to the force receiving member 112, it gives rise to swinging revolution and rotation about its center axis. By means of this, the jet path from the water jetting spout 121 is a combination of a conical revolving jet path and the following path. That is, since the water jetting spout 121 is inclined with respect to the rotation axis, the jet from the inclined the water jetting spout 121 changes by means of the inclined spout per se rotating in association with water jetting body rotation, combined with receiving centrifugal force occurring from water jetting body. Therefore, this cleansing water jet assumes a conical path centered on the rotation axis. Therefore, the jet path from the water jetting spout 121 is a combination of a conical revolving jet path and the conical path described above.

The water jetting spout 121 giving this jet is inclined with respect to the rotation axis of the water jetting body 120. Therefore, the spread path produced by centrifugal force that accompanies water jetting body rotation spreads out conically with respect to the rotation axis as well, with the extent of spread depending on the extent of inclination of the water jetting spout 121. Therefore, by jetting on a path that is a combination of this spread path and a conical revolving jet path, not only can cleansing water contact a wider area, but hollowing of the water contact range can be eliminated. Moreover, in this modified example, when realizing such a wide area jet, no special increase in the amount of water is required, and it is sufficient to bring about rotation of the water jetting body 120, so water conservation may be carried out efficiently.

Instead of the water jetting body 120, the water jetting body 125 shown in FIG. 12(*b*) could be used. This water jetting body 125 has the water jetting spout 126 that is eccentric with respect to the water jetting body rotation axis, so cleansing water from this eccentric spout, as with the inclined spout described above, assumes a circular columnar path centered on the rotation axis, due to the effects of centrifugal force produced by rotation of the eccentric spout per se and water jetting body rotation. Therefore, the cleansing nozzle 1 having the water jetting body 125 assembled therein realizes jet on a path that is a combination of this frustum path and a conical revolving jet path, so that jetting is performed in substantially similar fashion to FIG. 14.

The water jetting body 110 and the water jetting bodies 120, 125 in the above modified example can have a greater or lesser number of blades, or made of triangular column or square column, hexagonal column or other polygonal column, or else may be made of round column shape. By varying the shape of the blades in this way, the rotational speed of each water jetting body may be changed.

Also, by changing the gap between the vortex chamber 4 inside wall and the force receiving members 122, 127 of each water jetting body or the taper angle of the taper guide member 15, the swinging revolution angle of these water jetting bodies may be changed. For example, where the wash target is small and sensitive like a localized area of the human body as with the cleansing nozzle 1 of the human body part cleansing device 100, the gap between the force receiving members 122, 127 and the vortex chamber 4 inside wall is made narrow, and the swinging revolution angle of the water jetting body is made small. The taper angle of the taper guide member 15 is also similar.

Further, by making the blades of the force receiving members 122, 127 relatively small or like a square column or triangular column or round column, resistance received by the blades from the vortical flow during swinging revolution can be reduced. By so doing, the frequency of swinging revolution of the water jetting body can be made greater than the rotation frequency, that is, made to undergo swinging revolution at high speed. Therefore, aggregate cleansing of an area to be washed is possible, and a cleansing sensation similar to receiving simultaneous intense jet is possible. This is suitable where cleansing is intended to have an enema action by means of entering the cleansing water into the anus, or where a single location is washed intensively. Also, since the swinging revolution frequency and rotation frequency of the water jetting body can be adjusted through blade shape/the force receiving member weight etc., it is possible to freely set each frequency appropriately for object of cleansing, wash area etc.

In the preceding example and modified examples, the elastic body seal member 16 is used to support the water jetting body, but the seal portion could be eliminated, instead having an arrangement in which the cleansing nozzle and part of each the force receiving member of each water jetting body are in direct sliding contact (turning sliding). In this case, the water jetting body or the guide member of the cleansing nozzle that contacts the force receiving member, or both, can be made of material having excellent sliding and wear resistance, for example, polyacetal, nylon, polypropylene, polytetrafluoroethylene, silicone, ABS, PPS etc. Where a metal such as stainless steel is used, surface roughness should be minimized.

Figure 15A:
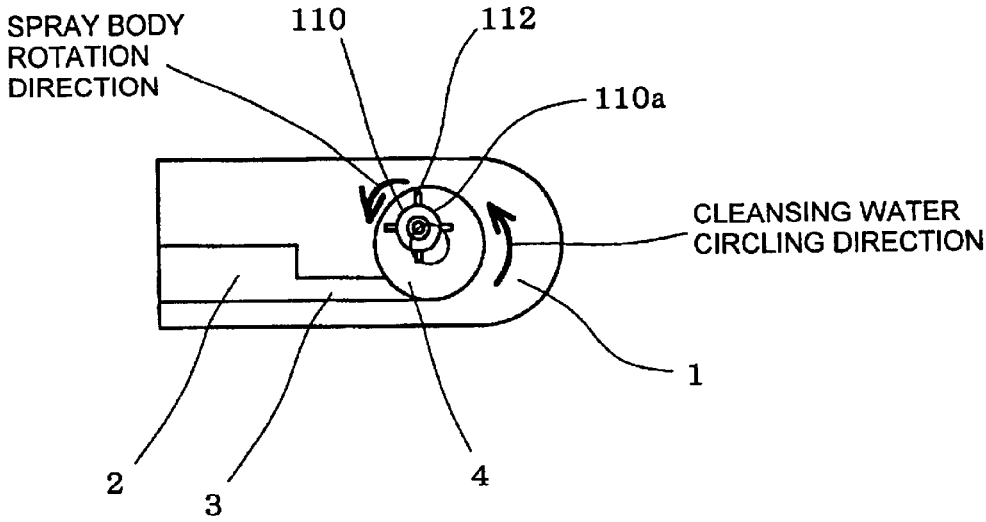
FIG. 15 is a descriptive diagram describing the relationship of swinging revolution and rotation of the water jetting body 110, wherein FIG. 15(*a*) is a descriptive diagram showing the case where the direction of turning in swinging revolution and rotation of the water jetting body 110 are the same, and FIG. 15(*b*) is a descriptive diagram showing the case where the direction of turning in swinging revolution and rotation of the water jetting body 110 are opposite directions.
Figure 15B:
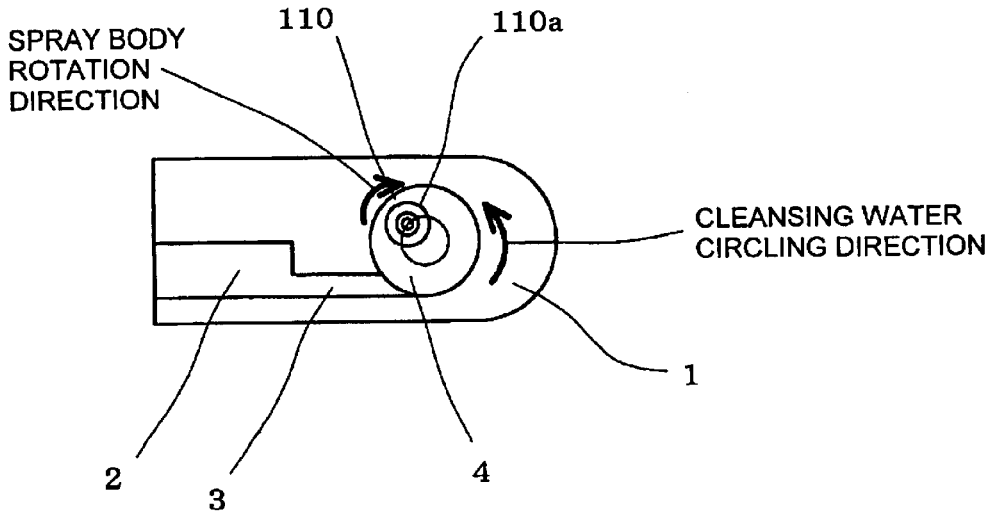

Here, the rotation behavior of the water jetting body shall be described. FIG. 15 is a descriptive diagram describing the relationship of swinging revolution and rotation of the water jetting body 110, wherein FIG. 15(*a*) is a descriptive diagram showing the case where the direction of turning in swinging revolution and rotation of the water jetting body 110 are the same, and FIG. 15(*b*) is a descriptive diagram showing the case where the direction of turning in swinging revolution and rotation of the water jetting body 110 are opposite directions.

The water jetting body 110, due to the vortical flow in the vortex chamber 4, undergoes swinging revolution in the same direction as the direction of the vortical flow shown in the drawing. During this swinging revolution, if the slip location, which generates slip resistance with respect to this revolution, is limited to the support location on the seal member 16, only slight slip resistance acts during revolution. Therefore, the force (i.e. revolutional force) tending to produce swinging revolution of the water jetting body 110 through lift based on vortical flow will cause the water jetting body 110 to rotate in opposition to the slip resistance. Therefore, the water jetting body 110 will undergo swinging revolution within the vortex chamber while rotational turning in the same direction as the vortical direction (swinging revolution direction) of the cleansing water.

Figure 16A:
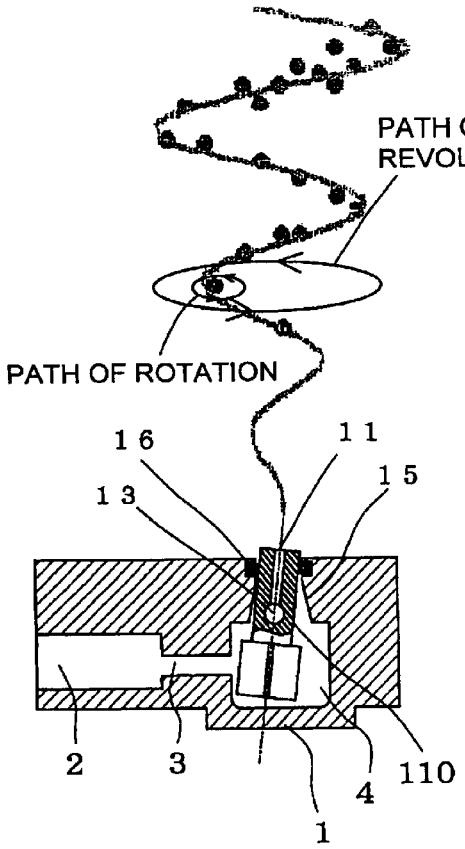
FIG. 16 is a descriptive diagram describing the condition of jetting water when the water jetting body 110 adopts the behavior of FIG. 15, wherein FIG. 16(*a*) is a descriptive diagram describing jet condition in the case where the direction of turning in swinging revolution and rotation are the same, and FIG. 16(*b*) is a descriptive diagram describing jet condition where the direction of turning in swinging revolution and rotation are opposite directions.

Therefore, the cleansing nozzle 1 giving rise to this revolution/rotation in the same direction jets cleansing water on the path modeled in FIG. 16(a). This FIG. 16(*a*) uses arrows to show the turning path direction produce by rotation of the cleansing water and the movement path of the cleansing water produced by swinging revolution in an arbitrary plane perpendicular to the jet direction, to facilitate understanding. That is, the cleansing water is jetted while revolving clockwise due to rotation of the water jetting body, and this jet revolves clockwise due to the swinging revolution of the water jetting body 110. Accordingly, at the outside perimeter of the revolving path of the cleansing water, the rotation direction and revolution direction of the cleansing water coincide, so at the outside perimeter of the revolving path the cleansing water receives air resistance produced by the cleansing water rotation speed and the cleansing water revolution speed. Because of this air resistance, the cleansing water over time creates disturbance from cohesive flow, and is pulled off in drops and scattered. Thus, the cleansing water jetted from the cleansing nozzle 1 under these conditions contacts the human body by advancing along the revolving path in the form of scattered drops, so that a wide area can be washed more softly.

On the other hand, during swinging revolution of the water jetting body 110, as shown in FIG. 15(*b*), the water jetting body 110 is made to contact the vortex chamber 4 inside wall and the taper guide member 15. In this state, slip resistance relative to swinging revolution of the water jetting body 110 increases, so the swinging revolution the water jetting body 110 is no longer able to be rotated in the same direction as the revolution direction by the revolutional force mentioned above. Even where this has occurred, the water jetting body 110 attempts to undergo swinging revolution by the revolutional force, so water jetting body receives slip resistance at the aforementioned contact location and rotates while in internal contact with the vortex chamber 4 inside wall and the taper guide member 15. The rotation direction in this case is the opposite of the swinging revolution direction of the water jetting body 110, and the water jetting body 110 jets water by undergoing swinging revolution, while at the same time rotating in the direction opposite thereto.

Figure 16B:
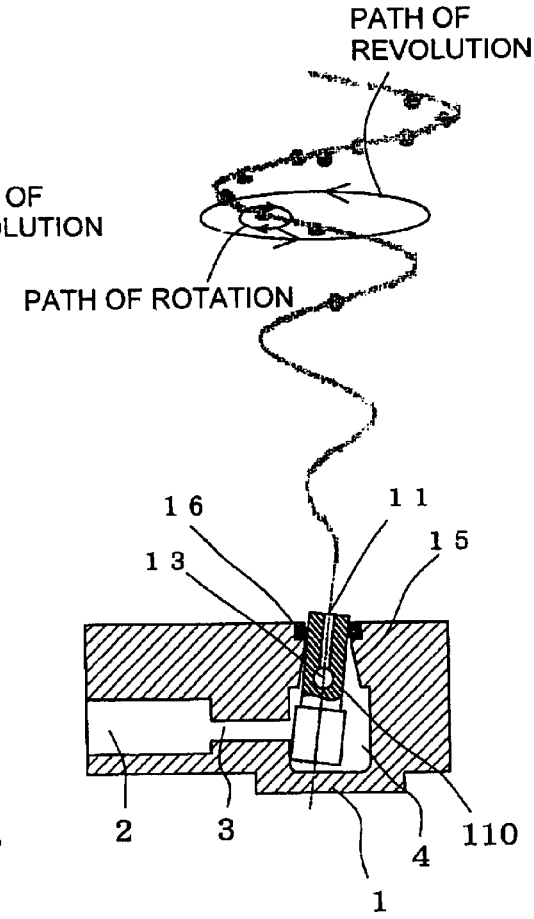

The cleansing nozzle 1 giving rise to this revolution/rotation in the opposite directions jets cleansing water on the path modeled in FIG. 16(*b*). That is, cleansing water is jetted while rotating clockwise due to rotation of the water jetting body 110, and this jet revolves counterclockwise due to swinging revolution of the water jetting body 110. Accordingly, at the outside perimeter of the revolving path of the cleansing water, the rotation direction and revolution direction of the cleansing water are opposite, so at the outside perimeter of the revolving path the cleansing water only receives relatively small air resistance produced by the difference in cleansing water rotation speed and cleansing water revolution speed. Since this air resistance is relatively small, the cleansing water is not scattered to any significant degree and continues to jet while maintaining a relatively cohesive flow. Accordingly, cleansing water jetted from the cleansing nozzle 1 under these conditions contacts the human body in a state of relatively cohesive flow, so that intense, more stimulating cleansing can be performed. Also, as the jet is cohesive, cleansing can be performed with negligible splashing.

Figure 17A:
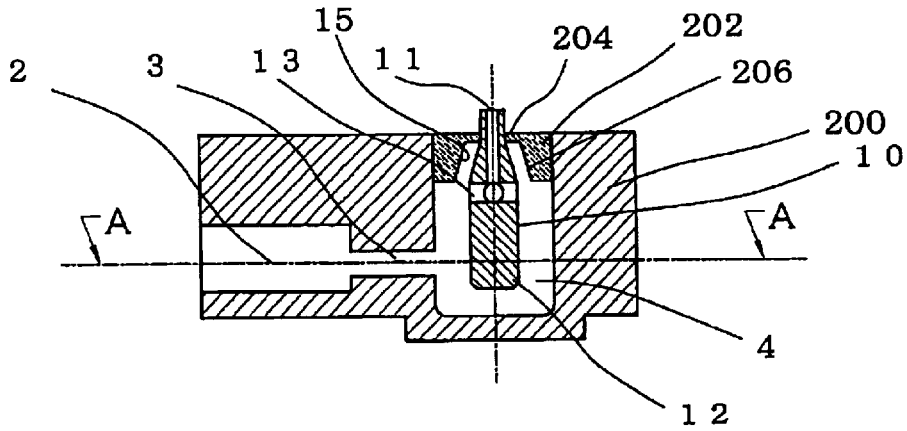
FIG. 17 is a descriptive diagram describing a cleansing nozzle 200 of another example viewed in cross section, wherein FIG. 17(*a*) shows a lateral section of the cleansing nozzle 200, and FIG. 17(*b*) is a sectional diagram of the cleansing nozzle 200 viewed in section in plane A—A in FIG. 17(*a*)
Figure 17B:
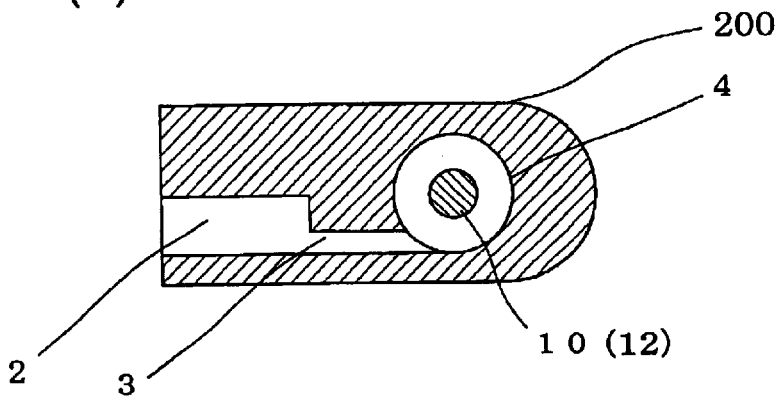

Next, another example shall be described. This example features a water jetting body that is clasped by a flexible member, the water jetting body being assembled in the vortex chamber with the water jetting body in this clasped state. FIG. 17 is a descriptive diagram describing a cleansing nozzle 200 of another example viewed in cross section, wherein FIG. 17(*a*) shows a lateral section of the cleansing nozzle 200, and FIG. 17(*b*) is a sectional diagram of the cleansing nozzle 200 viewed in section in plane A—A in FIG. 17(*a*). This cleansing nozzle 200 has the vortex chamber 4; as for the arrangement by which cleansing water is supplied to the vortex chamber from the conduit 2 and the vortex chamber inflow conduit 3 to create vortical flow in the vortex chamber 4, it is similar to the preceding example.

As shown in the drawing, this cleansing nozzle 200, like the example described in FIG. 4, has the water jetting body 10, and by means of the force receiving member 12 thereof receives lift based on vortical flow. In the present example, this water jetting body 10 is unified with an elastic body 202 having flexibility, and is clasped by the elastic body 202 by means of mating the water jetting member 10*a* with a through-hole opened in a film-shaped member 204 of the elastic body 202. The elastic body 202, clasping the water jetting body 10 in this manner, is assembled with the cleansing nozzle 200 so as to provide closure to the upper end of the vortex chamber 4. This elastic body 202 has the thin film-shaped member 204 and a thick pad member 206 continuous about the clasped water jetting body 10 at the center. That is, the elastic body 202 has non-uniform thickness in the radial direction with the clasped water jetting body 10 at the center.

The elastic body 202, when assembled with the vortex chamber 4, supports the water jetting body 10 with the water jetting spout 11 bordering the outside of the vortex chamber 4 and with the force receiving member 12 descending substantially to the center inside the vortex chamber 4. Therefore, when cleansing water inflows from the vortex chamber inflow conduit 3 into the vortex chamber 4, this cleansing water creates vortical flow around the force receiving member 12 along the inside peripheral wall of the vortex chamber 4, so that lift acts on the force receiving member 12 in the manner described earlier.

When force tending to incline the force receiving member 12 acts thereon, the elastic body 202, which has flexibility, will deform and permit the force receiving member 12 to incline. In particular, the clasp portion of the water jetting body 10 more readily causes inclination of the force receiving member 12, since it consists of the thin film-shaped member 204. Therefore, when lift based on vortical flow acts on the force receiving member 12, the elastic body 202 revolves with the force receiving member 12 inclined within the vortex chamber 4, so that the water jetting body 10 undergoes swinging revolution in the manner described previously.

The thick pad member 206 is sloped so as to encircle the water jetting body 10, and this sloping face is the taper guide member 15 for limiting the maximum inclination angle of the force receiving member 12, and hence of the water jetting body 10, as in the preceding example.

Figure 18:
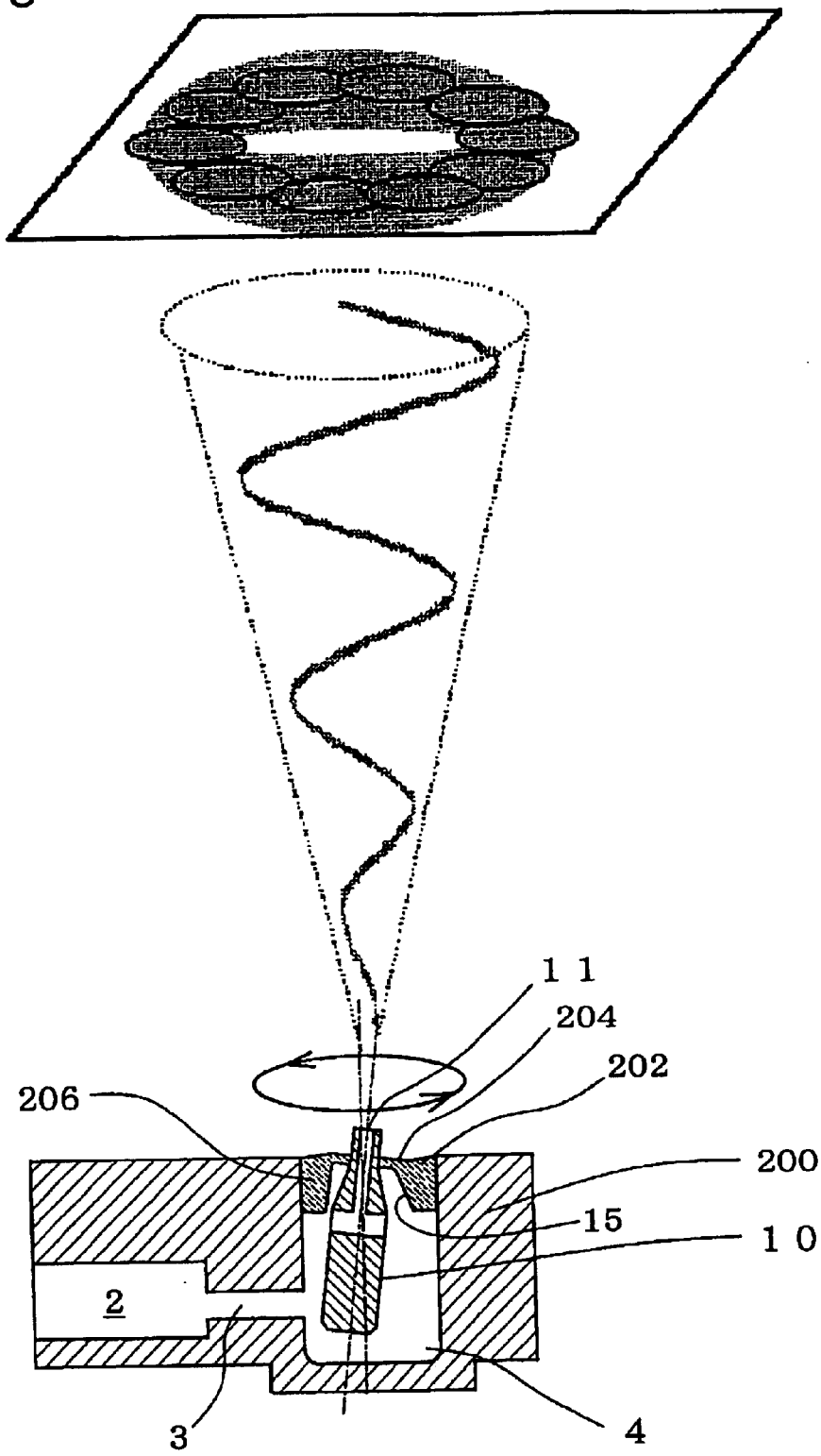
FIG. 18 is a descriptive diagram describing the condition of cleansing water-jet realized by this cleansing nozzle 200.

Jet from the cleansing nozzle 200 of this example is as follows. FIG. 18 is a descriptive diagram describing the condition of cleansing water jet realized by this cleansing nozzle 200.

With this cleansing nozzle 200 as well, as with the preceding example, the water jetting body 10 is made to undergo swinging revolution, so as shown in FIG. 18, the water jetting spout 11 jets the cleansing water in a conical pattern having the swinging center location of the water jetting body 10 (the clasping location of the film-shaped member 204) as the apex, producing the conical revolving jet described earlier. Therefore, with this example as well, effects similar to the previous example can be produced.

On the other hand, with the present example, swinging revolution of the water jetting body 10 is permitted by deformation of the elastic body 202, and the water jetting body 10 is clasped by the elastic body 202 and supported thereby. Therefore, sealing is achieved without creating turning sliding resistance during swinging revolution of the water jetting body 10. As a result, not only is the structure simple, but there is no worry about depositing by scale in the cleansing water or about leaking.

As the material for the elastic body 202 there may be used silicone, NBR, EPDM, fluororubber or other synthetic rubber etc. The elastic body may alternatively be composed of a polyester based, polystyrene based or polyolefin based thermoplastic elastomer, and integrally molded with the water jetting body 10 (so-called two-color molding). By so doing, it is desirable in terms of improving cohesive strength and assembleability. Also, by using a thermoplastic elastomer, there is no need for a vulcanization process etc. in contrast to the case with rubber etc., so that the molding cycle can be shortened.

Meanwhile, PP, POM, ABS etc. may be selected as the material of the water jetting body 10, or made of stainless steel or other metal, or the force receiving member 12 only constructed of metal. When clasping the water jetting body 10 of such material by the elastic body 202, when intending to bond the two, where the elastic body 202 is of synthetic rubber, it is acceptable to select bonding with a vulcanizing adhesive or adhesive. Where a thermoplastic elastomer is used for the elastic body 202, integral molding may be conducted, and bonding effected through fusion of the resin and thermoplastic elastomer by heat during molding. Also, the elastic body 202 and the water jetting body 10 may both be composed of thermoplastic elastomer.

Additionally, the elastic body 202 hardness, elastic coefficient, weight and shape may be optimized to optimize the natural frequency of the elastic body 202. Having done so, vibration of the elastic body 202 and vibration due to swinging revolution of the water jetting body 10 may be made to resonate, allowing the swinging revolution width (extent of inclination of the force receiving member 12) to be increased. Or, by adjusting the natural frequency of the elastic body 202, it is possible to attenuate the elastic body 202 by means of the vibration due to swinging revolution of the water jetting body 10 in order to improve anti-vibration effect. Specifically, it is acceptable to make the hardness of the elastic body 202 extremely low or the thickness small to make the natural frequency small. Or, it is acceptable to make the hardness of the elastic body 202 extremely high or the thickness large to make the natural frequency large.

Figure 19:
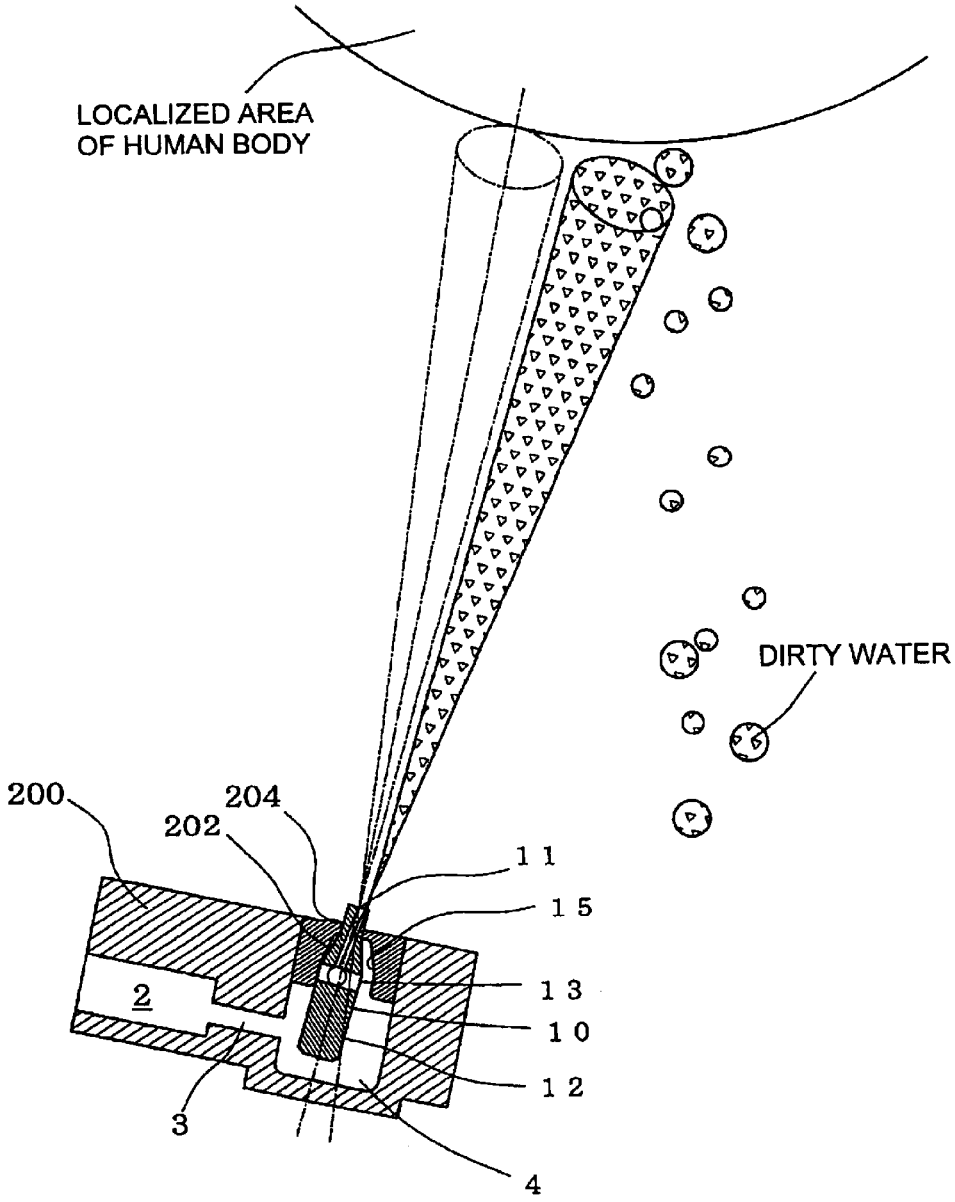
FIG. 19 is a descriptive diagram describing the condition of jetting water obtained in a modified example wherein a water jetting spout 11 is inclined with respect to the center axis of a water jetting body 10.

This example may be modified in the following manner. FIG. 19 is a descriptive diagram describing the condition of jetting water obtained in a modified example wherein the water jetting spout 11 is inclined with respect to the center axis of the water jetting body 10. The condition of jetting water when the water jetting spout 11 is inclined in this way differs with that described in the preceding modified example (see FIG. 14) in respect of the following points.

With the modified example shown in this FIG. 19, the water jetting body 10 is clasped by the elastic body 202 and rotation of the water jetting body 10 is not created. Because of this, the orientation direction of the revolving jet of cleansing water is able to incline towards the side of the inclination direction of the water jetting spout 11. Therefore, as shown in FIG. 19, in a human body part cleansing device, if the cleansing nozzle 200 is advanced on the diagonal and the water jetting spout 11 inclined towards the direction of advance of the cleansing nozzle 200, during cleansing of the buttocks, soiled cleansing water can be prevented from showing back down onto the cleansing nozzle 200. Or, by inclining the water jetting spout 11 opposite from nozzle advance direction, jet can be prevented from splashing forward, termed "blow by", during bidet cleansing.

Alternatively, the water jetting spout 11 may be made eccentric with respect to the center axis of the water jetting body 10 following FIG. 12(*b*). By so doing, to the extent the spout is eccentric, the path of revolving jet can be offset to a corresponding degree.

Figure 20:
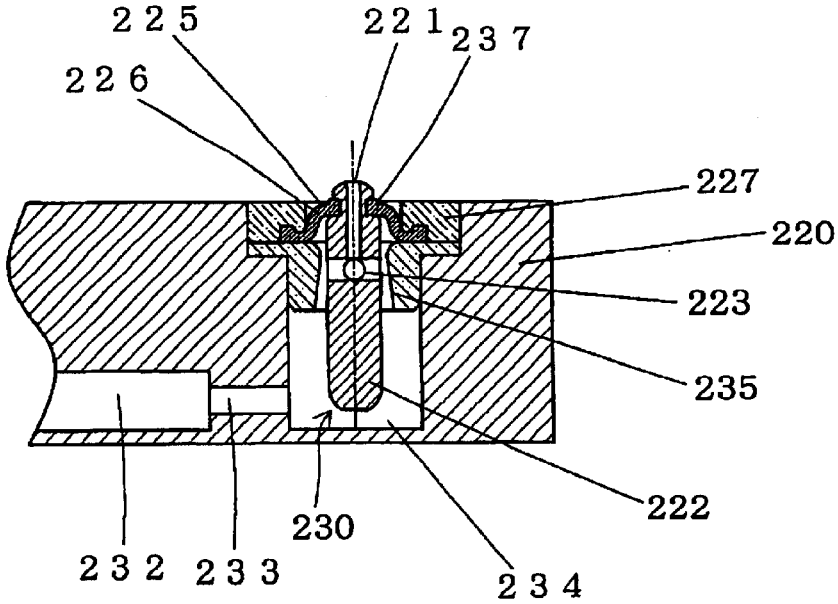
FIG. 20 is a descriptive diagram showing a cross section of a cleansing nozzle 220 of another modified example.

Next, another modified example of the aforementioned example wherein the water jetting body is clasped by an elastic body shall be described. FIG. 20 is a descriptive diagram showing a cross section of a cleansing nozzle 220 of another modified example.

As shown in the drawing, the cleansing nozzle 220 has a conduit 232, a vortex chamber inflow conduit 233 and a vortex chamber 234 corresponding to the conduit 2, the vortex chamber inflow conduit 3 and the vortex chamber 4 of the above example. By supplying water to the vortex chamber 234, the vortical flow described previously is created in the vortex chamber 234.

A water jetting body 230 is assembled in the vortex chamber 234, and this water jetting body 230, like the water jetting body 10 etc., jets cleansing water in the vortex chamber 234 from a water jetting water jetting spout 221 via a water supply conduit 223.

The water jetting body 230 is provided at the upper edge outside perimeter thereof with a groove-shaped elastic body support member 237, and is unified with a flexible elastic body 255 via this elastic body support member 237. The water jetting body 230 is fixed to the cleansing nozzle 220 by means of a restraint 227, and the vortex chamber 234 is provided closure by the elastic body 225. The elastic body 225 is formed from synthetic rubber or thermoplastic elastomer, and readily deforms by virtue of having a flex portion 226. By means of this, the water jetting body 230 is capable of swinging revolution similar to the water jetting body 10 in the cleansing nozzle 200 described previously.

The water jetting body 230 has its maximum inclination angle limited by means of a taper guide member 253 provided in the upper portion of the vortex chamber 234.

Accordingly, when cleansing water is supplied into the vortex chamber 234 to create vortical flow in the vortex chamber 234, a force receiving portion 222 receives the lift that accompanies vortical flow. By means of this, the water jetting body 230 undergoes swinging revolution with respect to the center axis of the vortex chamber 234.

Even with the cleansing nozzle 220 having this structure, as in the example described in FIG. 18, the cleansing water is jetted in a conical revolving jet in association with swinging revolution of the water jetting body 230. Therefore, even with the cleansing nozzle 220 of this modified example, effects similar to the example described previously may be achieved.

With the cleansing nozzle 220 of this modified example, there are the following advantages.

The elastic body 225 readily deforms since it has the flex portion 226. Therefore, swinging revolution of the water jetting body 230 arranged integrally with the elastic body 225 is readily brought about. Accordingly, in regions of low water pressure and weak water flow, even if used with a constricted amount of water, the water jetting body 230 can reliably undergo swinging revolution, so that the reliability of jet can be increased.

Figure 21:
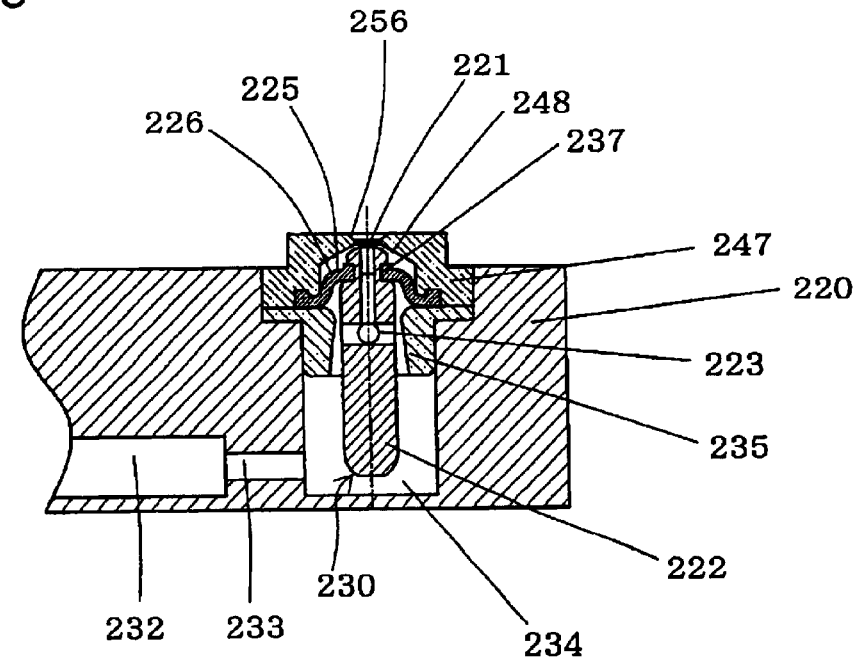
FIG. 21 is a descriptive diagram showing a cross section of the cleansing nozzle 220 of yet another modified example.

Yet another modified example shall be described. FIG. 21 is a descriptive diagram showing a cross section of the cleansing nozzle 220 of yet another modified example. As shown in the drawing, this modified example differs in the arrangement of the elastic restraint securing the water jetting body 223 together with the elastic body 225, but is no different in that the water jetting body 230 is made to undergo swinging revolution and jet a revolving jet of cleansing water.

An elastic restraint 247 of this modified example has an opening 256 opening substantially concentrically with the water-jetting spout 221 in the upper portion of the water jetting spout 221 in the jet direction, and a body restraint 248. This body restraint 248, when the water jetting body 230 is pushed in the jet direction by water pressure during jetting, prevents it from floating up. The edge face of the water jetting spout 221 which internally contacts this body restraint 248 during jetting is spherical-faced or tapered.

In this modified example as well, the water jetting body 230 has its maximum inclination angle limited by a taper guide member 235 provided in the upper portion of the vortex chamber 234.

Even with the cleansing nozzle 220 of this modified example having this structure, as in the example described in FIG. 18 or the above modified example, cleansing water is jetted in a conical revolving jet in association with swinging revolution of the water jetting body 230. Therefore, even with the cleansing nozzle 220 of this modified example, effects similar to the example described previously and the above modified example may be achieved.

With the cleansing nozzle 220 of this modified example, there are the following advantages.

Even if water jetting body is pushed by water pressure to the upper portion in the jet direction, due to the body restraint 248, the water jetting body 230 does not move upwardly more than necessary. Therefore, the elastic body 225 can be further reduced in hardness, made thinner, or otherwise made so that the water jetting body 225 deforms more readily. Even where designed thusly so that the water jetting body 230 readily undergoes swinging revolution, there is no problem of the water jetting body 230 moving more than necessary or the elastic body 225 deforming more than necessary, resulting in breakage or diminished durability.

Further, since the edge face of the water jetting spout 221 is spherical-faced, despite swinging revolution of the water jetting body 230 while in internal contact with the body restraint 248, sliding resistance is minimal. Thus, energy loss during swinging revolution is minimal.

Figure 22A:
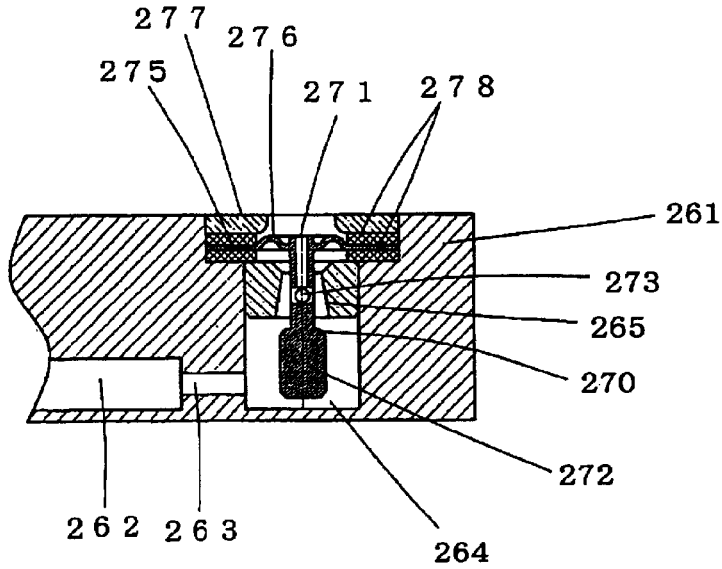
FIG. 22 is a descriptive diagram describing a cleansing nozzle 261 used in this modified example, wherein FIG. 22(*a*) is a longitudinal sectional view of the cleansing nozzle 261, and FIG. 22(*b*) is a descriptive diagram showing the condition of behavior of a water jetting body 270 in this cleansing nozzle 261 and the condition of jetting water from this nozzle.
Figure 22B:
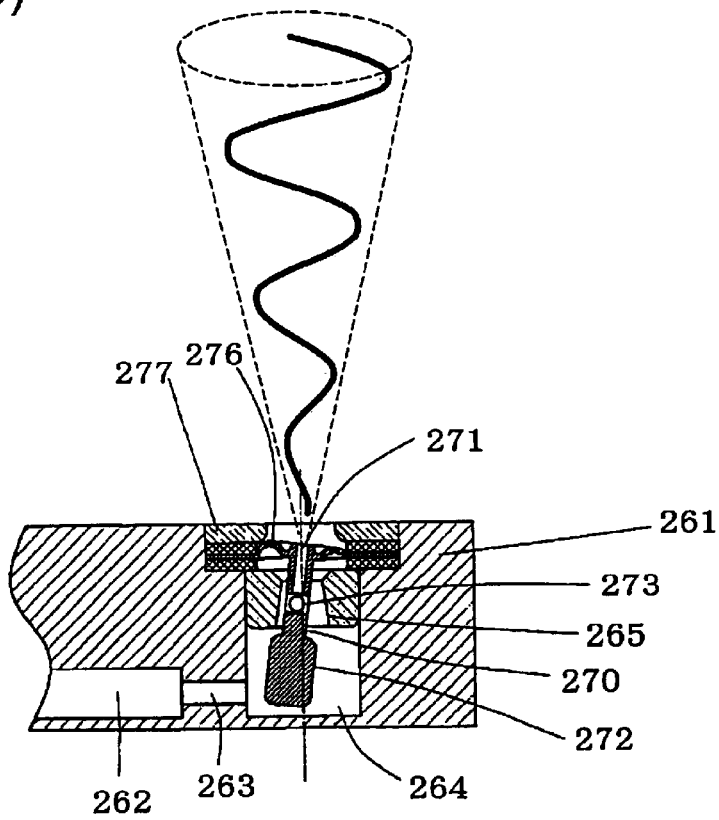

Next, another modified example shall be described. This modified example features a water jetting body and a water jetting body clasping it that are integrally molded of the same material. FIG. 22 is a descriptive diagram describing a cleansing nozzle 261 used in this modified example, wherein FIG. 22(*a*) is a longitudinal sectional view of the cleansing nozzle 261, and FIG. 22(*b*) is a descriptive diagram showing the condition of behavior of a water jetting body 270 in this cleansing nozzle 261 and the condition of jetting water from this nozzle.

As shown in the drawing, the cleansing nozzle 261 of this modified example also has a conduit 262, a vortex chamber inflow conduit 263 and a vortex chamber 264 corresponding to the conduit 2, the vortex chamber inflow conduit 3 and the vortex chamber 4. By supplying water to the vortex chamber 264, the vortical flow described previously is created in the vortex chamber 264.

In this modified example as well the water jetting body 270 is assembled in the vortex chamber 264. This water jetting body 270, like the water jetting body 10 and the water jetting body 230, jets cleansing water in the vortex chamber 264 from a water jetting spout 271 via a water supply conduit 273. The water jetting body 270 also has a force receiving member 272 that receives lift based on vortical flow in the vortex chamber 234.

The water jetting body 270 has a thin disk-shape sheet member 275 on the water jetting spout 271 end. This sheet member 275 has a bowed portion 276 so as to surround the distal end of the water jetting body 270, and this bowed portion 276 projects upwardly. The water jetting body 270, with the sheet member 275 sandwiched by an annular gaskets 278, is fixed to the cleansing nozzle 261 by means of a gasket restraint 277. By means of this vortex chamber 264 is provided closure by the sheet member 275, and the water jetting body 270 is able to undergo swinging revolution similar to the water jetting body 10 and the water jetting body 230 described earlier.

Forming the water jetting body 270 integral with the sheet member 275 of PP, POM, ABS or other soft resin, or polyester based, polystyrene based, polyolefin based or other thermoplastic elastomer is desirable in terms of ensuring flexibility of the sheet member 275. Since the sheet member 275 is of sheet form and has the bowed portion 276 described above, it readily deforms. Therefore, with this modified example as well, it is easy to bring about swinging revolution of the water jetting body 270.

Also, with this modified example as well, the maximum inclination angle of the water jetting body 270 is limited by a taper guide member 265 provided in the upper portion of the vortex chamber 264.

Accordingly, when cleansing water is supplied into the vortex chamber 264 to create vortical flow in the vortex chamber 264, a force receiving portion 272 receives the lift that accompanies vortical flow. By means of this, the water jetting body 270 undergoes swinging revolution with respect to the center axis of the vortex chamber 264.

Even with the cleansing nozzle 261 having this structure, as in the example described in FIG. 18, cleansing water is jetted in a conical revolving jet in association with swinging revolution of the water jetting body 270. Therefore, even with the cleansing nozzle 261 of this modified example, effects similar to the example described previously may be achieved.

The cleansing nozzle 261 of this modified example, as with the cleansing nozzle 220 of the previous modified example, the sheet member 275 is readily deformed. Therefore, swinging revolution of the water jetting body 270 arranged integrally with this sheet member 275 is readily brought about. By means of this, effects similar to the cleansing nozzle 220 of the previous modified example, namely, expanded applicability to low water pressure regions and improved jet reliability, may be achieved.

Also, with this modified example, the sheet member 275 and the water jetting body 270 are integrated using the same material. As a result, not only is the structure simple, but there is no worry about depositing by scale in the cleansing water or about leaking. Additionally, as the material for these there has been selected the aforementioned resins or thermoplastic elastomers, so resistance to chlorinated water and reliability are higher than with synthetic rubber, and high strength can be achieved. Therefore, even where cleansing water that has been disinfected with large amounts of chlorine is used, or where used in high water pressure regions or with a large amount of water, durability and reliability are excellent.

Figure 23A:
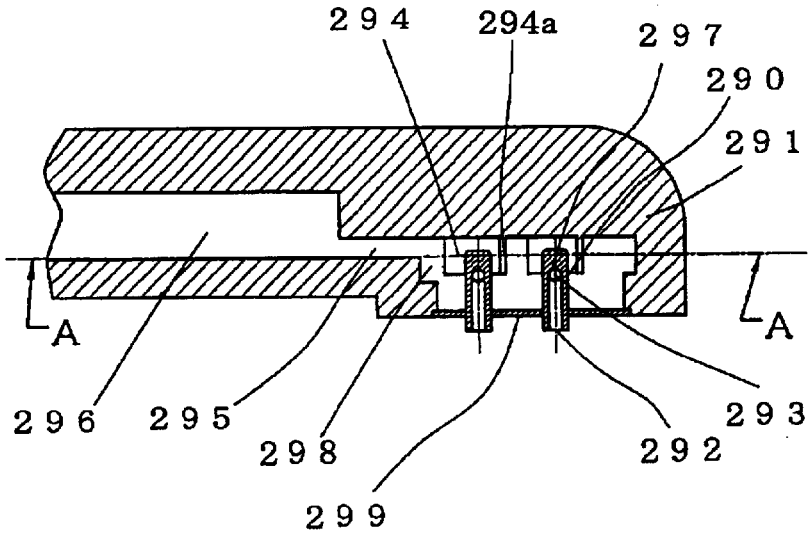
FIG. 23 is a descriptive diagram describing a shower device 291 implementing cleansing water jet in accompaniment with swinging revolution of a water jetting body, wherein FIG. 23(*a*) is a lateral sectional view of the shower device 291, and FIG. 23(*b*) is a sectional diagram the shower device 291 viewed in section in plane A—A in FIG. 23(*a*)
Figure 23B:
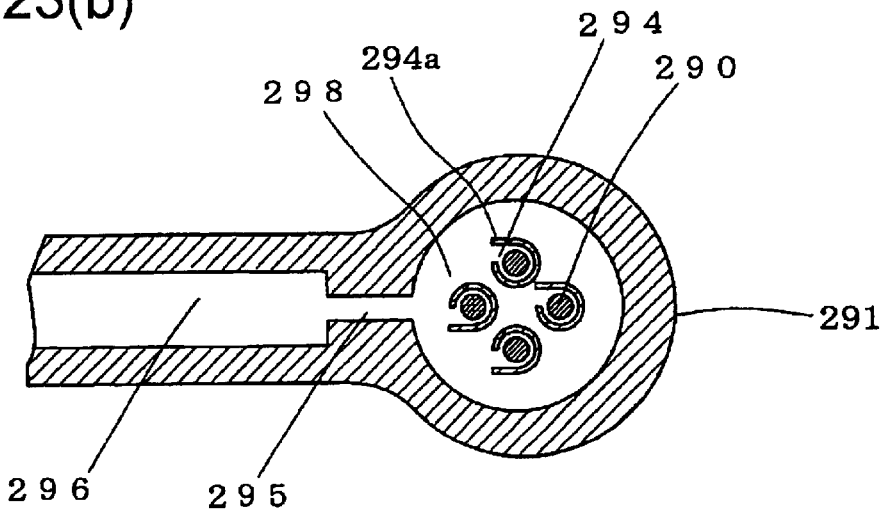
Figure 24:
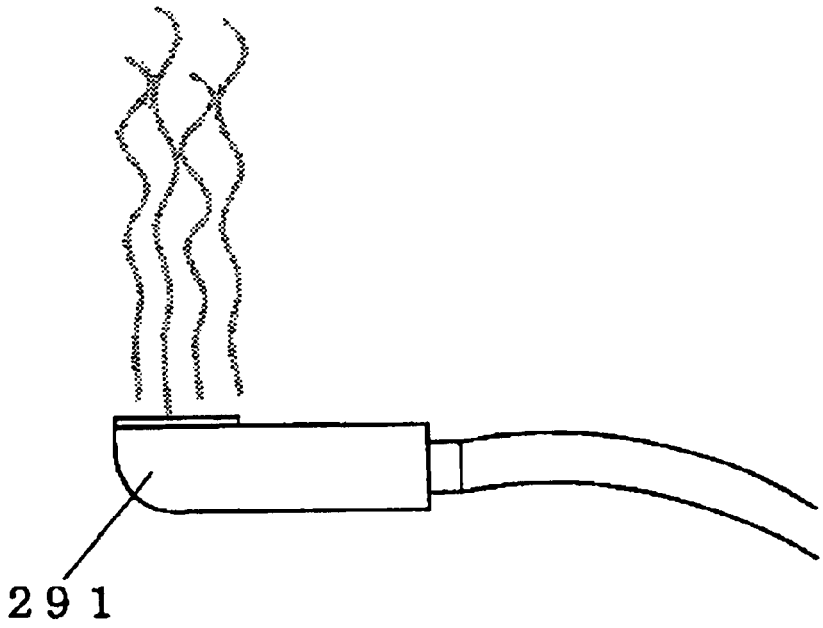
FIG. 24 a descriptive diagram describing the condition of cleansing water jet from this shower device 291.

Next, another example shall be described. This example illustrates application to a device, other than a human body part cleansing device, of a cleansing water jet accompanying swinging revolution of the aforementioned water jetting body. FIG. 23 is a descriptive diagram describing a shower device 291 implementing cleansing water jet in accompaniment with swinging revolution of a water jetting body, wherein FIG. 23(*a*) is a lateral sectional view of the shower device 291, and FIG. 23(*b*) is a sectional diagram the shower device 291 viewed in section in plane A—A in FIG. 23(*a*). FIG. 24 is a descriptive diagram describing the condition of cleansing water jet from this shower device 291.

As shown in FIG. 23(*a*), the shower device 291 comprises a conduit 296 and a buffer chamber inflow conduit 295 having a narrower passage area; cleansing water inflows with high kinetic energy (i.e. at high flow velocity) into to a buffer chamber 298. The buffer chamber 298 is provided with a plurality of the vortex chambers 294, each the vortex chamber 294 being surrounded by a vortex guide 294*a*, with cleansing water being guided along the vortex chamber inside wall into the vortex chamber 294 from an opening in the vortex guide 294*a*. Therefore, with each the vortex chamber 294, vortical flow is generated substantially similarly to the vortex chamber 4 etc. described previously.

Each the vortex chamber 294 is provided with a water jetting body 290. The water jetting body 290 comprises a water jetting spout 292, and guides cleansing water in the vortex chamber 294 via a water supply conduit 293 to the water jetting spout 292, from which it is jetted. This water jetting body 290 has one end thereof positioned within the vortex chamber 294, and this zone is designated a force receiving member 297. This force receiving member 297, like the force receiving member 12 described previously, receives the aforementioned lift based on vortical flow.

Each water jetting body 290 is integral with an elastic body 299 of thin film form having flexibility, and is clasped by this elastic body 299. The elastic body 299 is fixed to the shower device 291 so as to cover an opening in the buffer chamber 298. Therefore, the elastic body 299 supports each of water jetting body 290 such that the water jetting spout 292 thereof borders the outside of the vortex chamber 294, with the force receiving member 297 descending substantially to the center inside the vortex chamber 294. Accordingly, cleansing water inflows from the buffer chamber inflow conduit 295 to the buffer chamber 298, and when cleansing water flows into each the vortex chamber 294, this cleansing water gives rise to vortical flow around the force receiving member 297 along the inside peripheral wall of the vortex chamber 294. By means of this, lift as described hereinabove acts on the force receiving member 297, and the water jetting body 290 undergoes swinging revolution.

With the shower device 291 having this arrangement, in each vortex chamber 294, the water jetting body 290 undergoes swinging revolution, so the jet from-each water jetting spout 292 is a revolving jet as described in FIG. 18. The jet from the shower device 291 overall, as shown in FIG. 24, is an aggregate of revolving jets from each of the water jetting spouts 292. Here, the jet from any water jetting spout 291 is a revolving jet independent of the revolving jet of any other spout.

Accordingly, with this shower device 291, as with the examples and modified examples thereof shown previously, even if cleansing water quantity is reduced, jet can be carried out with stimulation and wide wash area assured.

Also, the swinging revolution frequency of the water jetting body 290 in each the vortex chamber 294 can be made to 3 Hz and more with flow velocity regulation etc. such as described previously. By so doing, revolving jet from each water jetting spout 292 imparts a sensation similar to being contacted uniformly by jet as described previously, and since these revolving jets are aggregated, the shower jet overall imparts a sensation of being contacted uniformly as well.

By setting the swinging revolution frequency to 40 Hz and more, it is possible to eliminate unpleasant sensation during cleansing, even when cleansing areas of the body where skin perception is sensitive, cut/scrape areas, etc. By further increasing this frequency, the jet sensation received by the human body becomes quite similar to a sensation of all water contact sites being uniformly contacted by jet. Where the swinging revolution frequency is set to about 160 Hz, the sensation of all water contact sites being uniformly contacted by jet is no longer obtained.

The higher swinging revolution frequency, the greater the centrifugal force and air shear to which the jetted cleansing water is subjected, leading to dispersion and splashing of jet. Therefore, in cases where it is desirable to limit dispersion and splashing of jet, the swinging revolution frequency should be kept to 160 Hz and below.

With the shower device 291 described above, the water jetting bodies 290 are supported by a shared elastic body 299, but is not limited to this. For example, each individual water jetting body 290 could be supported by the seal member 16 shown in FIG. 4, etc., or each water jetting body 290 guided by a guide member such as the taper guide member 15. Or, without providing a buffer chamber 298, a plurality of the vortex chambers 294 can be formed directly in the shower device 291, and the cleansing water flow branched into each the vortex chamber.

Figure 25:
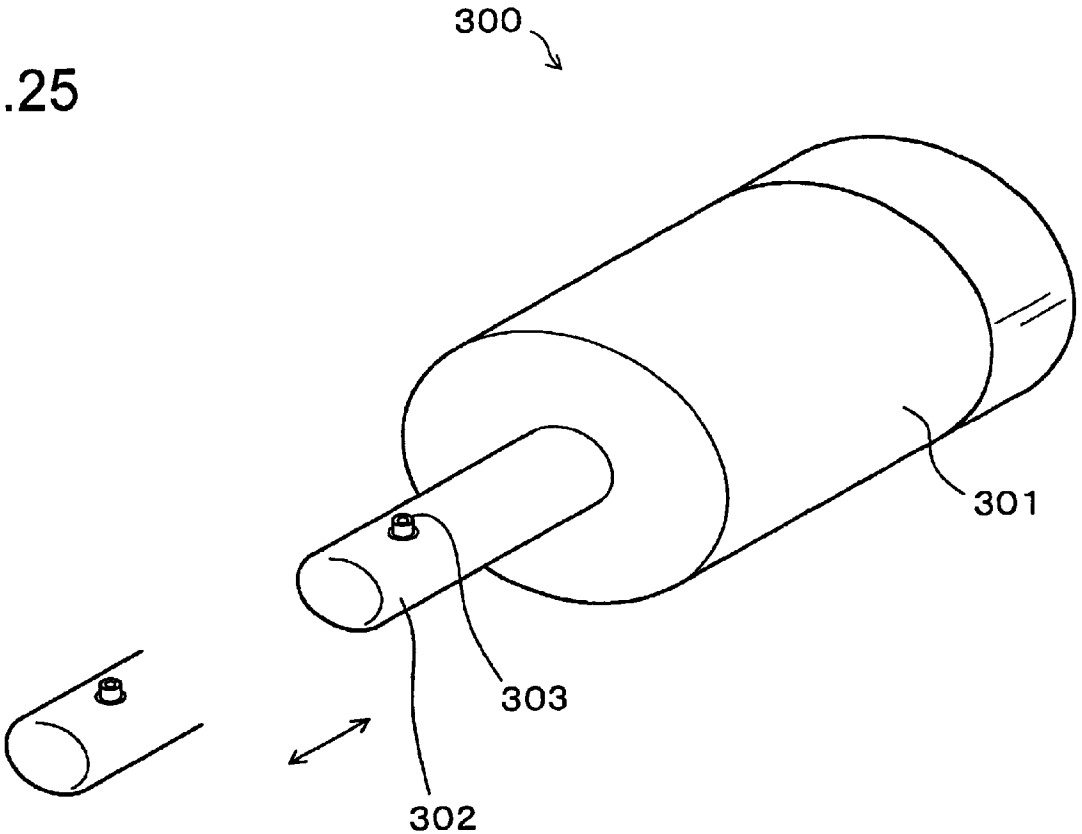
FIG. 25 is a simplified perspective view of a portable human body part cleansing device 300 implementing revolving jet in accompaniment with swinging revolution of a water jetting body.

Next, another example of revolving jet of cleansing water accompanying swinging revolution of a water jetting body shall be described. FIG. 25 is a simplified perspective view of a portable human body part cleansing device 300 implementing revolving jet in accompaniment with swinging revolution of a water jetting body.

As shown in the drawing, this human body part cleansing device 300 comprises a tank 301, and a cleansing nozzle 302 extendable and retractable with respect to the tank 301. The cleansing nozzle 302 is designed so that when cleansing water in the tank is pushed by grasping the tank of by a pump having a dry cell as drive power source, receives this water pressure and advances forward to a predetermined location, and then jets cleansing water.

This cleansing nozzle 302 comprises at the nozzle tip end a water jetting body 303, arranged so as to be capable of swinging revolution like the water jetting body 10 described earlier. Cleansing water is supplied to a vortex chamber, not shown, in which the water jetting body is assembled, so that cleansing water creates vortical flow and realizes a revolving jet.

With this human body part cleansing device 300, since it has the water jetting body 303 that undergoes swinging revolution based on vortical flow, the water conservation efficiency described previously serves to eliminate the dissatisfaction associated with water in the tank 301 becoming quickly depleted. Additionally, since there is no need for an actuator, etc., the device is lightweight and suited to being taken along, as well as allowing expansion of wash area and improvement of cleansing power to be performed at the same time, despite being of portable type.

Figure 26:
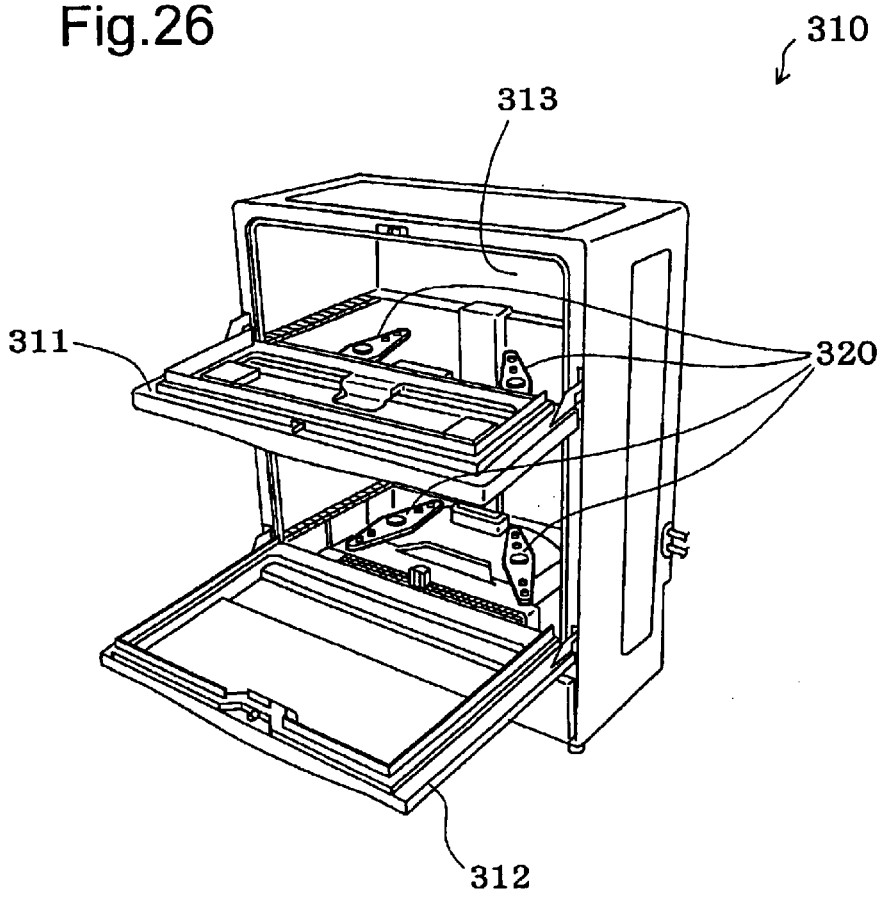
FIG. 26 is a simplified perspective view of a dish-cleansing device 310 implementing revolving jet in accompaniment with swinging revolution of a water jetting body.

Next, yet another example of a revolving jet of cleansing water shall be described. FIG. 26 is a simplified perspective view of a dish-cleansing device 310 implementing revolving jet in accompaniment with swinging revolution of a water jetting body, and FIG. 27 is a descriptive diagram describing a rotating wash arm 320 of this dish-cleansing device 310.

As shown, in the drawing, the dish-cleansing device 310 comprises front panel upper/lower doors 311, 312, and closes a wash chamber 313 with these doors. In this wash chamber 313 are provided spinning wash arms 320 that spin while jetting water, arranged in two upper/lower rows.

A spinning wash arm 320 is rotatably supported at its center by a support post 321, and has to both the left/right sides of this support post 321 sets of two jet nozzles 322 each. This jet nozzle 322 has a vortex chamber 323 and a water jetting body 324, as well as having a water supply conduit, not shown, for supplying cleansing water to the vortex chamber 323 from a tangential direction and creating cleansing water flow. In this case, the vortex chamber 323 and the water jetting body 324 can be the various ones described in the previous examples or modified examples thereof. For example, besides the vortex chamber 4 and the water jetting body 10 shown in FIG. 6, they can be the vortex chambers and the water jetting bodies shown in FIG. 10–FIG. 22.

Figure 27:
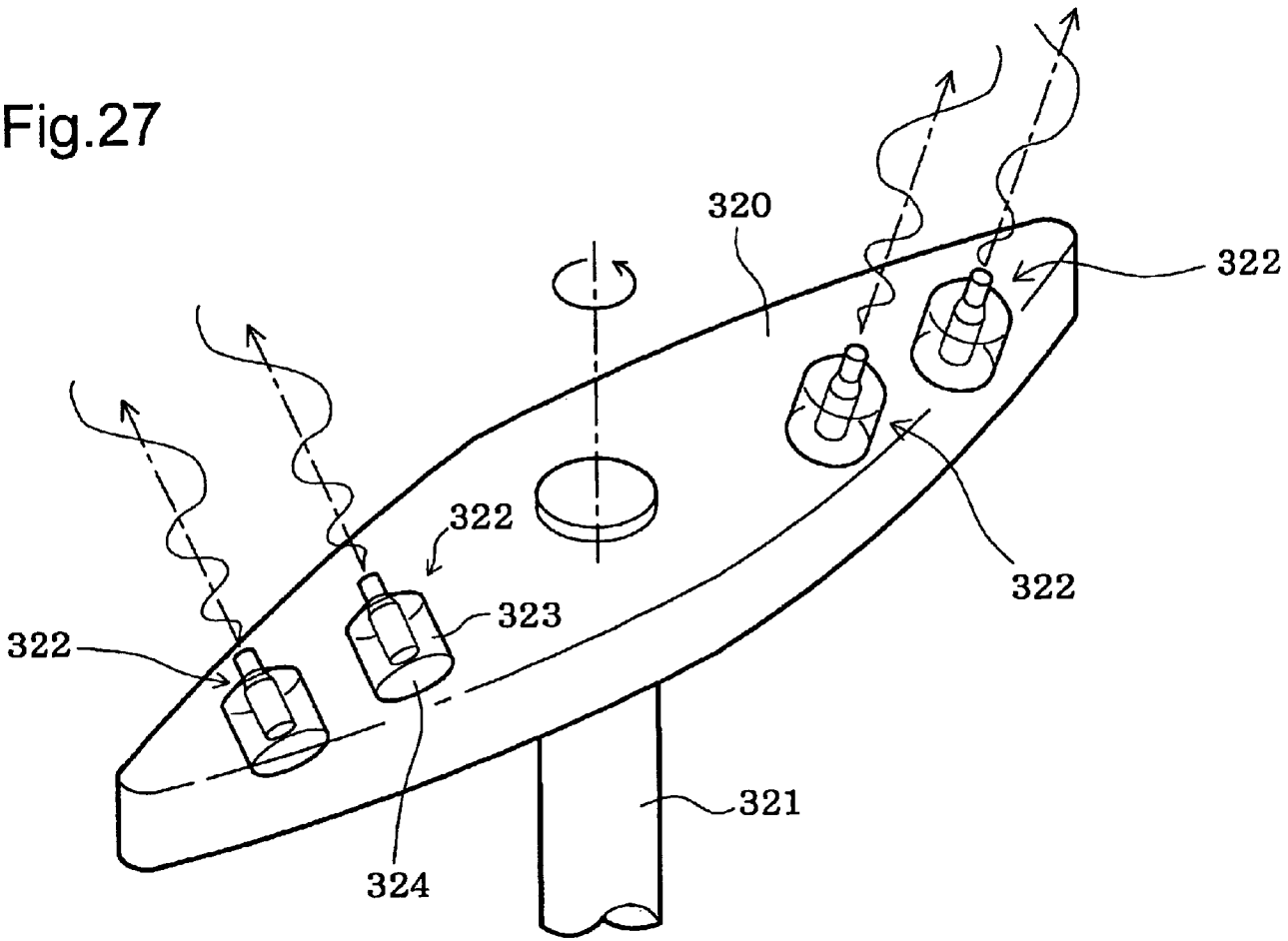
FIG. 27 is a descriptive diagram describing a rotating wash arm 320 of this dish-cleansing device 310.

This dish-cleansing device 310 has each of the jet nozzles 322 shown in FIG. 27 with the orientation direction of jet thereof facing diagonally, and the left/right jet nozzles of the spinning wash arm 320 have opposite orientation directions of jet. That is, the left side jet nozzle 322 in the drawing jets rearward with respect to the plane of the paper, and the right side jet nozzle 322 jets frontward with respect to the plane of the paper. Because of this, when cleansing water is jetted from each jet nozzle of the left/right ends of spinning wash arm 320, the reaction force generated by that cleansing water jet bears on the spinning wash arm 320 in the same direction.

To make the orientation direction of jet diagonal, it is acceptable to form the vortex chamber 323 diagonally in conjunction with the orientation direction of jet.

With this dish-cleansing device 310, each of the jet nozzles 322 having a vortex chamber 323 and a water jetting body 324 gives rise to vortical flow in the vortex chamber 323. Because of this, each jet nozzle 322 causes the water jetting body 324 to undergo swinging revolution like the water jetting body 10 described previously, realizing a revolving jet as shown in FIG. 6 and FIG. 11, FIG. 14, FIG. 16, FIG. 18 etc.

With this dish-cleansing device 310 as well, since each jet nozzle 322 is giving rise to revolving jet, as noted previously, there can be provided improvement in water conservation efficiency, improvement in cleaning performance (soil separation performance of dishware), expansion of wash area (water contact area) etc. In terms of the feature of dish-cleansing in particular, the advantage of being above to exhibit high cleaning performance with a small amount of cleansing water is desirable.

The jet nozzle 322 may, if necessary, be fixedly placed on a wall of the wash chamber 313. For example, a dish for a pot-steamed hotchpotch from which soil is difficult to remove may be placed in a "power scrub" rack of the wash chamber 313, and jetted (revolving jet) in this power scrub rack from a wall-fixed jet nozzle 322. By so doing, even a dish for a pot-steamed hotchpotch can be washed appropriately with high cleaning power. Also, with this wall-fixed nozzle, existing ordinary nozzles can be removed and replaced with the aforementioned jet nozzles 322. By so doing, an existing dish-cleansing device can be retrofitted easily so as to give excellent water conservation and high cleaning performance.

With the dish-cleansing device 310 described above, there are the following advantages.

As described above, when jetted from each jet nozzle 322 of the spinning wash arms 320, the spinning wash arms 320 are spun by the jet reaction force thereof. Accordingly, the spinning wash arms 320 can be made to spin while the jet produced by swinging revolution from each jet nozzle showers the dishes. Therefore, cleaning performance of dishware can be increased, and cleansing water can be jetted even into the corners of the wash chamber to wash dishes thoroughly all over.

Also, in the spinning wash arm 320 described above, the vortex chamber 323 takes an inclined attitude with respect to the spinning wash arm 320, and the water jetting body 324 is assembled in this vortex chamber 324. Where this water jetting body 324 is the water jetting body of FIG. 17 or FIG. 20–FIG. 22, during non-cleansing, this water jetting body 324 assumes an attitude extended substantially vertical downward under its own weight via bowing of the attached the film-shaped member 204 or sheet member 275 etc. That is, the water jetting body 324 assumes an inclined attitude in the inclined the vortex chamber 323, forming a narrow place of the gap between the water jetting body outside wall and the vortex chamber inside wall around the water jetting body.

Accordingly, when cleansing water is supplied to a vortex chamber under this condition, the flow velocity of the vortical flow increases in the aforementioned narrow place of the gap. Because of this flow velocity differential described earlier can be reliably created around the water jetting body 324. Therefore, swinging revolution of the water jetting body 324 based on the aforementioned lift can be created reliably, and the reliability of revolving jet can be increased. Moreover, since the water jetting body 324 is inclined from the outset with respect to the vortex chamber 323, collision of vortical flow is produced from the onset of inflow, and the water jetting body 324 is pushed by vortical flow. Therefore, the water jetting body 324 can give rise to swinging revolution quickly, and revolving jet can commence from the outset of cleansing water supply.

In this case, a condition of the vortex chamber and water jetting body being relatively inclined prior to commencing cleansing as described above can be realized easily by the examples and modified examples thereof described previously. For example, the cleansing nozzle 1 or the cleansing nozzle 200 of the human body part cleansing device 100 may be designed to. extend and retract diagonally as shown in FIG. 19. Even where this is done, the water jetting body 10 in each nozzle is diagonal with respect to the vortex chamber thereof, so there are the aforementioned advantages.

With the aforementioned dish-cleansing device 310, jet reaction force is utilized to spin the spinning wash arms 320, but is not limited to this. For example, the spinning wash arm 320 could be turned by a motor or the like, and the jet nozzle 322, on this spinning wash arm 320, is arranged upwardly facing.

Or, the upwardly facing jet nozzle 322 could be arranged on the upper face of the spinning wash arm 320, as well as also providing the jet nozzle 322 on a side face of the spinning wash arm 320. By so doing, the jet nozzle 322 of the side face, while cleansing dishware to the side of the spinning wash arm 320, spins the spinning wash arm 320 by the jet reaction force thereof. Meanwhile, the jet nozzle 322 of the upper face washes dishware above the spinning wash arm 320.

Figure 28:
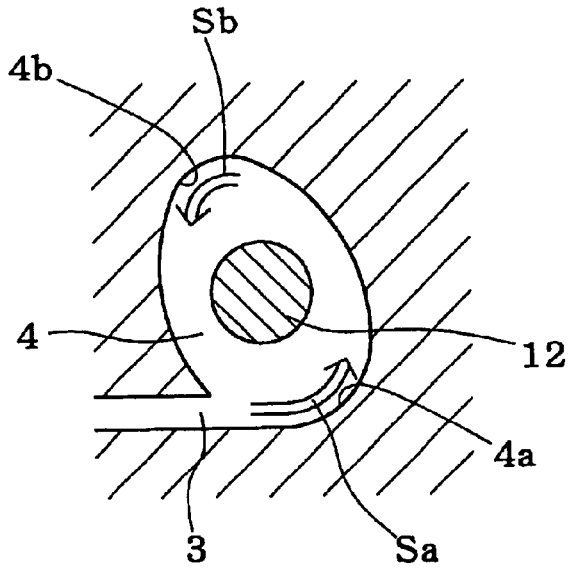
FIG. 28 is a descriptive diagram describing a method for creating a flow velocity differential around the force receiving member 12 in the vortical flow of the vortex chamber 4.

Next, an arrangement implementable in the examples and modified examples thereof described previously shall be described. FIG. 28 is a descriptive diagram describing a method for creating a flow velocity differential around the force receiving member 12 in the vortical flow of the vortex chamber 4, and FIG. 29 is a descriptive diagram describing another method for creating a flow velocity differential around the force receiving member 12.

As shown in FIG. 28, the vortex chamber 4 has an inside peripheral cross section of generally ovoid shape, the extent of curvature at the peripheral wall zone 4*a* opposite the vortex chamber inflow conduit 3 is large, and is small at the peripheral wall zone 4*b*. Therefore, differences in the manner of flowing of cleansing water are created between the peripheral wall zone 4*a* and the peripheral wall zone 4*b* having different curvatures, so that a flow velocity differential can be created reliably in vortical flows Sa, Sb at the two locations.

Figure 29:
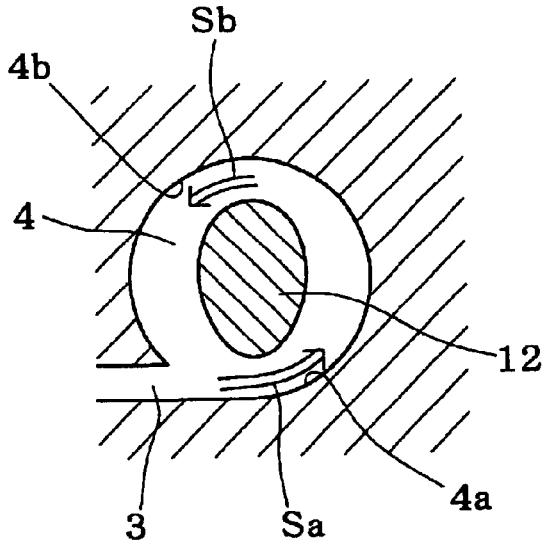
FIG. 29 is a descriptive diagram describing another method for creating a flow velocity differential around the force receiving member 12.

In the modified example shown in FIG. 29, the force receiving member 12 has a cross sectional shape that is generally ovoid. Therefore, the force receiving member 12, at the side thereof that is convex, narrows the gap between the force receiving member 12 outside wall and the vortex chamber inside wall to a greater extent than at other places. Because of this, cleansing water flow velocity can be increased in this narrowed gap, and a flow velocity differential created around the force receiving member 12. As shown in the drawing, where the convex zone of the force receiving member 12 is in proximity to the peripheral wall zone 4*a*, the flow velocity of vortical flow Sa at that location will reliably be faster than the vortical flow Sb at the peripheral wall zone 4*b*.

As a result, by contriving the shape of the vortex chamber 4 or the force receiving member 12 as shown in FIG. 28 and FIG. 29, there can be imparted stability of swinging revolution of the water jetting body/jet pattern.

Figure 30:
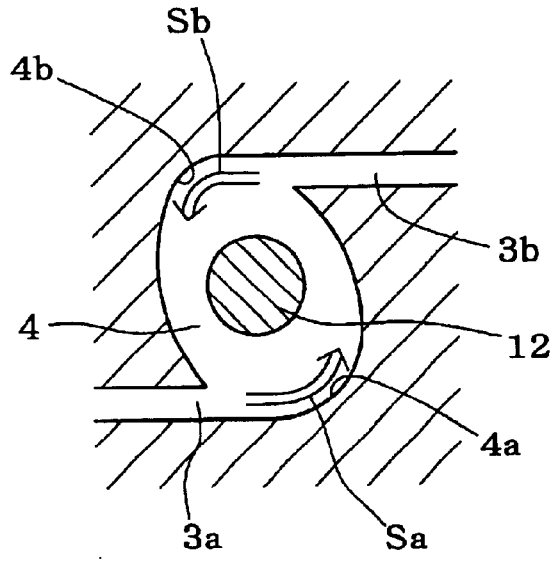
FIG. 30 is a descriptive diagram describing the state of cleansing water inflowing from 2 flow paths to the vortex chamber 4 shown in FIG. 28.
Figure 31:
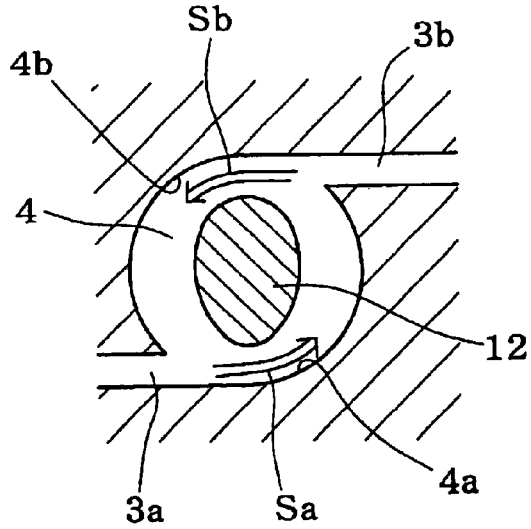
FIG. 31 is a descriptive diagram describing the state of cleansing water inflowing from 2 flow paths to the vortex chamber 4 shown in FIG. 29.

FIG. 30 is a descriptive diagram describing the state of cleansing water inflowing from 2 flow paths to the vortex chamber 4 shown in FIG. 28, and FIG. 31 is a descriptive diagram describing the state of cleansing water inflowing from 2 flow paths to the vortex chamber 4 shown in FIG. 29.

With those shown in these drawings, if one vortex chamber inflow conduit 3*a* and the other vortex chamber inflow conduit 3*b* have generally the same conduit area, there is no difference in flow velocity of the vortical flows Sa, Sb of cleansing water inflowing from each at the outset of inflow. However, when passing the peripheral wall zone 4*a* and the peripheral wall zone 4*b* that have different curvatures, a flow velocity differential between the vortical flows Sa, Sb at the two locations is created. Therefore, as shown in FIG. 30 and FIG. 31 even if cleansing water from a plurality of flow paths inflows to the vortex chamber 4, stability may be imparted to swinging revolution of the water jetting body/jet pattern.

Also, cleansing water inflow is performed from both the flow paths of the vortex chamber inflow conduit 3*a* and the vortex chamber inflow conduit 3*b*, so vortical flow around the force receiving member 12 in the vortex chamber 4 can be induced easily and reliably.

Figure 32A:
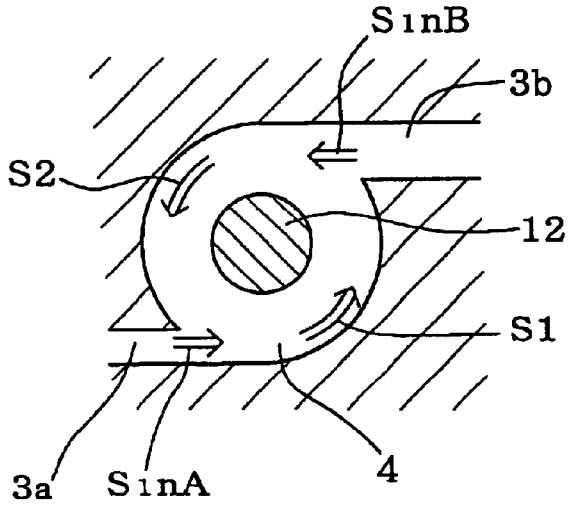
FIG. 32 is a descriptive diagram describing another method for inflowing cleansing water into the vortex chamber from a plurality of flow paths, wherein FIG. 32(*a*) is a descriptive diagram describing another method wherein a flow velocity differential is imparted to inflowing cleansing water per se from a plurality of flow paths, FIG. 32(*b*) is a descriptive diagram showing a method for adjusting timing of cleansing water inflow from a plurality of flow paths, and FIG. 32(*c*) is a descriptive diagram showing a method for changing inflow location of a plurality of flow paths.
Figure 32B:
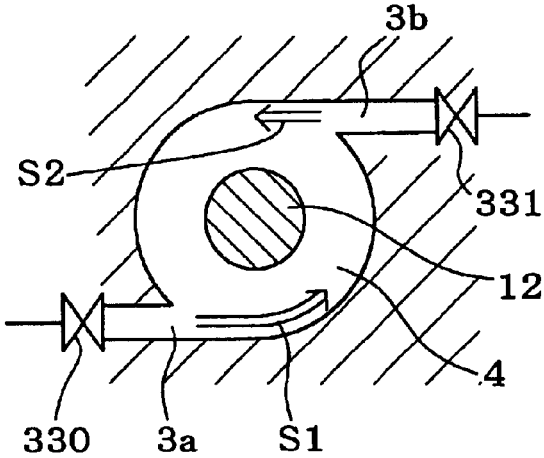
Figure 32C:
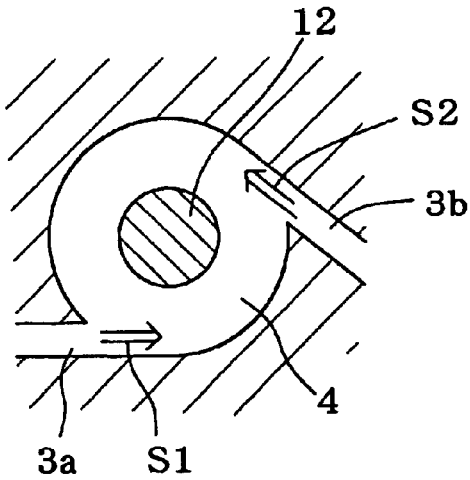

FIG. 32 is a descriptive diagram describing another method for inflowing cleansing water into the vortex chamber 4 from a plurality of flow paths, wherein FIG. 32(*a*) is a descriptive diagram describing another method wherein a flow velocity differential is imparted to inflowing cleansing water per se from a plurality of flow paths, FIG. 32(*b*) is a descriptive diagram showing a method for adjusting timing of cleansing water inflow from a plurality of flow paths, and FIG. 32(*c*) is a descriptive diagram showing a method for changing inflow location of a plurality of flow paths.

As shown in FIG. 32(*a*), the vortex chamber inflow conduit 3*a* has a more constricted conduit area than does the vortex chamber inflow conduit 3*b*. Therefore, of inflowing cleansing water SinA, SinB from each inflow conduit, the cleansing water of the former has a faster flow velocity. Because of this, those vortical flows Sa. Sb can be reliably made to have a flow velocity differential between the two locations of the peripheral wall zone 4*a* and the peripheral wall zone 4*b*.

As shown in FIG. 32(*b*), gate valves 330, 331 are respectively assembled in the vortex chamber inflow conduit 3*a* and the vortex chamber inflow conduit 3*b*. When jetting of cleansing water is commenced, either gate valve is opened after a delay. By so doing, at the point in time at which the delayed gate valve opens, cleansing water newly flows in, and the flow velocity at that inflow location can be increased. Therefore, even by means of this a flow velocity differential can be reliably imparted to vortical flow around the force receiving member 12.

As shown in FIG. 32(*c*), the vortex chamber inflow conduit 3*a* and the vortex chamber inflow conduit 3*b* inflow cleansing water to the vortex chamber 4 at locations that are asymmetrical with respect to the center of the vortex chamber 4. In the illustrated case, cleansing water flow from the vortex chamber inflow conduit 3*a* converges at the cleansing water inflow location from the vortex chamber inflow conduit 3*b*. Therefore, at this convergence location, flow velocity is higher than at other places, and a flow velocity differential can be reliably imparted to vortical flow around the force receiving member 12.

Where a plurality of the vortex chamber inflow conduits are provided as in these drawings, there are the following advantages. That is, as compared to the case where cleansing water inflow is provided from a single the vortex chamber inflow conduit, there is the advantage that flow velocity differential and flow velocity of the vortex chamber as a whole can be controlled independently. For example, if each inflow velocity is reduced while maintaining the relative relationship of cleansing water inflow velocity from each the vortex chamber inflow conduit, the overall flow velocity of the vortex chamber can be slowed while holding the flow velocity differential constant, so that stabilized vortical flow turning (swinging revolution of the water jetting body) can be realized.

Further, while the number of the vortex chamber inflow conduits may be three or more, in that case at least one of them can give rise to cleansing water inflow at different flow velocity, or have a different conduit area. Or, the inflow location at least one of them can be asymmetrical to the others.

Figure 33:
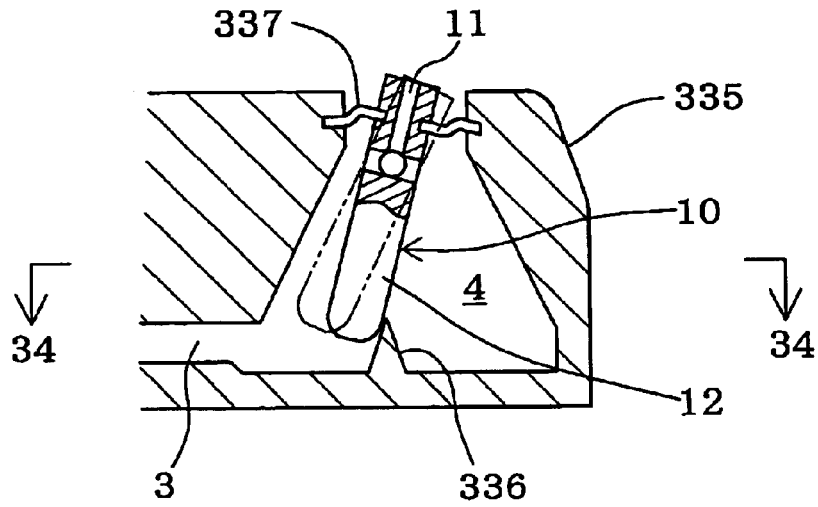
FIG. 33 is a descriptive diagram describing a cleansing nozzle 335 of a modified example.

Next, a modified example featuring a particular attitude of the water jetting body 10 during non-cleansing and a particular shape of the vortex chamber 4 shall be described. FIG. 33 is a descriptive diagram describing a cleansing nozzle 335 of a modified example.

As shown in the drawing, the cleansing nozzle 335 has a projection 336 in the center of the floor of the vortex chamber 4. In this case, the water jetting body 10 is a round column body of substantially uniform diameter including the force receiving member 12, and is supported by a flexible elastic body 337, with the water jetting spout 11 bordering the outside.

The vortex chamber 4 has a tapered inside peripheral wall that constricts in diameter towards the water jetting spout 11 end, and in substantial proximity of the floor thereof receives inflow of water from the vortex chamber inflow conduit 3 in a tangential direction. Therefore, with this cleansing nozzle 335 as well, vortical flow around the force receiving member 12 is created in the vortex chamber 4.

This cleansing nozzle 335, during the time of non-cleansing in the absence of inflow of cleansing water to the vortex chamber 4, the bottom end of the force receiving member 12 is made to interfere with the projection 336. Therefore, during this time of non-cleansing, the force receiving member 12 assumes an inclined attitude with respect to the vortex chamber 4, and in particular with respect to the center of the vortex chamber 4. As a result, as shown by the solid line in FIG. 33, a narrowed place is formed between the force receiving member 12 and the inside wall (taper wall) of the vortex chamber 4. Therefore, from the outset of inflow of cleansing water to the vortex chamber 4, the flow velocity of cleansing water passing through the aforementioned narrowed place can be increase, and a flow velocity differential of vortical flow brought about reliably. Because of this, from the outset of cleansing water inflow, the lift described previously can be generated reliably, so stabilization of the water jetting body 10 swinging revolution/jet pattern can be readily provided.

Further, with this cleansing nozzle 33, the inside peripheral wall of the vortex chamber 4 is tapered and the water jetting body 10 (the force receiving member 12) is made of column shape, so the gap between the outside face of the inclined force receiving member 12 and the tapered inside wall of the vortex chamber 4 can be substantially the same over the entire length of the force receiving member 12. Therefore, since the force receiving member 12 is inclined as shown in the drawing, flow velocity as the vortical flow passes through the aforementioned gap can be sped up in substantially the same way over the entire length of the force receiving member 12. That is, by increasing the length that contributes to generation of lift, lift can be increased. As a result, the drag accompanying lift increases as well, and the swinging revolution speed of the water jetting body 10 increases. Additionally, the range at which interference with the vortical flow is longer, so the force receiving member 12 is turned directly by the vortical flow along the direction, thereof. Because of this, centrifugal force is greater, and acceleration of swinging revolution of the water jetting body 10, and hence swinging revolution of the water jetting body 10 on a stabilized path and stabilized jet may be realized readily.

Also, with the cleansing nozzle 335, it has both an arrangement wherein the vortex chamber 4 has a tapered inside wall and an arrangement having the projection 336 in the center of the floor, but it would be possible to only taper the vortex chamber 4 or only have the projection 336. For example, the projection 336 could be formed in the vortex chamber shown in FIG. 4 or FIG. 20. Also, in the cleansing nozzle 335, the vortex chamber 4 devoid of the projection 336 could be used.

Figure 34:
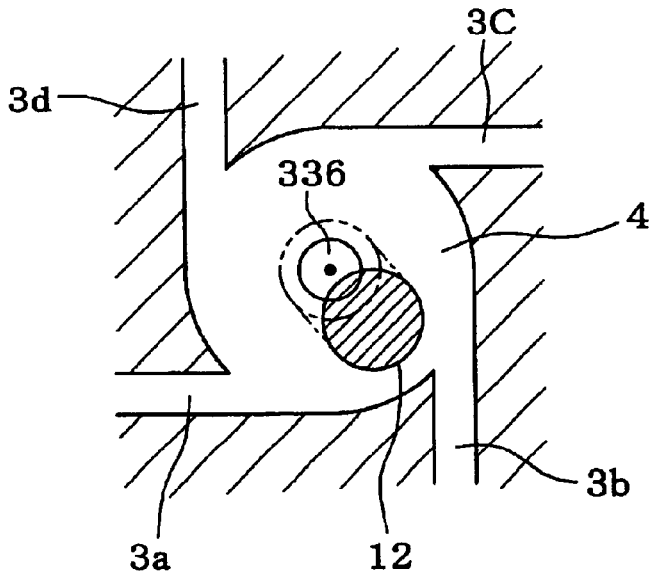
FIG. 34 is a sectional view of the vortex chamber 4 in the modified example of the cleansing nozzle 335, viewed in section along line 34—34 in FIG. 33.

In this way, with the cleansing nozzle 335, the water jetting body 10 is inclined at the time of non-cleansing, and thus can be modified in the following way. FIG. 34 is a sectional view of the vortex chamber 4 in the modified example of the cleansing nozzle 335, viewed in section along line 3333 in FIG. 33.

As shown in the drawing, in this modified example, the vortex chamber inflow conduits 3*a*–3*d* of equal diameter are provided pointsymmetrically with respect to the vortex chamber 4. Therefore, when cleansing water inflows from each inflow conduit to the vortex chamber 4 having no water jetting body 10 assembled, substantially no flow velocity differential is produced in the vortical flow. By the way, in this modified example, due to the projection 336, the force receiving member 12 in inclined at the time of non-cleansing, so the narrowed place in which the gap is narrowed is present in the gap between the outside wall of the force receiving member 12 and the tapered inside wall of the vortex chamber 4 as described previously. Therefore, even where a plurality of flow paths are arranged point-symmetrically, due to inclining of the force receiving member 12, flow velocity differential of the vortical flow in the above manner can be created reliably, and stabilization of the water jetting body 10 swinging revolution/jet pattern may be provided easily.

Figure 35:
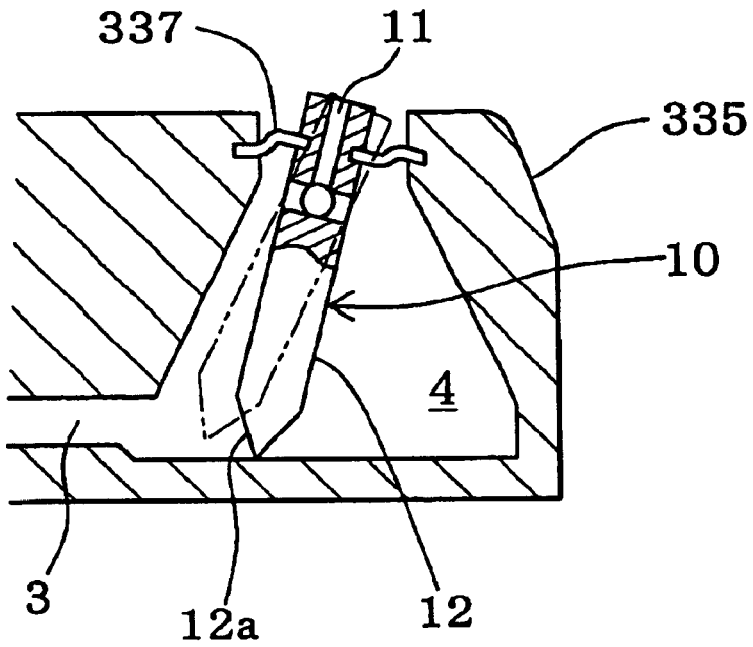
FIG. 35 is a descriptive diagram describing the cleansing nozzle 335 modified so that incline of the force receiving member 12 is created by the water jetting body 10 itself.

FIG. 35 is a descriptive diagram describing the cleansing nozzle 335 modified so that incline of the force receiving member 12 is created by the water jetting body 10 itself. As shown in the drawing, in this modified example, the water jetting body 10 has a convex portion 12*a* at the bottom end of the force receiving member 12, and by means of contact of this convex portion 12*a* with the vortex chamber floor, the force receiving member 12 takes an inclined attitude at the time of non-cleansing. Therefore, with this modified example as well, stabilization of the water jetting body 10 swinging revolution/jet pattern may be provided easily.

Figure 36:
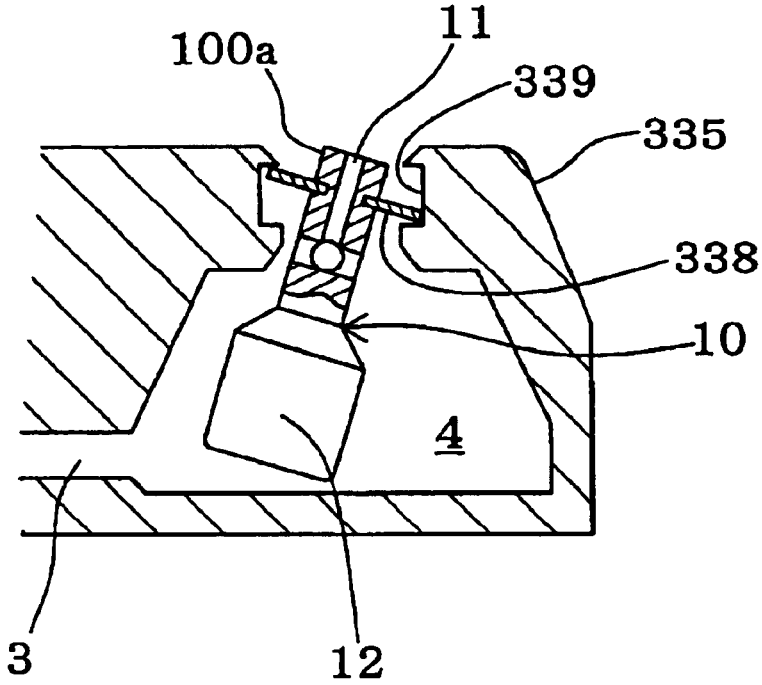
FIG. 36 is a descriptive diagram describing the cleansing nozzle 335 modified so that the force receiving member 12 of the water jetting body 10 is a column of greater diameter than a water jetting member 10*a;*

FIG. 36 is a descriptive diagram describing the cleansing nozzle 335 modified so that the force receiving member 12 of the water jetting body 10 is a column of greater diameter than the water jetting member 10*a*. As shown in the drawing, in this modified example, the water jetting body 10 has the force receiving member 12 and the water jetting member 10*a* of smaller diameter than this. An annular flange 338 is attached to this water jetting member 10*a*, and this flange 338 is assembled in an opening inside groove 339 at the top end of the vortex chamber 4 so as to have play.

With the cleansing nozzle 335 of this modified example, the force receiving member 12 is made to revolve by means of cleansing water inflow to the vortex chamber 4. During this time, the center portion of swinging movement of this force receiving member 12 (the water jetting body 10) is the zone of the small-diameter water jetting member 10*a*. Therefore, the pressure receiving face area of water pressure of the cleansing water received from the vortex chamber 4 is smaller, and resistance in the center portion during revolution, that is, resistance during revolution while the flange 338 contacts the groove wall of the opening inside groove 339, is smaller as well. Therefore, this is advantageous for accelerating and stabilizing swinging revolution of the water jetting body 10, and is also advantageous in reducing wear of the flange 338 and the opening inside groove 339.

Also, with this cleansing nozzle 335, the force receiving member 12 is of large diameter, and the projection area is large as well, and therefore the lift/drag generated at the force receiving member 12 is high. Because of this, the mass thereof is high as well. As a result of these, the inertia (=centrifugal force) once the force receiving member 12 has revolved under the influence of the lift/centrifugal force described previously, increases. Because of this, there are advantages in terms of stabilizing swinging revolution of the water jetting body 10 and stabilizing revolving jet. To increase the mass of the force receiving member 12, simple methods for doing so are to fabricate the force receiving member 12 of metal, and to fabricate the water jetting member 10*a* continuous therewith of resin. In terms of producing the water jetting member 10*a* and the force receiving member 12 with the former made of resin and the latter of metal, a production method such as insert molding is advantageous in terms of productivity and lower cost.

Figure 37:
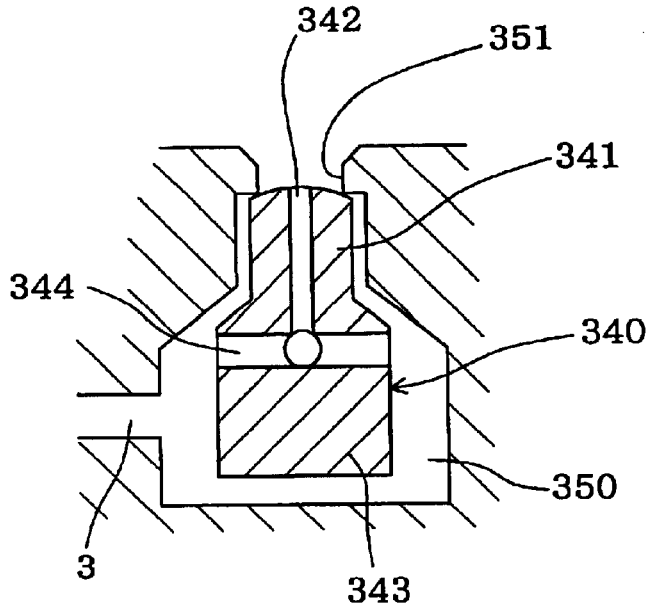
FIG. 37 is a descriptive diagram describing the condition of a water jetting body 340 and support in a modified example.

Next, a modified example of the water jetting body support method shall be described. FIG. 37 is a descriptive diagram describing the condition of a water jetting body 340 and support in a modified example.

As shown in the drawing, a vortex chamber 350 having the water jetting body 340 assembled therein has an opening 351 at the upper end thereof. The water jetting body 340, in the state of being assembled in the vortex chamber 350, has a water jetting spout 342 of the water jetting member bordering the outside from the opening 351.

With the vortex chamber 350 substantially filled with inflowing cleansing water, the cleansing water is guided through a water supply conduit 344 to the water jetting spout 342 in the water jetting body 340. In this state, the water jetting body 340 is pushed upwardly towards the opening 351 by the cleansing water inflowing into the vortex chamber 350, and is supported on the rim of the opening 351 by the distal end of the water jetting member 341. That is, at the time of cleansing water inflow, the water jetting body 340 is supported with the rim of the opening 351 as a swivel plate, and the force receiving member 343 receives lift based on vortical flow, producing swinging revolution as described earlier.

During swinging revolution of the water jetting body 340, by means of the upward pushing mentioned above, the distal end of the water jetting member 341 of the water jetting body 340 is pushed against the rim of the opening 351. By the way, during this pushing against, since the water jetting body per se is undergoing swinging revolution, the water jetting member distal end gives rise to so-called "one-sided touching" with the rim of the opening on the side to which the water jetting body is inclined. By so doing, in areas other than the side to which it inclines, the water jetting member distal end is apart from the rim of the opening, and in association with swinging revolution of the water jetting body 340, the position at which the water jetting member distal end contacts the rim of the opening changes while maintaining one-sided touching. Thus, cleansing water within the vortex chamber 350 attempting to leak out from the water jetting member distal end in non-one-sided touching areas thereof can be made to function as seal water of the water jetting member distal end. Therefore, no special lubricants or lubrication function is required at the water jetting member distal end or rim of the opening, providing a simpler arrangement and simplifying maintenance/inspection and assembly operations.

During swinging revolution of the water jetting body 340 the water jetting member distal end is merely made to undergo one-sided touching, so contact between the water jetting member distal end and rim of the opening occurs over only a small area. Therefore, frictional force associated with contact can be reduced, which is desirable in terms of preventing wear.

Figure 38:
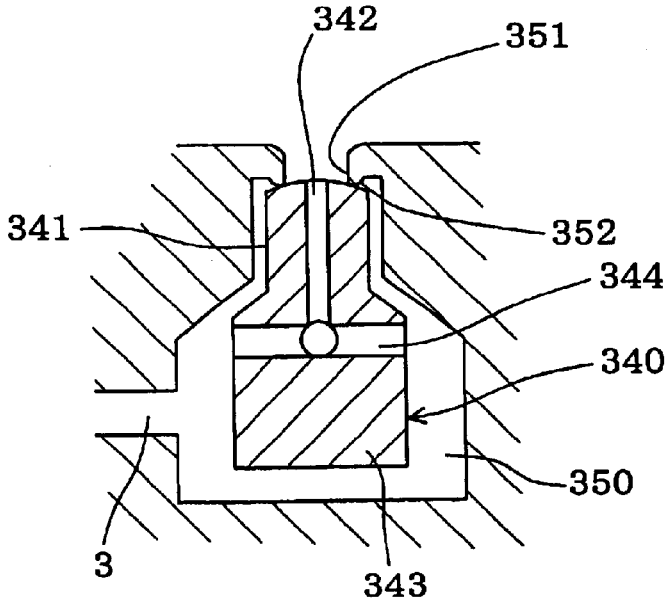
FIG. 38 is a descriptive diagram describing a water jetting body support method of yet another modified example.

FIG. 38 is a descriptive diagram describing a water jetting body support method of yet another modified example. As shown in the drawing, in this modified example, the opening rim of the opening 351 has an annular projection 352 projected towards the distal end of the water jetting member 341. With this modified example, when the water jetting member 341 distal end is one-sided touching in the manner described earlier, the water jetting member distal end is in one-sided touching contact only at this annular projection 352. Because of this there is the advantage of stabilizing one-sided touching, the aforementioned wear prevention, etc. Also, even if wear should occur, along the circumference of the annular projection 352 the location of contact by the water jetting member distal end does not change, so there is no functional impairment such as a drop in speed due to wear, and turning is stable.

In this case, by making the water jetting member distal end shown in FIG. 37 and FIG. 38 of sloping face shape, spherical shape or arcuate shape, there is the advantage of stabilizing one-sided touching-and preventing the aforementioned wear. By making the curvature or taper angle of the distal end shape large, one-sided touching can be stabilized further. That is, where the water jetting body inclines slightly, a connection wherein the water jetting member distal end does not contact the water jetting member over the entire circumference is produced, producing one-sided touching. Also, by tapering or chamfering to an arcuate shape the peripheral edge of the water jetting member distal end, there is the advantage of stabilizing one-sided touching, the aforementioned wear prevention, etc.

Figure 39:
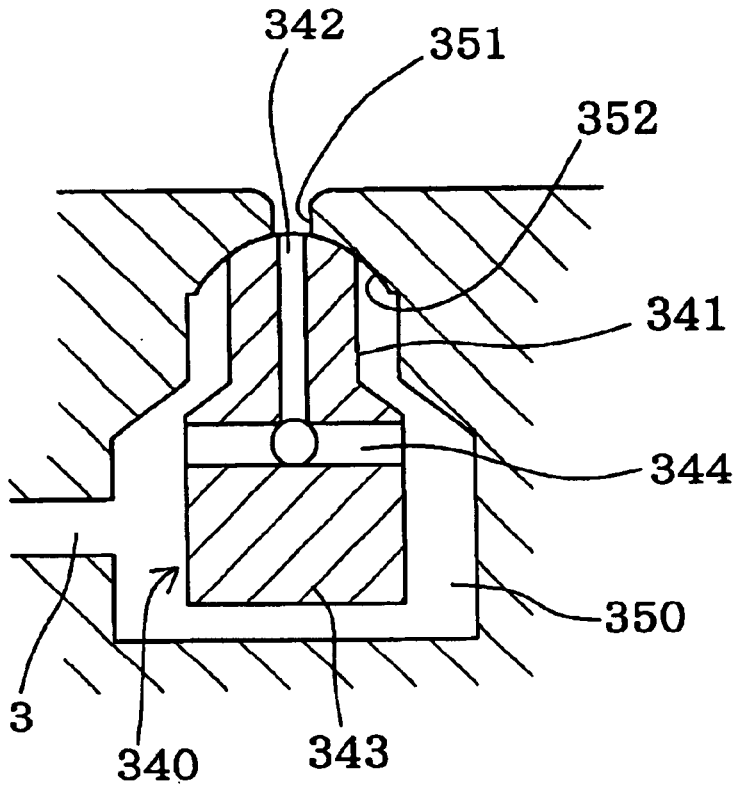
FIG. 39 is a descriptive diagram describing a water jetting body support method of another modified example.

FIG. 39 is a descriptive diagram describing a water jetting body support method of another modified example. As shown in the drawing, in this modified example the opening rim 352 of the opening 351 is of spherical shape, and the distal end of the water jetting member 341 is of convex spherical shape conforming to this spherical shape. With this modified example, since there is mutual contact between spherical shapes, depending on the relationship of the two spherical shapes, there can be adopted a case where the water jetting member distal end is made to undergo one-sided touching of the opening rim 351 as described above, or a case where the water jetting member distal end is received by the opening rim 352 over substantially the entire circumference thereof. In either case, it is possible to stabilize swinging revolution of the water jetting body 340. Also, to produce one-sided touching in this modified example, it is acceptable to make the curvature of the water jetting member 341 distal end and the curvature of the opening rim 352 different, or to make substantially entire-circumference touching, the curvatures of the two may be made substantially the same.

Figure 40:
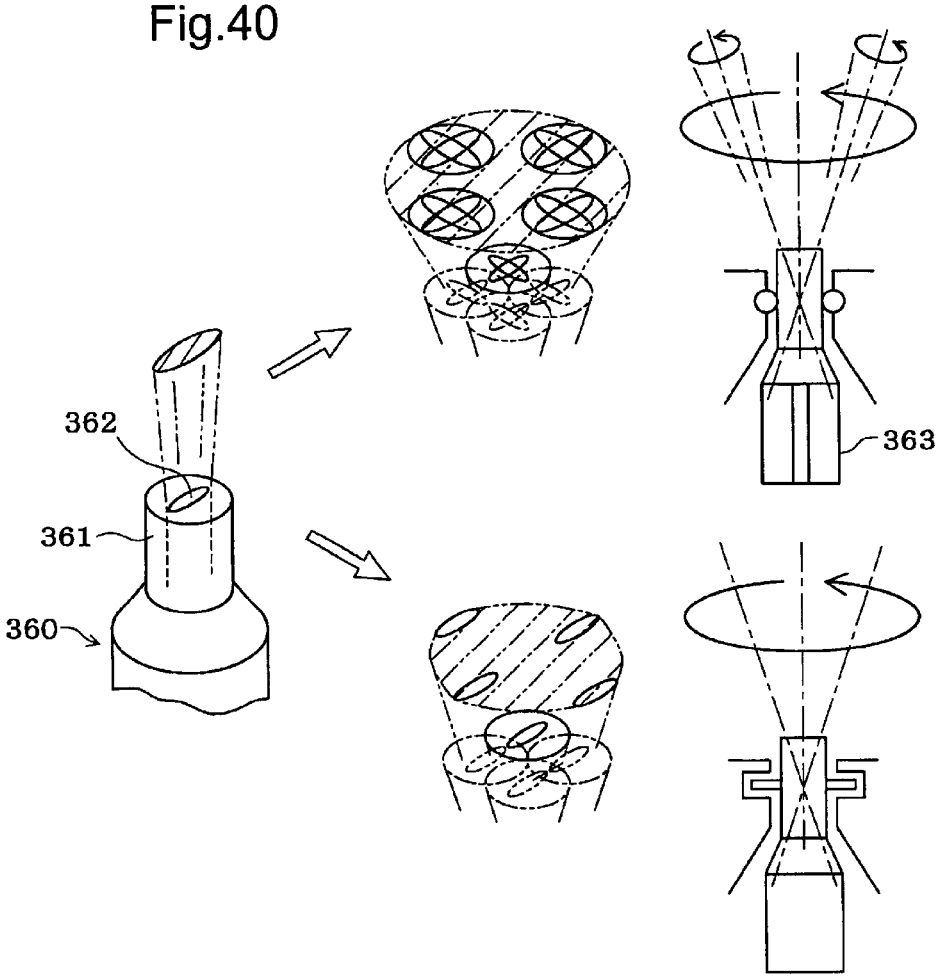
FIG. 40 is a descriptive diagram describing a water jetting body 360 of a modified example.

Next, a modified example of the water jetting body shall be described. FIG. 40 is a descriptive diagram describing a water jetting body 360 of a modified example, and FIG. 41 is a descriptive diagram describing a water jetting body 365 of another modified example.

The water jetting body 360 of the modified example shown in FIG. 40 has a slot-shaped water jetting spout 362 in the water jetting member 361. This water jetting body 360 can be made to give rise to swinging revolution as described in FIG. 17 and FIG. 22. By so doing, as shown in the drawing, the slot-shaped jet conforming to the shape of the spout can be expanded so as to revolve along a conical revolving jet path. Therefore, as shown in the drawing, the jet region can be expanded, and hollowing of the jet prevented from occurring. Also, during expansion of the jet region, as noted earlier, water conservation can be provided.

The water jetting body 360, on the other hand, has blades at a force receiving member 363 as described in FIG. 11, and as made so as to give rise to swinging revolution and water jetting body rotation as described previously. By so doing, as shown in the drawing, jetting occurs while the slot-shaped water jetting spout 362 is turning due to water jetting body rotation, and the jet moves along a conical revolving jet path. During this time, as with the aforementioned inclined/eccentric spout, the effects of rotation of the water jetting body per se and of centrifugal force occurring due to water jetting body rotation cause the aforementioned conical revolving jet path to become a spread out conical shape. Therefore, when giving rise to swinging revolution and spout rotation (water jetting body rotation), the jet region may be expanded further, and hollowing of the jet can be prevented more reliably. Also, during expansion of the jet region in this way, as noted previously, water conservation can be provided.

Figure 41:
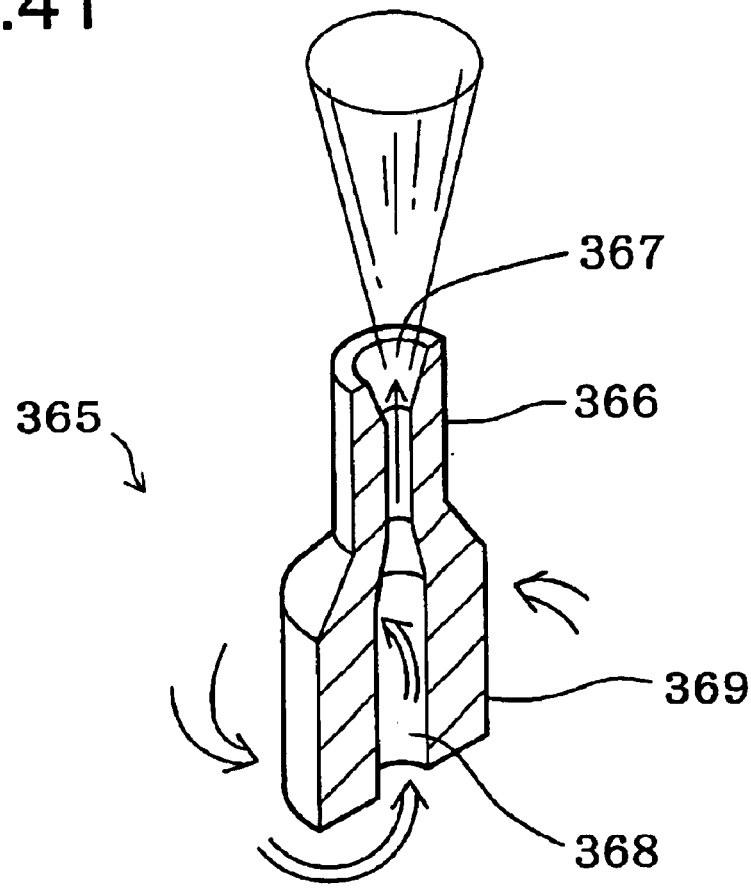
FIG. 41 is a descriptive diagram describing a water jetting body 365 of another modified example.

The water jetting body 365 of the modified example shown in FIG. 41 has a water jetting member 366 with a water jetting water jetting spout 367 of expanded tapered shape, and guides cleansing water to the water jetting spout 367 from a water supply conduit 368 passing through in the axial direction. The water supply conduit 368 is larger in diameter at the force receiving member 369 end and smaller in diameter at the water jetting member 366 end. Cleansing water of the vortex chamber (omitted from the drawing) is taken into this water supply conduit 368 from the bottom end thereof, and the cleansing water is jetted in a tapered shape from the water jetting spout 367 in conformance with the tapered shape thereof. Also, this water jetting body 365 is applicable to both the case of creating swinging revolution/ rotation of the water jetting body, and to the case of creating swinging revolution only; in either case, as with the water jetting body 360, avoidance of hollowing of jet, expansion of jet and, water conservation may be provided.

With this water jetting body 365, when guiding cleansing water to the water jetting spout 367, the cleansing water passes through the water supply conduit 368 of constricted pipe diameter. Therefore, the cleansing water receives rectification by means of this constricted pipe diameter and is jetted from the water jetting spout 367. Also, even when cleansing water is inflowing to the water supply conduit 368, cleansing water circulating around the force receiving member 369 inflows to the water supply conduit 368 while retaining the vortical component thereof. Because of this, the cleansing water passes spirally through the large-diameter portion of the water supply conduit 368, so rectifiability is increased. By means of such rectification, jet from the water jetting spout 367 can be stabilized. Therefore, the condition of jetting water accompanying swinging revolution/rotation of the water jetting body can be further stabilized, and improved reliability of jet provided.

Figure 42:
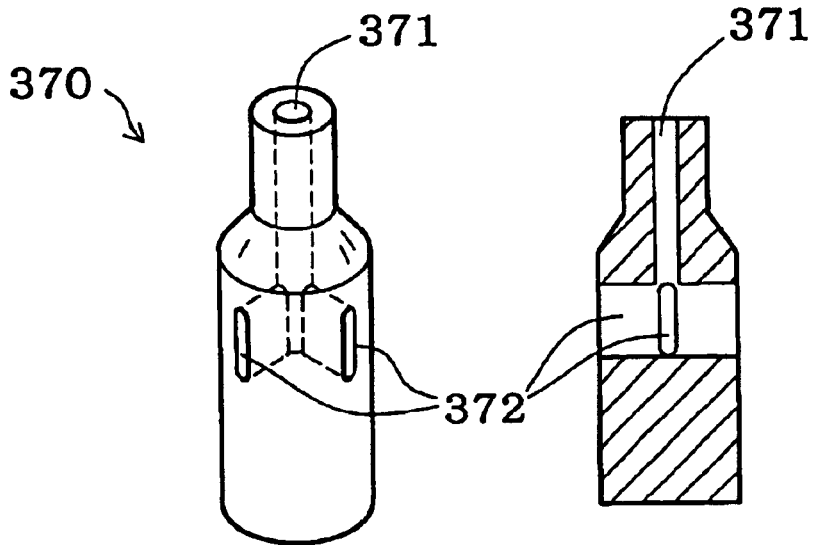
FIG. 42 is a descriptive diagram of a water jetting body 370 of a modified example, showing a simplified perspective view and longitudinal section thereof.

Next, a modified example of cleansing water rectification shall be described. FIG. 42 is a descriptive diagram of a water jetting body 370 of a modified example, showing a simplified perspective view and longitudinal section thereof, FIG. 43 is a descriptive diagram of a water jetting body 374 of another modified example, showing a longitudinal section and fragmentary enlarged section thereof, and FIG. 44 is a descriptive diagram of a water jetting body 380 of yet another modified example, showing a longitudinal section and fragmentary enlarged section thereof.

The water jetting body 370 shown in FIG. 42 has a water supply conduit 372, which guides cleansing water to a water jetting, spout 371, that is a conduit of slit form, this being formed intersecting in a cross shape. With this water jetting body 370 as well, as with the water supply conduit 13 of the water jetting body 10 described previously, the total passage sectional area of the water supply conduit 372 is wider than the water jetting spout 371. Therefore, by means of the conduit shape of the water supply conduit 372 per se and the area relationship relative to the water jetting spout 371, cleansing water receives high rectification and reaches the water jetting spout 371, where it is jetted. As a result of this, according to the water jetting body 370, the condition of jetting water accompanying swinging revolution/rotation of the water jetting body of the water jetting body can be stabilized further, and there are advantages in terms of improving reliability of jet as well.

Figure 43:
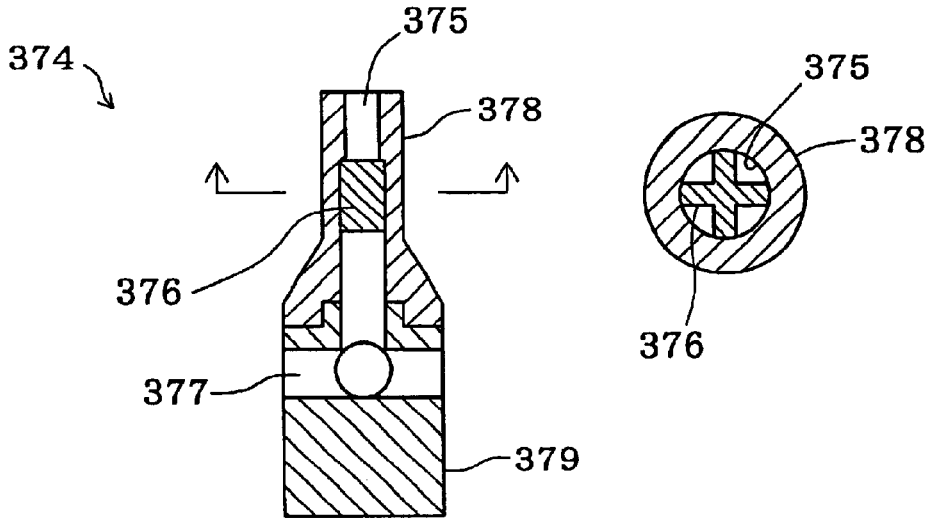
FIG. 43 is a descriptive diagram of a water jetting body 374 of another modified example, showing a longitudinal section and fragmentary enlarged section thereof.

The water jetting body 374 shown in FIG. 43 comprises a cross-shape rectifying member 376 at the front of a water jetting spout 375, and cleansing water from a water supply conduit 377 is rectified by this rectifying member 376 prior to being guided to the water jetting spout 375. Therefor, with this water jetting body 375 as well, it is possible to impart stabilized jet condition and improved reliability of jet as described above. Further, in consideration of assembly of the rectifying member 376, the force receiving member 379 and the water jetting member 378 are separate parts, with these two being fixed after the rectifying member has been assembled.

Figure 44:
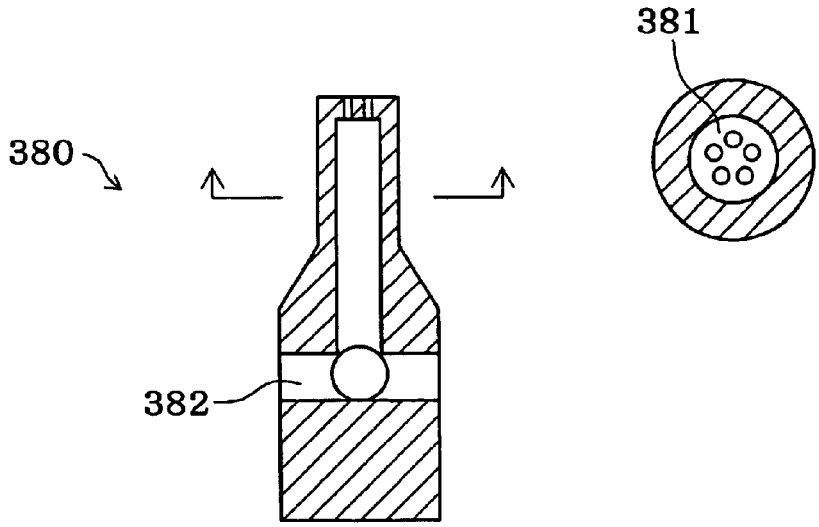
FIG. 44 is a descriptive diagram of a water jetting body 380 of yet another modified example, showing a longitudinal section and fragmentary enlarged section thereof.

The water jetting body 380 shown in FIG. 44 has the cleansing water jetting spout formed as an aggregation of small-diameter spouts 381, whereby cleansing water from a water supply conduit 382 is rectified and jetted. Accordingly, with this water jetting body 380 as well, it is possible to impart stabilized jet condition and improved reliability of jet as described above.

These water jetting bodies can be used appropriately in the examples and modified examples thereof described previously.

Figure 45:
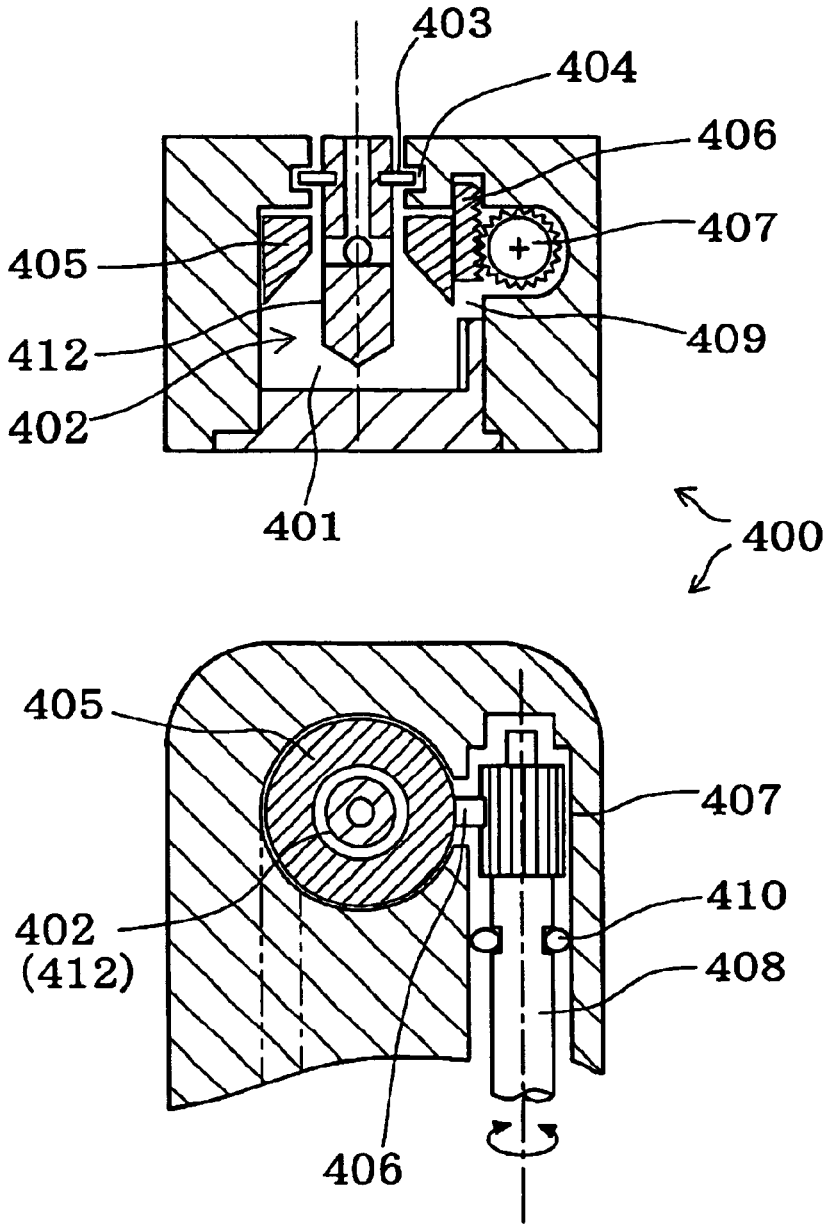
FIG. 45 is a descriptive diagram of a cleansing nozzle 400 of a modified example, showing a fragmentary longitudinal section and horizontal section thereof.

Yet another modified example shall be described next. This modified example features a variable extent of incline of the force receiving member of the water jetting body so that the extent of spread of revolving jet is adjustable. FIG. 45 is a descriptive diagram of a cleansing nozzle 400 of a modified example, showing a fragmentary longitudinal section and horizontal section thereof.

As shown in the drawing, this cleansing nozzle 400 comprises a vortex chamber 401 and a water jetting body 402. The water jetting body 402 is supported so as to be capable of swinging revolution in an opening inner groove 404 via an annular flange 403.

On the ceiling end of the vortex chamber 401 there is assembled a taper guide member 405. This taper guide member 405 is made to be able to move up and down within the vortex chamber 401, and has a rack 406 on the outside periphery thereof. The rack 406 meshes with a pinion 407 arranged inserted in the cleansing nozzle 400, and moves up and down through forward and reverse turning of a shaft 408. Therefore, the taper guide member 405 moves up and down in association with up and down movement of the rack 406. Also, the range of vertical motion of the rack 406, that is, the range of vertical motion of the taper guide member 405, is limited by the lower end/upper end of a rack housing portion 409.

The vortex chamber 401 communicates with the aforementioned pinion/shaft placement zone. However, since the communication site is in proximity to the vortex chamber roof, at the vortex chamber floor there are no effects on induction of the vortical flow described previously. Namely in the shaft placement zone, a seal ring 410 is installed on the shaft 408 to prevent water leakage.

Figure 46:
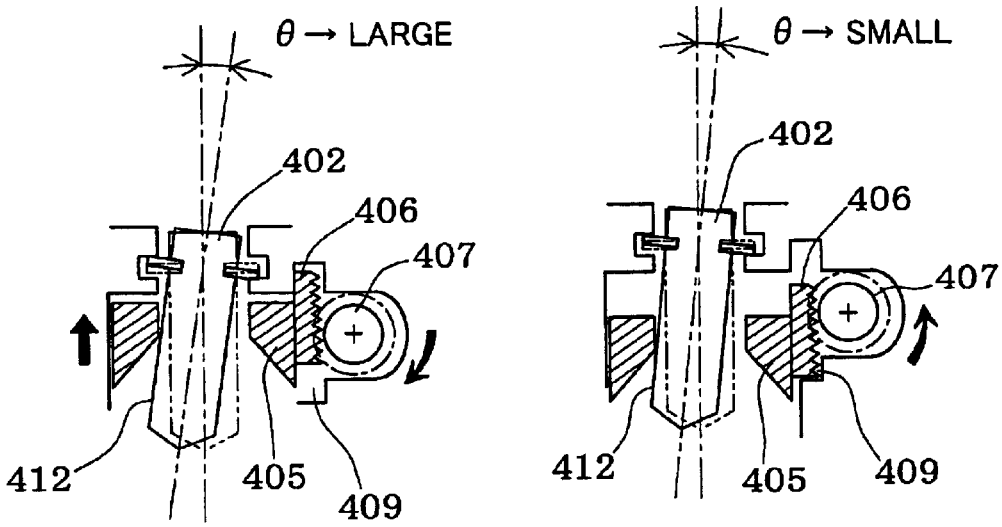
FIG. 46 is a descriptive diagram describing vertical motion of a taper guide 405 and the effect thereof.

The cleansing nozzle 400 having this arrangement produces the following effects through the agency of up and down motion of the taper guide member 405. FIG. 46 is a descriptive diagram describing vertical motion of the taper guide member 405 and the effect thereof.

As shown in the drawing, when the pinion 407 turns in a first direction to elevate the taper guide member 405, the contact zone of this guide member and the force receiving member 412 comes into proximity with the water jetting body 402 support location end. On the other hand, when the taper guide member 405 is lowered, the contact zone moves away from the aforementioned support location. Accordingly, the incline angle θ of the force receiving member 412 limited by contact with the taper guide member 405 varies in size in association with up and down motion of the taper guide member 405. By means of this, with the-cleansing nozzle 400 of the modified example, the extent of spread of the conical revolving jet that accompanies swinging revolution of the water jetting body 402 (the force receiving member 412) can be set wide or narrow, so the wash area can be readily adjusted to wide or narrow. Also, the shaft 408 for performing up and down motion of the taper guide member 405 is turned manually or by a motor etc.

Figure 47:
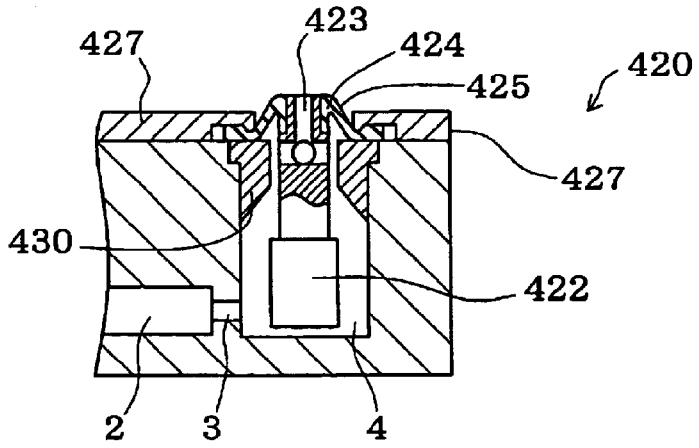
FIG. 47 is a descriptive diagram describing a cleansing nozzle 420 of a modified example.
Figure 48:
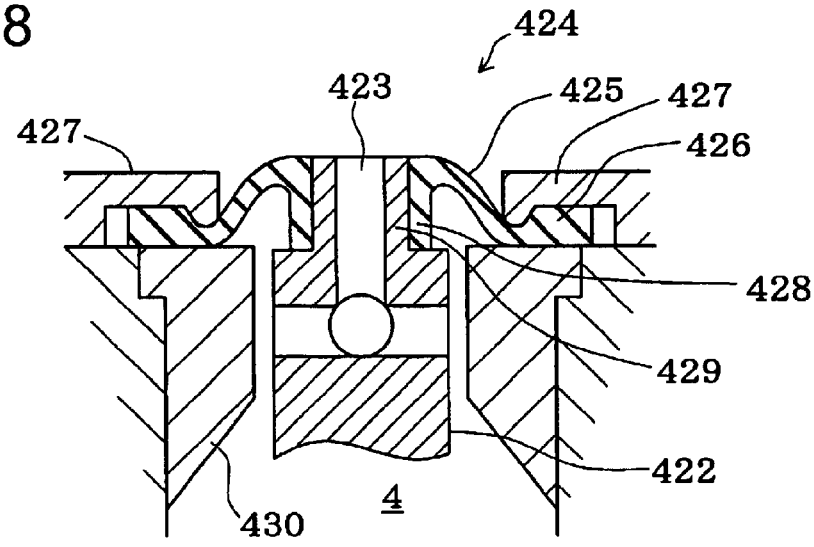
FIG. 48 is a fragmentary enlarged view of this cleansing nozzle 420.

Next, a modified example for improving sealing when supporting the water jetting body shall be described. FIG. 47 is a descriptive diagram describing a cleansing nozzle 420 of a modified example, and FIG. 48 is a fragmentary enlarged view of this cleansing nozzle 420.

As shown in the drawing, the cleansing nozzle 420 comprises a water jetting body 422 in the vortex chamber 4 and a flexible elastic body 424. The flexible elastic body 424 supports the water jetting body 422 at the end of a water jetting spout 423. With this elastic body 424 as well, as with the elastic body 225 described previously, it is formed of synthetic resin or thermoplastic elastomer, and can readily deform due to having a thin flex portion 425.

The elastic body 424 has a skirt portion of the flex portion 425 as a thick fixing portion 426, and this fixing portion 426 is pressed against an elastic body restraint 427 to fix the cleansing nozzle 420. Also, this elastic body 424 comprises in its center a cylindrical clasp member 428, a distal end small diameter portion 429 of the water jetting body 422 being mated with this cylindrical clasp member 428 to support the water jetting body 422. Therefore, the water jetting body 422, like the water jetting body described previously, can undergo swinging revolution. Also, on the ceiling end of the vortex chamber 4 there is fixed a taper guide member 430 for regulating the incline of the water jetting body 422.

Figure 49:
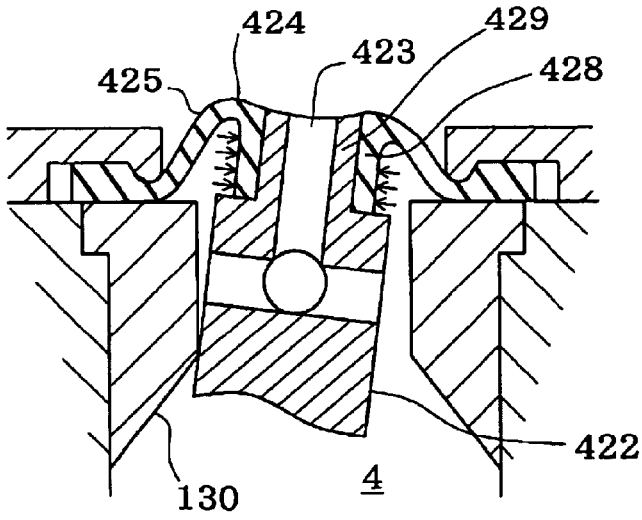
FIG. 49 is a descriptive diagram describing the effect of an elastic body 424 of the cleansing nozzle 420.

According to this cleansing nozzle 420 there are the following advantages. FIG. 49 is a descriptive diagram describing the effect of the elastic body 424 of the cleansing nozzle 420.

When water is supplied to the vortex chamber 4, the water jetting body 422 undergoes swinging revolution in the manner described previously, and during this time the vortex chamber 4 is full of cleansing water. Accordingly, the cleansing water in the vortex chamber passes through the gap between the taper guide member 430 and the water jetting body 422, and reaches the area around the cylindrical clasp member 428 of the elastic body 424, whereupon the cleansing water pressure now extends to the outside wall of the cylindrical clasp member 428. The cylindrical clasp member 428 having received this cleansing water pressure tightens the mated distal end small diameter portion 429 from the outside as shown by the arrows in the drawing, thereby enhancing sealing of the water jetting body 422 and the elastic body 424. As a result, reliability of the water jetting body seal increases, and cleansing water leakage from the cylindrical clasp member 428 can be favorably and unfailingly reduced. Moreover, leaking cleansing water does not occur from the cylindrical clasp member 428, so the revolving jet from the water jetting spout 423 is not disturbed by this leaking cleansing water, which is advantageous in terms of stabilizing the revolving jet. Further, as bonding is not needed when supporting the water jetting body 422 by the elastic body 424, there is no need for an adhesive or an application process therefor. Therefore, production process and assembly operation of the cleansing nozzle 420 can be provided simplify, which is advantageous in reducing cost as well. Also, by means of the aforementioned tightening, the previously described rotation of the water jetting body 422 can be made to not occur unfailingly and easily.

Figure 50:
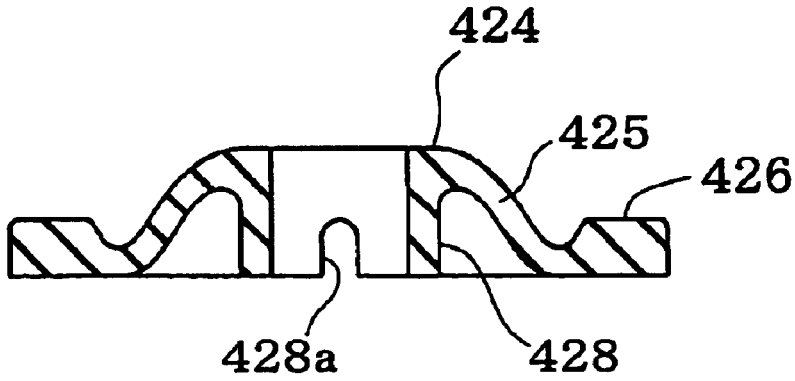
FIG. 50 is a descriptive diagram showing the elastic body 424 and a water jetting body 422 of a modified example of the cleansing nozzle 420.
Figure 50:
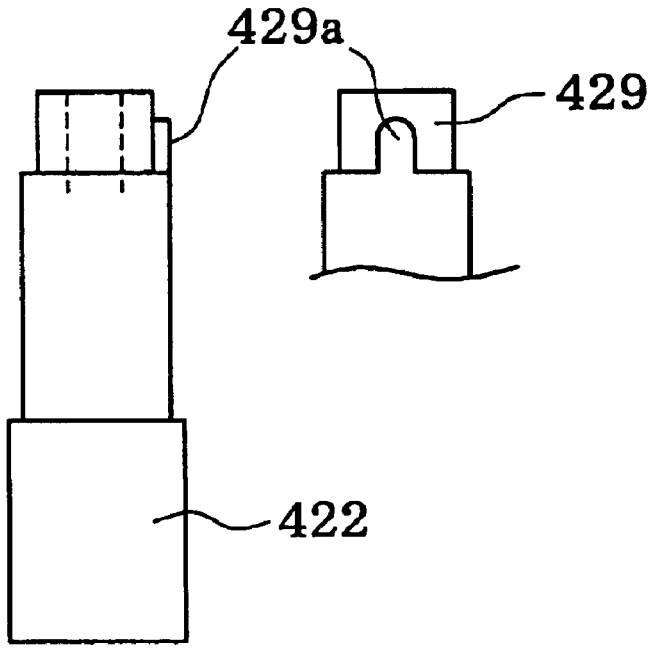

This cleansing nozzle 420 may be further modified in the following manner. FIG. 50 is a descriptive diagram showing the elastic body 424 and the water jetting body 422 of a modified example of the cleansing nozzle 420.

As shown in the drawing, with this modified example, the elastic body 424 comprises a notch 428*a* made in the cylindrical clasp member 428, and the water jetting body 422 has in the distal end small diameter portion 429 thereof a convex rib 429 mating with the notch 428*a*. By so doing, the water jetting body 422 supported by the elastic body 424 can be made to not turn about the axis thereof, which is advantageous where making the water jetting body so that it does not give rise-to rotation.

Figure 51:
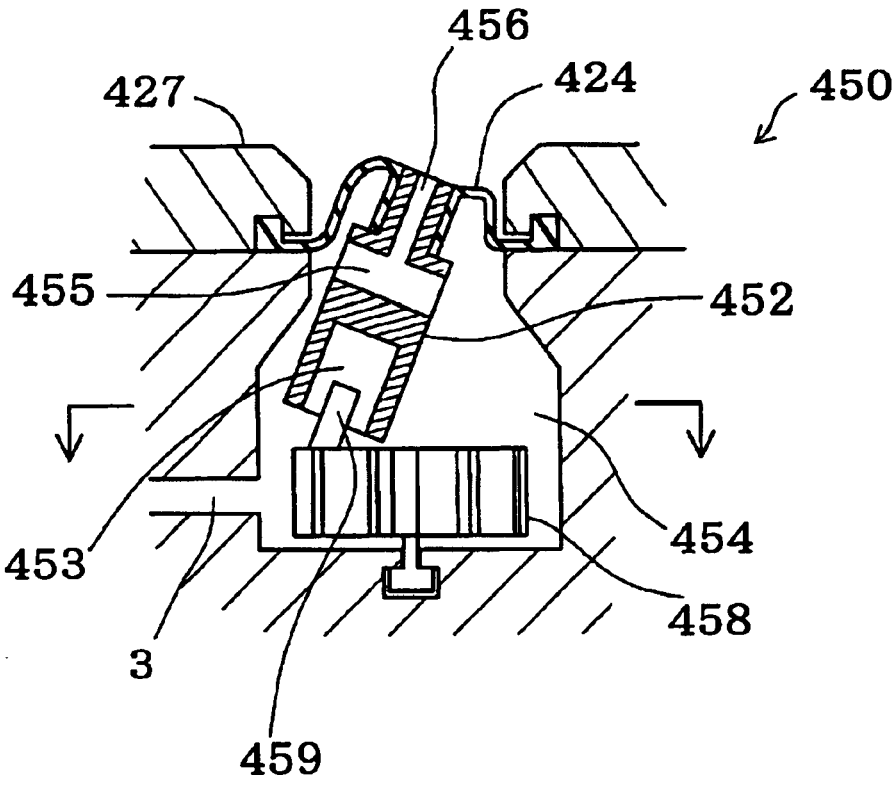
FIG. 51 is a descriptive diagram showing a cleansing nozzle 450 of another example in longitudinal sectional view and fragmentary sectional view.
Figure 51:
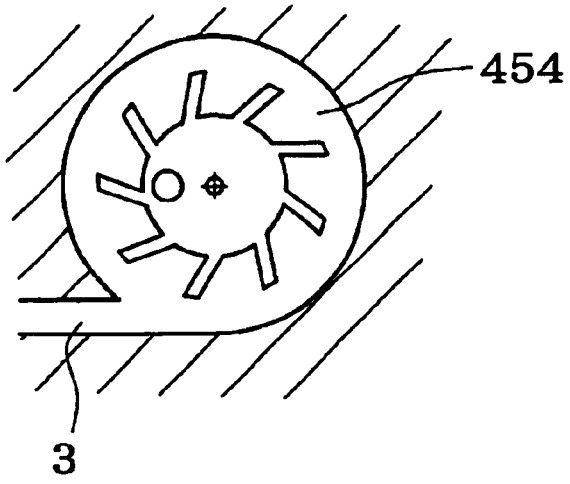

Next, another example shall be described. This example features enabling swinging revolution of the water jetting body through unification of both the water jetting body and the elastic body, and then transmitting turning force to this water jetting body based on water flow. FIG. 51 is a descriptive diagram showing a cleansing nozzle 450 of another example in longitudinal sectional view and fragmentary sectional view.

As shown in the drawing, this cleansing nozzle 450, like the cleansing nozzle 420 shown in FIG. 47, has a water jetting body 452 clasped by the elastic body 424 so that the water jetting body 452 is supported so as to be capable of swinging revolution within a vortex chamber 454. The water jetting body 452 jets cleansing water in the vortex chamber from a water jetting spout 456 via a water supply conduit 455.

Cleansing water inflows to the vortex chamber 454 from a tangential direction by means of the vortex chamber inflow conduit 3. And the inflowing cleansing water turns an impeller 458 that is rotatably axially supported on the vortex chamber floor. This impeller 458 comprises an inclined bar 459 at its upper end, the inclined bar 459 being inserted into a mating hole 453 at the lower end of the water jetting body 452. Accordingly, the turning motion of the impeller 458 turned by the inflowing cleansing water to the vortex chamber is transferred to the water jetting body 452 via the inclined bar 459, so the water jetting body 452 undergoes swinging revolution as described previously, and during this time the water jetting body does not give rise to rotation. By means of this, with this cleansing nozzle 450 as well, it is possible to obtain conical revolving jet, and effects similar to the example described above may be exhibited.

Figure 52:
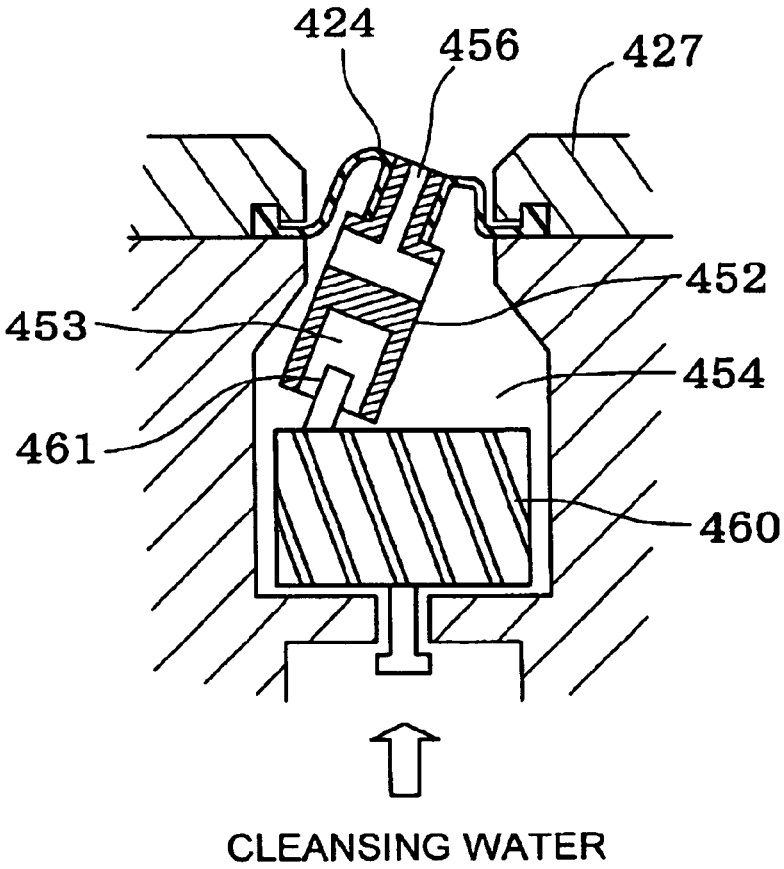
FIG. 52 is a descriptive diagram describing a modified example of the cleansing nozzle 450.

FIG. 52 is a descriptive diagram describing a modified example of the cleansing nozzle 450. With this modified example, there are the features of impeller arrangement and condition of cleansing water inflow to the vortex chamber.

As shown in the drawing, the cleansing nozzle 450 of this modified example has an impeller 460 that gyrates on the vortex chamber 454 floor by means of axial flow. This impeller 460 has on the outside peripheral wall a spiral groove that takes a spiral path, and by means of reaction force when a fluid (cleansing water) passes through this groove, rotates. Accordingly, when cleansing water inflows from the vortex chamber floor into the vortex chamber 454, the impeller 460 turns, and the turning motion is transferred to the water jetting body 452 via an inclined bar 461. Because of this, with this cleansing nozzle 450 as well, it is possible to give rise to swinging revolution of the water jetting body 452 and produce conical revolving jet, so effects similar to the example described above may be exhibited.

Figure 53:
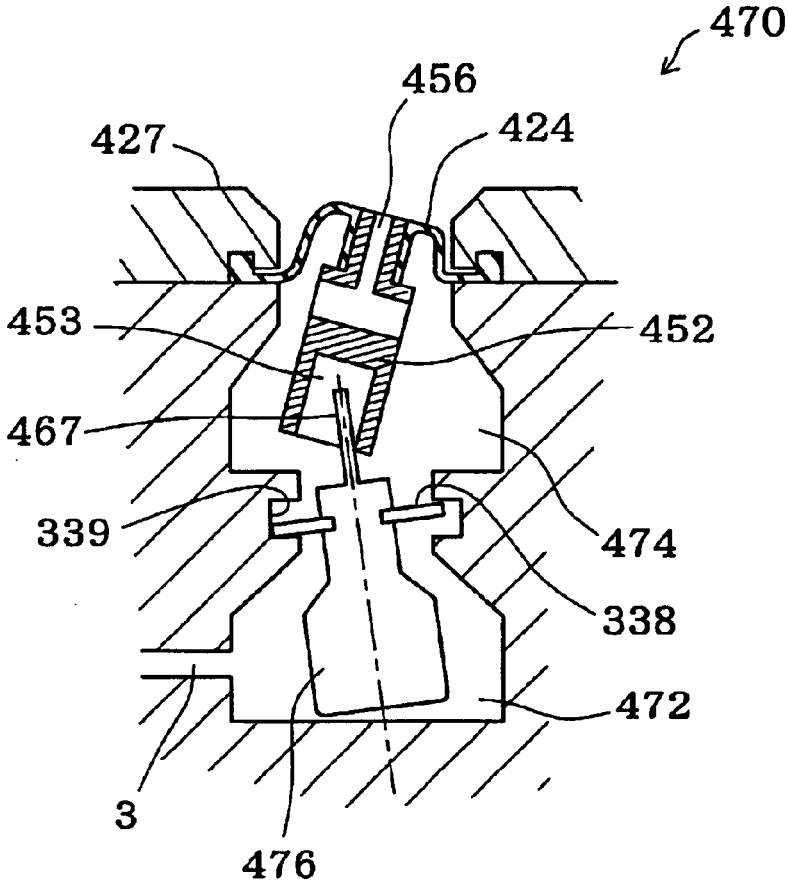
FIG. 53 is a descriptive diagram showing a cleansing nozzle 470 of yet another modified example.

Yet another modified example shall be described. This modified example features a combination of a mechanism for receiving lift based on a flow velocity differential of vortical flow to give rise to swinging revolution, and a water jetting body supported so as to be capable of swinging revolution. FIG. 53 is a descriptive diagram showing a cleansing nozzle 470 of yet another modified example.

As shown in the drawing, the cleansing nozzle 470 of this modified example has upper and lower cleansing water inflow chambers, the lower inflow chamber being a vortex chamber 472 where inflow of cleansing water is received from a tangential direction via the vortex chamber inflow conduit 3. By means of this, vortical flow is created in the vortex chamber 472 in the manner described previously. The upper portion of this vortex chamber 472 is a drive chamber 474 of the water jetting body 452 clasped by the elastic body 424.

The vortex chamber 472 has assembled therein a revolving body 476 instead of the water jetting body 10 etc.

described previously. This revolving body 476 is supported so as to be capable of swinging revolution on the upper mouth of the vortex chamber 472, by means of the annular flange 338 and the opening inner groove 339 in a similar manner to the water jetting body 10 in FIG. 36. Accordingly, when cleansing water inflows to the vortex chamber 472, the revolving body 476 gives rise to swinging revolution, and this revolving motion is transmitted to the water jetting body 452 via a mating shaft 467 at the upper end. This swinging revolution movement of the revolving body 476 is no different from turning motion of the impeller 458 etc. in the horizontal plane, so the water jetting body 452 having received transmission of this motion gives rise to swinging revolution. Therefore, even with the cleansing nozzle 470 of this modified example, conical revolving jet can be obtained, and effects similar to the above examples may be exhibited.

Also, cleansing water can be made to inflow to the drive chamber 474 via the vortex chamber 472 over various flow paths. For example, cleansing water can be flowed into the drive chamber 474 without hindrance through a location other than that where the flange 338 is one-sided touching the opening inner groove 339. Also, a bypass, not shown, may be provided inside the revolving body 476, and cleansing water from this bypass flowed into the drive chamber 474. Or, there may be provided at the perimeter of the vortex chamber 472 and the drive chamber 474 a bypass that bypasses the perimeter of the opening inner groove 339, and cleansing water from this bypass flows into the drive chamber 474.

Figure 54:
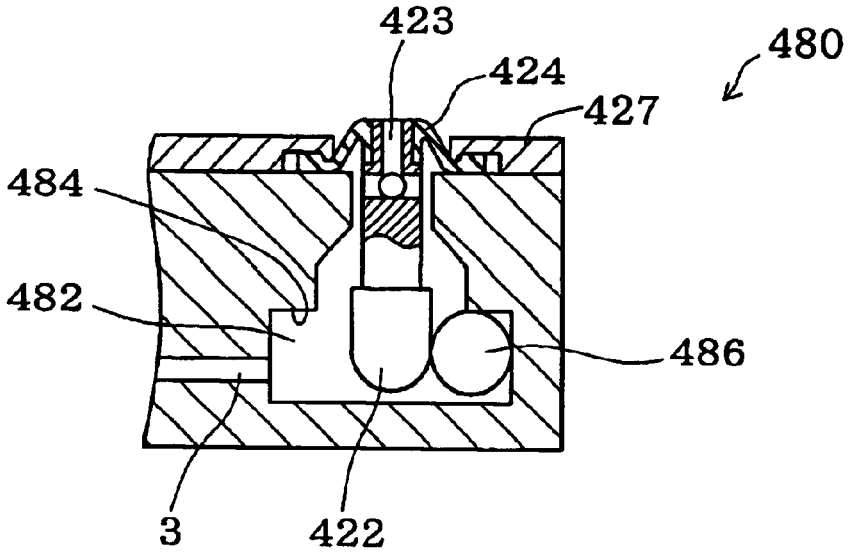
FIG. 54 is a descriptive diagram showing a cleansing nozzle 480 of a modified example in longitudinal cross section.

Next, another modified example of transmission of turning force based on water flow to a water jetting body capable of swinging revolution shall be described. FIG. 54 is a descriptive diagram showing a cleansing nozzle 480 of a modified example in longitudinal cross section.

As shown in the drawing, this cleansing nozzle 480 has the water jetting body 422 clasped by the elastic body 424, assembled in a vortex chamber 482. This vortex chamber 482 has a groove 484 form annularly in the floor thereof, and a ball 486 is assembled in this groove. This ball 486 can turn along the groove 484 while vertical motion is limited by the upper and lower walls of the groove 484.

With the ball 486 assembled in this state, the ball 486 contacts the water jetting body 422 and inclines the water jetting body 422 in the manner shown in the drawing. When cleansing water inflows into the vortex chamber 482 in a tangential direction from the vortex chamber inflow conduit 3, the ball 486 is pushed by the inflowing water and gyrates in the groove 484. When the ball 486 gyrates in this way, the water jetting body 422 which is contacting the ball 486 changes its incline direction while remaining inclined, giving rise to the swinging revolution described previously. Therefore, even with the cleansing nozzle 480 of this modified example, conical revolving jet can be obtained, and effects similar to the above examples may be exhibited. The ball 486 is not limited as to the material thereof, and can be resin or metal, etc. Where made of metal, mass will be higher, so inertial force after gyrating along the groove 484 will be greater, which is convenient in terms of maintaining swinging revolution of the water jetting body.

The present invention is not limited to the examples and modified examples shown above, and may be realized in various modes.

Figure 55:
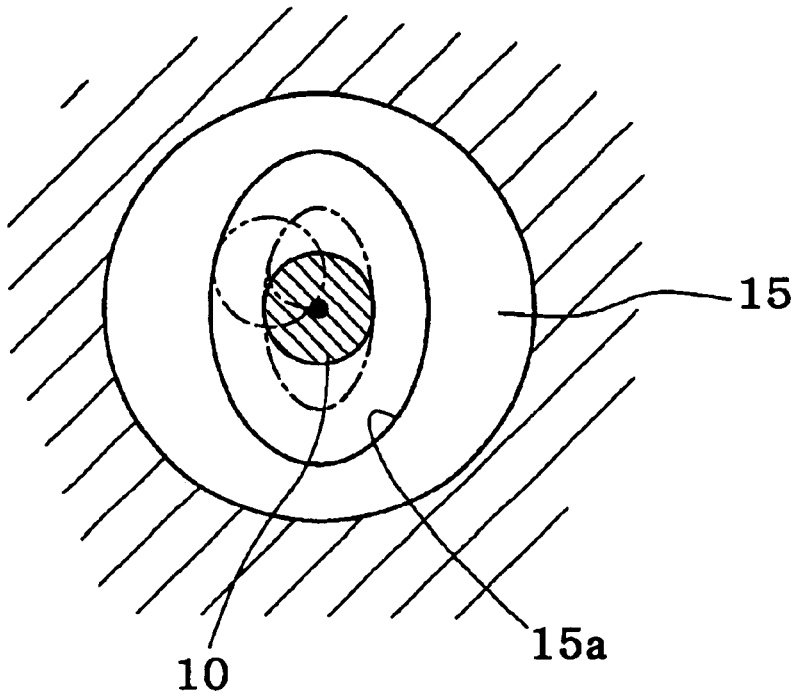
FIG. 55 is a descriptive diagram describing the condition of incline restriction of the water jetting body 10 by a taper guide member 15.

For example, where the angle of incline of the water jetting body 10 is restricted by the taper guide member 15, the following may be done. FIG. 55 is a descriptive diagram describing the condition of incline restriction of the water jetting body 10 by the taper guide member 15.

As shown in the drawing, the taper guide member 15 has a water jetting body guide opening 15*a* of elliptical shape in horizontal cross section, and incline of the water jetting body 10 is restricted by the guide opening 15*a* of elliptical shape. That is, the water jetting body 10 begins swinging revolution due to vortical flow in the aforementioned the vortex chamber, and by means of contact with the guide opening 15*a* revolves on a path shown by the single dot-dashed line in the drawing, in conformance to the shape of the opening. Because of this, according to this modified example, the path of swinging revolution, and hence the path of revolution of cleansing water, may be modified. Therefore, by making the guide opening shape conform to the shape of the contact target of the cleansing water, cleansing water can be made to contact in a pattern matching the shape of the contact target.

INDUSTRIAL APPLICABILITY

The water jetting device of the present invention is applicable to a water jetting nozzle device for jetting supplied water from a nozzle, various implementing same, for example, a human body part a shower device, a dish-cleansing device and the like.

What is claimed is:

1. A water jetting device comprising a nozzle, for jetting from the nozzle cleansing water supplied thereto, wherein the nozzle has;

an inflow chamber into which cleansing water flows, a water jetting body assembled in the inflow chamber, having a water jetting member comprising a cleansing water jetting spout and a chamber-housed member continuous with the water jetting member and situated within the inflow chamber, the water jetting body having a conduit for guiding cleansing water in the inflow chamber to the water jetting spout, and a water supply mechanism for guiding cleansing water into the inflow chamber in such a way that vortical flow around the chamber-housed member along the inside peripheral wall of the inflow chamber is created in cleansing water flowing into the inflow chamber, the water jetting body is assembled in the inflow chamber with the water jetting spout located in proximity to the exterior of the inflow chamber, such that the chamber-housed member is capable of swinging in an inclined attitude within the inflow chamber, the water supply mechanism generates a flow velocity differential in the vortical flow around the chamber-housed member, the force generated on the basis of the flow velocity differential exerting influence on the chamber-housed member whereby the chamber-housed member at an inclined attitude within the inflow chamber induces swinging motion and revolution of the water jetting body.

2. A water jetting device according to claim 1, wherein the inflow chamber is of cylindrical shape, and the chamber-housed member of the water jetting body is of generally round columnar shape.

3. A water jetting device according to claim 2, wherein outside diameter of the chamber-housed member is about 35–80% of inside diameter of the inflow chamber.

4. A water jetting device according to claim 1, wherein at least one of the inflow chamber and the chamber-housed member has peripheral wall shape such that a difference in flow velocity of the vortex chamber is created around the chamber-housed member.

5. A water jetting device according to claim 4, wherein at least one of the peripheral wall of the inflow chamber and the peripheral wall of the chamber-housed member has a peripheral wall regions of different curvatures.

6. A water jetting device according to of claim 1, wherein the water supply mechanism has a nozzle conduit communicating eccentrically with the inflow chamber at a peripheral wall of the inflow chamber.

7. A water jetting device according to claim 1, wherein the water supply mechanism has a plurality of nozzle conduits communicating eccentrically with the inflow chamber at a peripheral wall of the inflow chamber, and the vortical flow is created by cleansing water inflowing to the inflow chamber from the plurality of nozzle conduits.

8. A water jetting device according to claim 7, wherein the plurality of nozzle conduits inflow cleansing water to the inflow chamber at different flow velocities.

9. A water jetting device according to claim 8, wherein the plurality of nozzle conduits have different conduit areas.

10. A water jetting device according to claim 7, wherein the plurality of nozzle conduits communicate with the inflow chamber peripheral wall at asymmetric locations with respect to the center of the inflow chamber.

11. A water jetting device according to claim 1, wherein the water jetting body of the nozzle inclines the chamber-housed member with respect to the inflow chamber during non-jet times when there is no inflow of cleansing water to the inflow chamber.

12. A water jetting device according to claim 11, wherein the nozzle assumes an inclined attitude in the horizontal plane, and the water jetting body under gravity acting thereupon inclines the chamber-housed member with respect to the inflow chamber during the non-jet times.

13. A water jetting device according to claim 11, wherein the inflow chamber has a projection in the center of the inflow chamber floor, the water jetting body being caused by means of the projection to incline the chamber-housed member with respect to the inflow chamber during the non-jet times.

14. A water jetting device according to claim 11, wherein the water jetting body comprises a projection at the chamber-housed member lower end, and by means of the projection is caused to incline the chamber-housed member with respect to the inflow chamber during the non-jet times.

15. A water jetting device according to claim 1, wherein the inflow chamber has a tapered inside peripheral wall of small diameter at the water jetting member end of the water jetting body, the chamber-housed member of the water jetting body has generally columnar shape.

16. A water jetting device according to claim 1, wherein the water jetting body assembled in the inflow chamber comprises the water jetting member as a column body smaller in diameter than the chamber-housed member.

17. A water jetting device according to claim 1, wherein the inflow chamber has an opening, the water jetting spout of the water jetting member in the water jetting body being made to border the outside from the opening, and the opening rim serving as a swivel plate for the distal end of the water jetting member.

18. A water jetting device according to claim 17, wherein the inflow chamber has an annular projection, which is projected towards the water jetting member distal end, on the opening rim.

19. A water jetting device according to claim 1, wherein the water jetting body has the chamber-housed member that is greater in mass than the water jetting member.

20. A water jetting device according to claim 1, wherein the water jetting body while giving rise to the revolution gives rise to rotation wherein the water jetting body per se turns about the axis of the chamber-housed member.

21. A water jetting device according to claim 20, wherein the water jetting body has the conduit leading to the water jetting spout of the water jetting member, that is inclined with respect to the rotation axis of the water jetting body.

22. A water jetting device according to claim 20, wherein the water jetting body has the conduit leading to the water jetting spout of the water jetting member, which is eccentric with respect to the rotation axis of the water jetting body.

23. A water jetting device according to claim 1, wherein the water jetting body has the water jetting spout of slot shape.

24. A water jetting device according to claim 1, wherein the water jetting body has the water jetting spout of expanded taper shape.

25. A water jetting device according to claim 1, wherein the water jetting body further comprises a rectification mechanism for giving rise to rectification in the flow of cleansing water during guiding of cleansing water to the water jetting spout.

26. A water jetting device according to claim 1 wherein the water jetting body has the water jetting spout formed by a plurality of openings.

27. A water jetting device according to claim 1, wherein the nozzle further comprises an adjustment mechanism for width/narrowness adjustment of the extent of incline of the chamber-housed member of the water jetting body in the inflow chamber.

28. A water jetting device according to claim 1, wherein the nozzle further comprises a flexible clasp body for clasping the water jetting body, the clasp body provides closure to the inflow chamber.

29. A water jetting device according to claim 28, wherein the clasp body further comprises a cylindrical clasp member for mating with the water jetting body to clasp the water jetting body, the water pressure of cleansing water inflowing to the inflow chamber being cause to act on the outside wall of the cylindrical clasp member.

30. A water jetting device according to claim 28, wherein the clasp body has different clasp body thickness along the radial direction with the clasp zone of the water jetting body as the center.

31. A water jetting device according to claim 28, wherein the clasp body further comprises an outwardly convex flex member around the clasp zone of the water jetting body clasped with the clasp body.

32. A water jetting device according to claim 28, wherein the clasp body is formed of one polyester based, polyolefin based, or polystyrene based thermoplastic elastomer.

33. A water jetting device according to claim 28, wherein the clasp body further comprises a sheet composed of resin and capable of bending utilizing the elasticity of the resin.

34. A water jetting device according to claim 33, wherein the molding resin of the clasp body is one of PP (polypropylene), ABS (acrylonitrile-butadiene-styrene copolymer), or POM (polyacetal).

35. A water jetting device according to claim 28, wherein where fn is the natural frequency of the clasp body, and f is the frequency defined by the cycle of revolution produced by the water jetting body, the value of the ratio f/fn fulfills 0.5 (f/fn) 10.

36. A water jetting device according to claim 1, wherein the nozzle has a plurality of the inflow chambers and the water jetting bodies assembled therein.

37. A water jetting device according to claim 1, wherein the frequency defined by the cycle of revolution given rise to by the water jetting body is 3 Hz and more.

38. A water jetting device according to claim 37, wherein the frequency is 40 Hz and more.

39. A water jetting device according to claim 37, wherein the frequency is 380 Hz and below.

40. A human body part cleansing device for jetting supplied cleansing water onto a localized area of the human body, the human body part cleansing device is characterized by having the water jetting device according to claim 1, and jetting cleansing water onto the localized area of the human body from the nozzle comprised in the water jetting device.

41. A human body part cleansing device according to claim 40, wherein the water jetting device is portable.

42. A human body part cleansing device according to claim 40, wherein the water jetting device has the nozzle extendable to and retractable from a location opposite the localized area of the human body from the rear of a toilet.

43. A shower device for jetting supplied water onto a human body, the shower device is characterized by having the water jetting device according to claim 1, and jetting cleansing water from the nozzle, comprised in the water jetting device, onto the human body.

44. A washing device for jetting supplied cleansing water onto an article to be washed, the washing device is characterized by having the water jetting device according to claim 1, and jetting cleansing water from the nozzle, comprised in the water jetting device, onto the article to be washed.

45. A washing device according to claim 44 having the nozzle in a wash chamber wherein the article to be washed is housed.

46. A washing device according to claim 45, the washing device further comprises;

a spinning arm arranged in the wash chamber and turnable about a turning axis, and a water supply conduit for supplying cleansing water to the nozzles arranged to either side of the turning axis in terminal portions of the spinning arm, wherein each the nozzle jets cleansing water oriented on the diagonal with respect to the spinning arm so that reaction force created by cleansing water jet imparts to the spinning arm turning in the same direction about the turning axis.

47. A water jetting device comprising a nozzle, for jetting from the nozzle cleansing water supplied thereto, wherein the nozzle has;

an inflow chamber into which cleansing water flows, a water jetting body assembled in the inflow chamber, having a water jetting member comprising a cleansing water jetting spout and a chamber-housed member continuous with the water jetting member and situated within the inflow chamber, the water jetting body having a conduit for guiding cleansing water in the inflow chamber to the water jetting spout, a flexible clasp body for clasping the water jetting body, the clasp body, with the water jetting spout being placed bordering the outside of the inflow chamber, providing closure to the inflow chamber such that the chamber-housed member is assembled within the inflow chamber so as to be capable of swinging in an inclined attitude within the inflow chamber;

a water supply mechanism for guiding cleansing water into the flow chamber; and a transmission mechanism for creating vortical force around the inner peripheral wall of the inflow chamber by means of cleansing water inflow to the inflow chamber through the water supply mechanism, exerting the vortical force on the chamber-housed member, and creating swinging movement and revolution of the water jetting body with the chamber-housed member in an inclined attitude within the inflow chamber.

48. A water jetting device according to claim 47, wherein the water jetting body and the clasp body are integrally arranged.

49. A water jetting device according to claim 47, wherein the water jetting body has the conduit which leads to the water jetting spout of the water jetting member and inclines with respect to the center axis of the water jetting body.

* * * * *

UNITED STATES PATENT AND TRADEMARK OFFICE

CERTIFICATE OF CORRECTION

PATENT NO. : 6,795,981 B2
DATED : September 28, 2004
INVENTOR(S) : Sato et al.

It is certified that error appears in the above-identified patent and that said Letters Patent is hereby corrected as shown below:

Column 23,
Line 39, change “time to” to -- time t0 --.

Column 28,
Line 9, change “water 5a” to -- water Sa --.

Column 45,
Line 43, change “line 3333” to -- line 33-33 --.

Column 54,
Line 20, change “various implementing same” to -- various cleansing devices implementing same --.
Line 21, change “part a shower” to -- part cleansing device, a shower --.

Column 55,
Line 3, change “to of claim 1” to -- to claim 1 --.

Signed and Sealed this

First Day of February, 2005

JON W. DUDAS
*Director of the United States Patent and Trademark Office*